US011253756B2

(12) United States Patent
Hoffman et al.

(10) Patent No.: US 11,253,756 B2
(45) Date of Patent: Feb. 22, 2022

(54) GOLF CLUB HEAD

(71) Applicant: Taylor Made Golf Company, Inc, Carlsbad, CA (US)

(72) Inventors: Joseph H. Hoffman, Carlsbad, CA (US); Matthew D. Johnson, Carlsbad, CA (US); Todd Beach, Encinitas, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

(21) Appl. No.: 16/883,832

(22) Filed: May 26, 2020

(65) Prior Publication Data

US 2020/0353322 A1 Nov. 12, 2020

Related U.S. Application Data

(63) Continuation of application No. 16/223,108, filed on Dec. 17, 2018, now Pat. No. 10,695,621, which is a (Continued)

(51) Int. Cl.
*A63B 53/04* (2015.01)
*A63B 53/06* (2015.01)
(Continued)

(52) U.S. Cl.
CPC ..... *A63B 53/0466* (2013.01); *A63B 53/06* (2013.01); *A63B 60/02* (2015.10);
(Continued)

(58) Field of Classification Search
CPC ..... A63B 53/0466; A63B 60/02; A63B 60/50; A63B 53/06; A63B 53/0408;
(Continued)

(56) References Cited

U.S. PATENT DOCUMENTS 1,907,134 A 5/1933 Weiskopf
5,106,094 A 4/1992 Desbiolles et al.
(Continued)

FOREIGN PATENT DOCUMENTS

JP 1142300 2/1999
JP 2000317018 11/2000
(Continued)

OTHER PUBLICATIONS

Office Action concerning Taiwan Patent Application No. 107146805 dated Jun. 24, 2019 with English summary.
(Continued)

*Primary Examiner* — Michael D Dennis
(74) *Attorney, Agent, or Firm* — Kunzler Bean & Adamson

(57) ABSTRACT

Disclosed herein is a golf club head that comprises a strike face. The strike face has a central region, defined by a forty millimeter by twenty millimeter rectangular area centered on a center of the strike face and elongated in a heel-to-toe direction. Within the central region, the strike face has a characteristic time (CT) of no more than 257 microseconds. Within the central region, no less than 25% of the strike face has a coefficient of restitution (COR) of at least 0.8. Within the central region, no less than 60% of the strike face has a CT of at least 235 microseconds. Within the central region, no less than 35% of the strike face has a CT of at least 240 microseconds.

20 Claims, 47 Drawing Sheets

Related U.S. Application Data continuation-in-part of application No. 16/167,078, filed on Oct. 22, 2018, now Pat. No. 10,589,155, which is a continuation-in-part of application No. 15/857,407, filed on Dec. 28, 2017, now Pat. No. 10,188,915.

(60) Provisional application No. 62/772,560, filed on Nov. 28, 2018.

(51) Int. Cl.

| | |
|---|---|
| ***A63B 60/02*** | (2015.01) |
| ***A63B 60/50*** | (2015.01) |
| ***A63B 102/32*** | (2015.01) |
| ***A63B 53/08*** | (2015.01) |
| ***A63B 60/52*** | (2015.01) |

(52) U.S. Cl.

CPC ..... *A63B 60/50* (2015.10); *A63B 53/0408* (2020.08); *A63B 53/0412* (2020.08); *A63B 53/0433* (2020.08); *A63B 53/0437* (2020.08); *A63B 53/0454* (2020.08); *A63B 53/0458* (2020.08); *A63B 53/08* (2013.01); *A63B 60/52* (2015.10); *A63B 2053/0491* (2013.01); *A63B 2102/32* (2015.10)

(58) Field of Classification Search

CPC ..... A63B 53/0412; A63B 53/0433; A63B 53/0437; A63B 53/0454; A63B 53/0458; A63B 60/52; A63B 2053/0491; A63B 2102/32; A63B 53/08; A63B 53/04; A63B 53/045

See application file for complete search history.

(56) References Cited

U.S. PATENT DOCUMENTS

| | | | |
|---|---|---|---|
| 5,395,113 | A | 3/1995 | Antonious |
| 5,405,137 | A | 4/1995 | Vincent et al. |
| 5,431,396 | A | 7/1995 | Shieh |
| 5,467,983 | A | 11/1995 | Chen |
| 5,482,279 | A | 1/1996 | Antonious |
| 5,524,331 | A | 6/1996 | Pond |
| 5,547,427 | A | 8/1996 | Rigal et al. |
| 5,586,948 | A | 12/1996 | Mick |
| 5,624,331 | A | 4/1997 | Lo et al. |
| 5,704,850 | A | 1/1998 | Shieh |
| 5,743,813 | A | 4/1998 | Chen et al. |
| 6,146,571 | A | 11/2000 | Vincent et al. |
| 6,296,576 | B1 | 10/2001 | Capelli |
| 6,299,547 | B1 | 10/2001 | Kosmatka |
| 6,306,048 | B1 | 10/2001 | McCabe et al. |
| 6,315,678 | B1 | 11/2001 | Teramoto |
| 6,454,665 | B2 | 9/2002 | Antonious |
| 6,525,157 | B2 | 2/2003 | Cozewith et al. |
| 6,602,150 | B1 | 8/2003 | Kosmatka |
| 6,773,360 | B2 | 8/2004 | Willett et al. |
| 6,800,038 | B2 | 10/2004 | Willett et al. |
| 6,824,475 | B2 | 11/2004 | Burnett et al. |
| 6,835,145 | B2 | 12/2004 | Tsurumaki |
| 6,872,152 | B2 | 3/2005 | Beach et al. |
| 6,945,876 | B2 | 9/2005 | Nakahara et al. |
| 6,997,820 | B2 | 2/2006 | Willett et al. |
| 7,059,973 | B2 | 6/2006 | Erickson et al. |
| 7,108,612 | B2 | 9/2006 | Nakahara et al. |
| 7,140,974 | B2 | 11/2006 | Chao et al. |
| 7,166,040 | B2 | 1/2007 | Chao et al. |
| 7,186,190 | B1 | 3/2007 | Beach et al. |
| 7,204,768 | B2 | 4/2007 | Nakahara et al. |
| 7,223,180 | B2 | 5/2007 | Willett et al. |
| 7,258,630 | B2 | 8/2007 | Erickson et al. |
| 7,267,620 | B2 | 9/2007 | Chao et al. |
| 7,407,447 | B2 | 8/2008 | Beach et al. |
| 7,410,425 | B2 | 8/2008 | Willett et al. |
| 7,410,426 | B2 | 8/2008 | Willett et al. |
| 7,419,441 | B2 | 9/2008 | Hoffman et al. |
| 7,431,668 | B2 | 10/2008 | Tateno et al. |
| 7,448,963 | B2 | 11/2008 | Beach et al. |
| 7,452,285 | B2 | 11/2008 | Chao et al. |
| 7,462,109 | B2 | 12/2008 | Erickson et al. |
| 7,530,904 | B2 | 5/2009 | Beach et al. |
| 7,540,811 | B2 | 6/2009 | Beach et al. |
| 7,568,985 | B2 | 8/2009 | Beach et al. |
| 7,578,753 | B2 | 8/2009 | Beach et al. |
| 7,578,756 | B2 | 8/2009 | Erickson et al. |
| 7,585,233 | B2 | 9/2009 | Horacek et al. |
| 7,591,738 | B2 | 9/2009 | Beach et al. |
| 7,621,823 | B2 | 11/2009 | Beach et al. |
| 7,628,707 | B2 | 12/2009 | Beach et al. |
| 7,628,712 | B2 | 12/2009 | Chao et al. |
| 7,632,194 | B2 | 12/2009 | Beach et al. |
| 7,651,412 | B2 | 1/2010 | Meyer et al. |
| 7,713,142 | B2 | 5/2010 | Hoffman et al. |
| 7,717,804 | B2 | 5/2010 | Beach et al. |
| 7,717,805 | B2 | 5/2010 | Beach et al. |
| 7,731,603 | B2 | 6/2010 | Beach et al. |
| 7,744,484 | B1 | 6/2010 | Chao et al. |
| RE41,577 | E | 8/2010 | McLean et al. |
| 7,775,905 | B2 | 8/2010 | Beach et al. |
| 7,815,522 | B2 | 10/2010 | Horacek et al. |
| 7,824,280 | B2 | 11/2010 | Yokota |
| 7,846,041 | B2 | 12/2010 | Beach et al. |
| 7,874,936 | B2 | 1/2011 | Chao |
| 7,874,937 | B2 | 1/2011 | Chao et al. |
| 7,874,938 | B2 | 1/2011 | Chao et al. |
| 7,887,431 | B2 | 2/2011 | Beach et al. |
| 7,927,232 | B2 | 4/2011 | Horacek et al. |
| 7,942,759 | B2 | 5/2011 | Matsunaga et al. |
| 7,963,861 | B2 | 6/2011 | Beach et al. |
| RE42,544 | E | 7/2011 | Chao et al. |
| 7,985,146 | B2 | 7/2011 | Lin et al. |
| 8,012,042 | B2 | 9/2011 | Abe |
| 8,016,691 | B2 | 9/2011 | Stites |
| 8,025,587 | B2 | 9/2011 | Beach et al. |
| 8,088,024 | B2 | 1/2012 | Horacek et al. |
| 8,096,897 | B2 | 1/2012 | Beach et al. |
| 8,235,831 | B2 | 8/2012 | Beach et al. |
| 8,235,844 | B2 | 8/2012 | Albertsen et al. |
| 8,241,143 | B2 | 8/2012 | Albertsen et al. |
| 8,241,144 | B2 | 8/2012 | Albertsen et al. |
| 8,262,503 | B2 | 9/2012 | Horacek et al. |
| 8,303,431 | B2 | 11/2012 | Beach et al. |
| 8,337,319 | B2 | 12/2012 | Sargent et al. |
| 8,353,786 | B2 | 1/2013 | Beach et al. |
| 8,353,787 | B2 | 1/2013 | Meyer et al. |
| 8,403,769 | B2 | 3/2013 | Stites |
| 8,444,504 | B2 | 5/2013 | Chao et al. |
| 8,444,505 | B2 | 5/2013 | Beach et al. |
| 8,628,434 | B2 | 1/2014 | Chao et al. |
| 8,734,271 | B2 | 5/2014 | Beach et al. |
| 8,747,250 | B2 | 6/2014 | Chao et al. |
| 8,771,095 | B2 | 7/2014 | Beach et al. |
| 8,795,100 | B2 | 8/2014 | Horacek et al. |
| 8,801,541 | B2 | 8/2014 | Beach et al. |
| 8,858,359 | B2 | 10/2014 | Willett et al. |
| 8,870,678 | B2 | 10/2014 | Beach et al. |
| 8,888,607 | B2 | 11/2014 | Harbert et al. |
| 8,900,069 | B2 | 12/2014 | Beach et al. |
| 8,956,242 | B2 | 2/2015 | Rice et al. |
| 9,033,821 | B2 | 5/2015 | Beach et al. |
| 9,044,653 | B2 | 6/2015 | Wahl et al. |
| 9,162,115 | B1 | 10/2015 | Beach et al. |
| 9,174,096 | B2 | 11/2015 | Sargent et al. |
| 9,220,953 | B2 | 12/2015 | Beach et al. |
| 9,259,625 | B2 | 2/2016 | Sargent et al. |
| 9,358,430 | B2 | 6/2016 | Greaney et al. |
| 9,399,156 | B2 | 7/2016 | Horacek et al. |
| 9,662,545 | B2 | 5/2017 | Beach et al. |
| 9,707,457 | B2 | 7/2017 | Mata et al. |
| 9,795,840 | B2 | 10/2017 | Greensmith et al. |
| 9,861,864 | B2 | 1/2018 | Beach et al. |
| 9,914,027 | B1 | 3/2018 | Harbert et al. |

(56) References Cited

U.S. PATENT DOCUMENTS

| | | | | |
|---|---|---|---|---|
| 9,943,734 | B2 | 4/2018 | James et al. | |
| 9,973,734 | B2 | 4/2018 | James et al. | |
| 2003/0027662 | A1 | 2/2003 | Werner et al. | |
| 2003/0034142 | A1* | 2/2003 | Bliss | A63B 53/0466 164/76.1 |
| 2004/0116207 | A1* | 6/2004 | De Shiell | A63B 53/0466 473/345 |
| 2004/0166959 | A1 | 8/2004 | Chen | |
| 2005/0221913 | A1 | 10/2005 | Kusumoto | |
| 2006/0019770 | A1 | 1/2006 | Meyer et al. | |
| 2006/0079345 | A1 | 4/2006 | Gibbs et al. | |
| 2008/0139339 | A1 | 6/2008 | Cheng | |
| 2008/0149267 | A1 | 6/2008 | Chao et al. | |
| 2009/0163289 | A1 | 6/2009 | Chao et al. | |
| 2009/0286622 | A1* | 11/2009 | Yokota | A63B 53/0466 473/342 |
| 2010/0048325 | A1 | 2/2010 | Tanimoto | |
| 2010/0137074 | A1 | 6/2010 | Gilbert et al. | |
| 2011/0009211 | A1* | 1/2011 | Chao | A63B 60/00 473/342 |
| 2011/0152000 | A1 | 6/2011 | Sargent et al. | |
| 2011/0159986 | A1* | 6/2011 | Chao | A63B 60/00 473/345 |
| 2011/0312437 | A1 | 12/2011 | Sargent et al. | |
| 2012/0071264 | A1 | 3/2012 | Beach et al. | |
| 2012/0122601 | A1 | 5/2012 | Beach et al. | |
| 2012/0172146 | A1 | 7/2012 | Greaney et al. | |
| 2012/0258818 | A1 | 10/2012 | Beach et al. | |
| 2013/0123040 | A1 | 5/2013 | Willett et al. | |
| 2013/0178306 | A1 | 7/2013 | Beno et al. | |
| 2013/0324308 | A1* | 12/2013 | Boyd | A63B 60/00 473/346 |
| 2014/0302946 | A1 | 10/2014 | Rae et al. | |
| 2014/0323237 | A1 | 10/2014 | Beno et al. | |
| 2015/0018117 | A1* | 1/2015 | Blevins | A63B 53/0466 473/324 |
| 2015/0038259 | A1 | 2/2015 | Sander | |
| 2015/0057101 | A1 | 2/2015 | Sander | |
| 2016/0001146 | A1 | 1/2016 | Sargent et al. | |
| 2016/0023062 | A1 | 1/2016 | Willett et al. | |
| 2016/0023063 | A1 | 1/2016 | Willett et al. | |
| 2016/0059093 | A1* | 3/2016 | Nielson | A63B 60/00 473/338 |
| 2016/0158910 | A1 | 6/2016 | Parson et al. | |
| 2016/0303439 | A1 | 10/2016 | Horacek et al. | |
| 2017/0173417 | A1* | 6/2017 | Seluga | A63B 53/0466 |
| 2017/0319916 | A1* | 11/2017 | Knuth | A63B 60/00 |
| 2018/0251870 | A1* | 9/2018 | Simone | C22C 14/00 |
| 2018/0318666 | A1* | 11/2018 | Morales | A63B 53/0466 |
| 2018/0345093 | A1 | 12/2018 | Harbert et al. | |
| 2019/0046845 | A1 | 2/2019 | Greensmith et al. | |
| 2019/0201752 | A1 | 7/2019 | Hoffman et al. | |
| 2019/0201753 | A1 | 7/2019 | Hoffman et al. | |
| 2019/0201759 | A1 | 7/2019 | Hoffman et al. | |

FOREIGN PATENT DOCUMENTS

| | | |
|---|---|---|
| JP | 2002113134 | 4/2002 |
| JP | 2010088818 | 4/2010 |
| JP | 2011161135 | 8/2011 |
| JP | 2014057832 | 4/2014 |
| JP | 2016097101 | 5/2016 |
| JP | 2017153954 | 9/2017 |
| TW | 200743514 | 12/2007 |
| TW | 201729874 | 9/2017 |

OTHER PUBLICATIONS

Office Action concerning Japanese Patent Application No. 2018-244805 dated Mar. 10, 2020 with English translation.

Detachable Face Golf Drivers advertised by DNA Golf, http://www.dnagolf.com/custom_drivers.html, access Jul. 25, 2018.

U.S. Appl. No. 16/161,337 dated Oct. 16, 2018.

Office Action concerning Chinese Patent Application No. 201811609980.X dated Jul. 1, 2020 with English translation.

* cited by examiner

GOLF CLUB HEAD

CROSS-REFERENCE TO RELATED APPLICATIONS

This is a continuation of U.S. patent application Ser. No. 16/223,108, filed Dec. 17, 2018, which claims the benefit of U.S. Provisional Patent Application No. 62/772,560, filed Nov. 28, 2018, and is a continuation-in-part of U.S. patent application Ser. No. 16/167,078, filed Oct. 22, 2018, which is a continuation-in-part of U.S. patent application Ser. No. 15/857,407, filed Dec. 28, 2017, all of which are incorporated herein by reference in their entirety.

FIELD his disclosure relates generally to golf clubs, and more particularly to a head of a golf club with characteristic time (CT) control and tuning features.

BACKGROUND

Modern "wood-type" golf clubs (notably, "drivers," "fairway woods," and "utility or hybrid clubs"), are generally called "metalwoods" since they tend to be made of strong, lightweight metals, such as titanium. An exemplary metalwood golf club, such as a driver or fairway wood, typically includes a hollow shaft and a golf club head coupled to a lower end of the shaft. Most modern versions of club heads are made, at least in part, from a lightweight but strong metal, such as a titanium alloy. In most cases, the golf club head is includes a hollow body with a face portion. The face portion has a front surface, known as a strike plate, configured to contact the golf ball during a proper golf swing.

Under USGA regulations governing the configuration of golf club heads, the characteristic time (CT) of a golf club head at all points on the face portion within a hitting zone cannot exceed a regulated CT threshold. Conventional golf club heads may sacrifice some performance characteristics at the expense of meeting the regulated CT threshold. For example, some golf club heads have thickened the face portion at areas away from a center of the face portion in an attempt to meet the CT threshold in such areas. However, such attempts have resulted in a corresponding reduction in the CT at the center of the face portion. Additionally, to ensure the CT does not exceed the regulated CT threshold, some conventional golf club heads are designed to have a CT within a cautiously large standard deviation of a target CT lower than the regulated CT threshold. Such large standard deviations, however, can result in batches of produced golf club heads with significantly non-uniform performance characteristics. Accordingly, meeting the regulated CT threshold while reducing the negative impact on other performance characteristics of the golf club head can be difficult.

SUMMARY

The subject matter of the present application has been developed in response to the present state of the art, and in particular, in response to the shortcomings of golf clubs and associated golf club heads, that have not yet been fully solved by currently available techniques. Accordingly, the subject matter of the present application has been developed to provide a golf club and golf club head that overcome at least some of the above-discussed shortcomings of prior art techniques.

The characteristic time (CT) of a golf club head is the amount of time a metal hemisphere, at the end of a pendulum, remains in contact with the face portion of a golf club head during a bounce of the metal hemisphere against the face portion. The characteristics of the pendulum and metal hemisphere, as well as the constraints of the CT testing equipment, are governed by the United States Golf Association ("USGA") under the Procedure for Measuring the Flexibility of a Golf Clubhead manual, which is published at www.usga.org and incorporated herein by reference. The CT of a golf club head is directly related to the flexibility or spring-like effect of the face portion of the golf club head. In other words, the higher the flexibility of the face portion, the higher the CT of the golf club head. Under the USGA regulations governing the configuration of golf club heads, the CT of a golf club head at all points on the face portion within a hitting zone cannot exceed a regulated CT threshold.

In some examples, the golf club heads of the present disclosure help to lower the CT of the face portions at locations away from the center of the face portion without negatively affecting the performance of the face portion at the center compared to conventional golf club heads. Moreover, in certain examples, the golf club heads of the present disclosure promote smaller standard deviations of CT for batches of produced golf club heads compared to conventional golf club heads.

Disclosed herein is a golf club head comprising a body. The body defines an interior cavity. The body also comprises a sole portion that is positioned at a bottom region of the golf club head. The sole portion has a sole surface area. The body additionally comprises a crown portion that is positioned at a top region of the golf club head. The crown portion has a crown surface area. The body further comprises a skirt portion that is positioned around a periphery of the golf club head between the sole portion and the crown portion, a forward region, a rearward region that is opposite the forward region, a heel region, and a toe region that is opposite the heel region. The golf club head also comprises a face portion, coupled to the body, at the forward region of the body. The face portion comprises a strike face and an interior surface that is opposite the strike face. The golf club head further comprises a stiffener located within the interior cavity of the body and in direct contact with the interior surface of the face portion. The stiffener is made of a material having a hardness of at least Shore 5.95D. An areal weight of the crown portion of the golf club head is less than about 0.35 g/cm$^2$ over more than about 50% of an entire surface area of the crown portion. The golf club head has a center of gravity (CG) with a head center face origin x-axis coordinate between about −5 mm and about 5 mm and a head center face origin y-axis coordinate between about 25 mm and about 50 mm, and a center face head origin z-axis coordinate less than 2 mm. The strike face has a central region, defined by a forty millimeter by twenty millimeter rectangular area centered on a center of the strike face and elongated in a heel-to-toe direction. The face portion has a thickness that varies. Within the central region, the face portion has a maximum face thickness no more than 4.5 mm and a minimum face thickness no less than 2.0 mm. Within the central region, the strike face has a characteristic time (CT) of no more than 257 microseconds. Within the central region, no less than 25% of the strike face has a coefficient of restitution (COR) of at least 0.8. Within the central region, no less than 60% of the strike face has a CT of at least 235 microseconds. Within the central region, no less than 35% of the strike face has a CT of at least 240 microseconds. The golf club head has a volume between about 350 cm3 and about 500 cm3, a moment of inertia about a head center of gravity z-axis (Izz), and a moment of inertia about a head center of gravity x-axis (Ixx). A summation of Izz and Ixx is between about 740 kg·mm$^2$ and about 1100 kg·mm$^2$. The preceding subject matter of this paragraph characterizes example 1 of the present disclosure.

More than 20% of the strike face has a CT of at least 245 microseconds. The preceding subject matter of this paragraph characterizes example 2 of the present disclosure, wherein example 2 also includes the subject matter according to example 1, above.

Within the central region, no less than 50% of the strike face has a COR of at least 0.8. The preceding subject matter of this paragraph characterizes example 3 of the present disclosure, wherein example 3 also includes the subject matter according to any one of examples 1-2, above.

Within the central region, no less than 55% of the strike face has a COR of at least 0.8. The preceding subject matter of this paragraph characterizes example 4 of the present disclosure, wherein example 4 also includes the subject matter according to example 3, above.

Within the central region, no less than 68% of the strike face has a COR of at least 0.8. The preceding subject matter of this paragraph characterizes example 5 of the present disclosure, wherein example 5 also includes the subject matter according to example 4, above.

At least a portion of the crown portion is made of a non-metallic composite material. The preceding subject matter of this paragraph characterizes example 6 of the present disclosure, wherein example 6 also includes the subject matter according to any one of examples 1-5, above.

The crown portion is made of a metal alloy. The preceding subject matter of this paragraph characterizes example 7 of the present disclosure, wherein example 7 also includes the subject matter according to any one of examples 1-6, above.

An areal weight of the sole portion of the golf club head is less than about 0.35 g/cm$^2$ over more than about 50% of an entire surface area of the sole portion. The preceding subject matter of this paragraph characterizes example 8 of the present disclosure, wherein example 8 also includes the subject matter according to any one of examples 1-7, above.

The body and the face portion form a one-piece, unitary, monolithic construction. The preceding subject matter of this paragraph characterizes example 9 of the present disclosure, wherein example 9 also includes the subject matter according to any one of examples 1-8, above.

The face portion comprises a face opening and a strike plate welded to the face opening. The preceding subject matter of this paragraph characterizes example 10 of the present disclosure, wherein example 10 also includes the subject matter according to any one of examples 1-9, above.

The summation of Izz and Ixx is greater than about 790 kg·mm$^2$. The preceding subject matter of this paragraph characterizes example 11 of the present disclosure, wherein example 11 also includes the subject matter according to any one of examples 1-10, above.

The summation of Izz and Ixx is greater than about 805 kg·mm$^2$. The preceding subject matter of this paragraph characterizes example 12 of the present disclosure, wherein example 12 also includes the subject matter according to any one of examples 1-11, above.

Ixx is no less than 305 kg·mm$^2$. The preceding subject matter of this paragraph characterizes example 13 of the present disclosure, wherein example 13 also includes the subject matter according to any one of examples 1-12, above.

Ixx is no less than 320 kg·mm$^2$. The preceding subject matter of this paragraph characterizes example 14 of the present disclosure, wherein example 14 also includes the subject matter according to any one of examples 1-13, above.

Ixx is no less than 350 kg·mm$^2$. The preceding subject matter of this paragraph characterizes example 15 of the present disclosure, wherein example 15 also includes the subject matter according to any one of examples 1-14, above.

At least 60% of the strike face within the central region has a CT of at least 240 microseconds. The preceding subject matter of this paragraph characterizes example 16 of the present disclosure, wherein example 16 also includes the subject matter according to any one of examples 1-15, above.

At least 70% of the strike face within the central region has a CT of at least 240 microseconds. The preceding subject matter of this paragraph characterizes example 17 of the present disclosure, wherein example 17 also includes the subject matter according to example 16, above.

At least 40% of the strike face within the central region has a CT of at least 245 microseconds. The preceding subject matter of this paragraph characterizes example 18 of the present disclosure, wherein example 18 also includes the subject matter according to any one of examples 1-17, above.

At least 50% of the strike face within the central region has a CT of at least 245 microseconds. The preceding subject matter of this paragraph characterizes example 19 of the present disclosure, wherein example 19 also includes the subject matter according to example 18, above.

At least 10% of the strike face within the central region has a CT of at least 250 microseconds. The preceding subject matter of this paragraph characterizes example 20 of the present disclosure, wherein example 20 also includes the subject matter according to any one of examples 1-19, above.

At least 15% of the strike face within the central region has a CT of at least 250 microseconds. The preceding subject matter of this paragraph characterizes example 21 of the present disclosure, wherein example 21 also includes the subject matter according to example 20, above.

The CT at any location on the strike face within at least five millimeters of the center of the strike face is greater than 240 microseconds. The preceding subject matter of this paragraph characterizes example 22 of the present disclosure, wherein example 22 also includes the subject matter according to any one of examples 1-21, above.

The CT of the strike face, along a horizontal path on the strike face passing through a center of the strike face, peaks at a distance of at least 30 millimeters toward of the center of the strike face. The preceding subject matter of this paragraph characterizes example 23 of the present disclosure, wherein example 23 also includes the subject matter according to any one of examples 1-22, above.

The face portion further comprises an aperture, extending through the face portion from the strike face to the interior surface and a plug, non-movably fixedly retained within the aperture. The plug protrudes no more than 0.15 millimeters from the strike face or is sunken below the surface of the strike face no more than 0.1 millimeters. The preceding subject matter of this paragraph characterizes example 24 of the present disclosure, wherein example 24 also includes the subject matter according to any one of examples 1-23, above.

The aperture comprises internal threads. The plug comprises external threads that are threadably engaged with the internal threads of the aperture. The preceding subject matter of this paragraph characterizes example 25 of the present disclosure, wherein example 25 also includes the subject matter according to example 24, above.

The aperture further comprises a counterbore interposed between the internal threads and the strike face. The plug comprises a head portion nestably engaged with the counterbore. The preceding subject matter of this paragraph characterizes example 26 of the present disclosure, wherein example 26 also includes the subject matter according to example 25, above.

The plug comprises a portion of the stiffener. The preceding subject matter of this paragraph characterizes example 27 of the present disclosure, wherein example 27 also includes the subject matter according to any one of examples 24-26, above.

The plug comprises a polymeric material. The preceding subject matter of this paragraph characterizes example 28 of the present disclosure, wherein example 28 also includes the subject matter according to any one of examples 24-26, above.

Additionally disclosed herein is a golf club head. The golf club head comprises a body that defines an interior cavity and comprises a sole portion that is positioned at a bottom region of the golf club head. The sole portion has a sole surface area. The body further comprises a crown portion that is positioned at a top region of the golf club head. The crown portion has a crown surface area. The body also comprises a skirt portion that is positioned around a periphery of the golf club head between the sole portion and the crown portion. The body additionally comprises a forward region, a rearward region that is opposite the forward region, a heel region, and a toe region that is opposite the heel region. The golf club head also comprises a face portion, coupled to the body, at the forward region of the body. The face portion comprises a strike face and an interior surface that is opposite the strike face. The golf club head further comprises a plurality of stiffeners located within the interior cavity of the body and in direct contact with the interior surface of the face portion. The plurality of stiffeners are a plurality of ribs made of the same material as the body. The face portion has a thickness that varies. A maximum thickness of the face portion is no more than 5 mm and a minimum thickness of the face portion is less than 3 mm. An areal weight of the crown portion of the golf club head is less than about 0.35 g/cm$^2$ over more than about 50% of an entire surface area of the crown portion. An areal weight of the sole portion of the golf club head is less than about 0.35 g/cm$^2$ over more than about 50% of an entire surface area of the sole portion. The strike face has a central region, defined by a forty millimeter by twenty millimeter rectangular area centered on a center of the strike face and elongated in a heel-to-toe direction. Within the central region, the strike face has a characteristic time (CT) of no more than 257 microseconds. Within the central region, no less than 25% of the strike face has a coefficient of restitution (COR) of at least 0.8. Within the central region, no less than 60% of the strike face has a CT of at least 235 microseconds. Within the central region, no less than 35% of the strike face has a CT of at least 240 microseconds. The preceding subject matter of this paragraph characterizes example 29 of the present disclosure.

The plurality of ribs are located proximate a transition between the face portion and the crown portion. The preceding subject matter of this paragraph characterizes example 30 of the present disclosure, wherein example 30 also includes the subject matter according to example 29, above.

The plurality of ribs are located proximate a transition between the face portion and the sole portion. The preceding subject matter of this paragraph characterizes example 31 of the present disclosure, wherein example 31 also includes the subject matter according to any one of examples 29-30, above.

The body and the face portion form a one-piece, unitary, monolithic construction. The preceding subject matter of this paragraph characterizes example 32 of the present disclosure, wherein example 32 also includes the subject matter according to any one of examples 29-31, above.

The face portion comprises a face opening and a strike plate welded to the face opening. The preceding subject matter of this paragraph characterizes example 33 of the present disclosure, wherein example 33 also includes the subject matter according to any one of examples 29-31, above.

At least one of the plurality of ribs has a head origin x-axis coordinate between +15 mm and +25 mm, and at least one of the plurality of ribs has a head origin x-axis coordinate between −15 mm and −25 mm. The preceding subject matter of this paragraph characterizes example 34 of the present disclosure, wherein example 34 also includes the subject matter according to any one of examples 29-33, above.

Further disclosed herein is a golf club head that comprises a body. The body defines an interior cavity and comprises a sole portion that is positioned at a bottom region of the golf club head. The sole portion has a sole surface area. The body also comprises a crown portion that is positioned at a top region of the golf club head. The crown portion has a crown surface area. The body further comprises a skirt portion that is positioned around a periphery of the golf club head between the sole portion and the crown portion, a forward region, a rearward region that is opposite the forward region, a heel region, and a toe region that is opposite the heel region. The body also comprises a face portion, coupled to the body, at the forward region of the body. The face portion comprises a strike face and an interior surface, opposite the strike face. The body further comprises a plurality of stiffeners located within the interior cavity of the body and offset from the interior surface of the face portion by at least 1 mm and by no more than 20 mm as measured along a head origin y-axis. The plurality of stiffeners are elongated stiffening members extending between an interior surface of the crown portion and an interior surface of the sole portion. The face portion has a thickness that varies. A maximum thickness of the face portion is no more than 5 mm and a minimum thickness of the face portion is less than 3 mm. An areal weight of the crown portion of the golf club head is less than about 0.35 g/cm$^2$ over more than about 50% of an entire surface area of the crown portion. An areal weight of the sole portion of the golf club head is less than about 0.35 g/cm$^2$ over more than about 50% of an entire surface area of the sole portion. The strike face has a central region, defined by a forty millimeter by twenty millimeter rectangular area centered on a center of the strike face and elongated in a heel-to-toe direction. Within the central region, the strike face has a characteristic time (CT) of no more than 257 microseconds. Within the central region, no less than 25% of the strike face has a coefficient of restitution (COR) of at least 0.8. Within the central region, no less than 60% of the strike face has a CT of at least 235 microseconds. Within the central region, no less than 35% of the strike face has a CT of at least 240 microseconds. The preceding subject matter of this paragraph characterizes example 35 of the present disclosure.

The body and the face portion form a one-piece, unitary, monolithic construction. The preceding subject matter of this paragraph characterizes example 36 of the present disclosure, wherein example 36 also includes the subject matter according to example 35, above.

The face portion comprises a face opening and a strike plate welded to the face opening. The preceding subject matter of this paragraph characterizes example 37 of the present disclosure, wherein example 37 also includes the subject matter according to example 35, above.

Within the central region, a thickness of the face portion is greatest proximate the center of the strike face. The preceding subject matter of this paragraph characterizes example 38 of the present disclosure, wherein example 38 also includes the subject matter according to any one of examples 35-37, above.

A thickness of the face portion at the center of the strike face is greater than 2.9 mm. The preceding subject matter of this paragraph characterizes example 39 of the present disclosure, wherein example 39 also includes the subject matter according to any one of examples 35-38, above.

The plurality of stiffeners comprises two or more brace bars. The two or more brace bars each has a mass per unit length of between 0.005 g/mm and 0.40 g/mm. The preceding subject matter of this paragraph characterizes example 40 of the present disclosure, wherein example 40 also includes the subject matter according to any one of examples 35-39, above.

The body further comprises a channel. The golf club head further comprises one or more polymeric stiffeners located within the channel the body further comprises a channel. The golf club head further comprises one or more polymeric stiffeners located within the channel. The preceding subject matter of this paragraph characterizes example 41 of the present disclosure, wherein example 41 also includes the subject matter according to any one of examples 35-40, above.

At least one of the plurality of stiffeners has a head origin x-axis coordinate between +15 mm and +25 mm, and at least one of the plurality of stiffeners has a head origin x-axis coordinate between −15 mm and −25 mm. The preceding subject matter of this paragraph characterizes example 42 of the present disclosure, wherein example 42 also includes the subject matter according to any one of examples 35-41, above.

Additionally disclosed here is a golf club head comprising a body. The body defines an interior cavity and comprises a sole portion, positioned at a bottom region of the golf club head, the sole portion having a sole surface area. The body also defines a crown portion, positioned at a top region of the golf club head, the crown portion having a crown surface area. The body further defines a skirt portion, positioned around a periphery of the golf club head between the sole portion and the crown portion. The body additionally defines a forward region, a rearward region, opposite the forward region, a heel region, and a toe region, opposite the heel region. The golf club head also comprises a face portion, coupled to the body, at the forward region of the body, and comprising a strike face and an interior surface, opposite the strike face. The face portion has a thickness that varies. An areal weight of the crown portion of the golf club head is less than about 0.35 g/cm$^2$ over more than about 50% of an entire surface area of the crown portion. An areal weight of the sole portion of the golf club head is less than about 0.35 g/cm$^2$ over more than about 50% of an entire surface area of the sole portion. The strike face has a central region, defined by a forty millimeter by twenty millimeter rectangular area centered on a center of the strike face and elongated in a heel-to-toe direction. Within the central region, a maximum thickness of the face portion is no more than 4 mm and a minimum thickness of the face portion is no less than 2.4 mm. Within the central region, the strike face has a characteristic time (CT) of no more than 257 microseconds. Within the central region, no less than 25% of the strike face has a coefficient of restitution (COR) of at least 0.8. Within the central region, no less than 60% of the strike face has a CT of at least 235 microseconds. Within the central region, no less than 50% of the strike face has a CT of at least 240 microseconds. The preceding subject matter of this paragraph characterizes example 43 of the present disclosure.

The body and the face portion form a one-piece, unitary, monolithic construction. The preceding subject matter of this paragraph characterizes example 44 of the present disclosure, wherein example 44 also includes the subject matter according to example 43, above.

The face portion comprises a face opening and a strike plate welded to the face opening. The preceding subject matter of this paragraph characterizes example 45 of the present disclosure, wherein example 45 also includes the subject matter according to example 43, above.

Within the central region, a thickness of the face portion is greatest proximate the center of the strike face. The preceding subject matter of this paragraph characterizes example 46 of the present disclosure, wherein example 46 also includes the subject matter according to any one of examples 43-45, above.

A thickness of the face portion at the center of the strike face is greater than 2.9 mm. The preceding subject matter of this paragraph characterizes example 47 of the present disclosure, wherein example 47 also includes the subject matter according to any one of examples 43-46, above.

Within the central region, no less than 15% of the strike face has a CT of at least 245 microseconds. The preceding subject matter of this paragraph characterizes example 48 of the present disclosure, wherein example 48 also includes the subject matter according to any one of examples 43-47, above.

The sole portion, the crown portion, and the skirt portion of body form a one-piece, unitary, monolithic construction, and the wherein the face portion comprises a face opening and a strike plate encloses the face opening. The preceding subject matter of this paragraph characterizes example 49 of the present disclosure, wherein example 49 also includes the subject matter according to any one of examples 43-48, above.

The face portion comprises a face opening and a strike plate welded to the face opening. The preceding subject matter of this paragraph characterizes example 50 of the present disclosure, wherein example 50 also includes the subject matter according to any one of examples 43 and 45-49, above.

The face portion comprises a face opening and a strike plate bonded or glued to the face opening. The preceding subject matter of this paragraph characterizes example 51 of the present disclosure, wherein example 51 also includes the subject matter according to any one of examples 43 and 45-49, above.

The body and the face portion form a one-piece, unitary, monolithic construction. The crown portion comprises a crown opening and a crown insert encloses the crown opening. The crown insert is formed of a lower density material than the rest of the body and the face portion. The preceding subject matter of this paragraph characterizes example 52 of the present disclosure, wherein example 52 also includes the subject matter according to any one of examples 43, 44, and 46-49, above.

The golf club head further comprises two or more brace bars extending from an interior surface of the sole portion to an interior surface of the crown portion, wherein each of the two or more brace bars has a mass per unit length of between 0.005 g/mm and 0.40 g/mm. The preceding subject matter of this paragraph characterizes example 53 of the present disclosure, wherein example 53 also includes the subject matter according to any one of examples 43-52, above.

Wherein the two or more brace bars are formed of the same material as the body. The preceding subject matter of this paragraph characterizes example 54 of the present disclosure, wherein example 54 also includes the subject matter according to example 53, above.

The two or more brace bars are formed of a lower density material than that of the body. The preceding subject matter of this paragraph characterizes example 55 of the present disclosure, wherein example 55 also includes the subject matter according to any one of examples 53-54, above.

The two or more brace bars have a head origin y-axis coordinate between the head origin y-axis coordinate of a center of gravity of the golf club head and the head origin y-axis coordinate of the face portion of the golf club head. The preceding subject matter of this paragraph characterizes example 56 of the present disclosure, wherein example 56 also includes the subject matter according to any one of examples 53-55, above.

The two or more brace bars are positioned between 1 mm and 20 mm, inclusive, from the face portion. The preceding subject matter of this paragraph characterizes example 57 of the present disclosure, wherein example 57 also includes the subject matter according to any one of examples 53-56, above.

The two or more brace bars are positioned at least 20 mm forward of a center of gravity of the golf club head as measured along a head origin y-axis. The preceding subject matter of this paragraph characterizes example 58 of the present disclosure, wherein example 58 also includes the subject matter according to any one of examples 53-57, above.

Within the central region, a ratio of a thickness of a thinnest portion of the face portion to the thickness of a thickest portion of the face portion is between 0.60 and 1.0, inclusive. The preceding subject matter of this paragraph characterizes example 59 of the present disclosure, wherein example 59 also includes the subject matter according to any one of examples 53-58, above.

Within the central region, a ratio of a thickness of a thinnest portion of the face portion to the thickness of a thickest portion of the face portion is between 0.70 and 1.0, inclusive. The preceding subject matter of this paragraph characterizes example 60 of the present disclosure, wherein example 60 also includes the subject matter according to any one of examples 53-59, above.

Within the central region, no less than 50% of the strike face has a COR of at least 0.8. The preceding subject matter of this paragraph characterizes example 61 of the present disclosure, wherein example 61 also includes the subject matter according to any one of examples 53-60, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Figure 1:
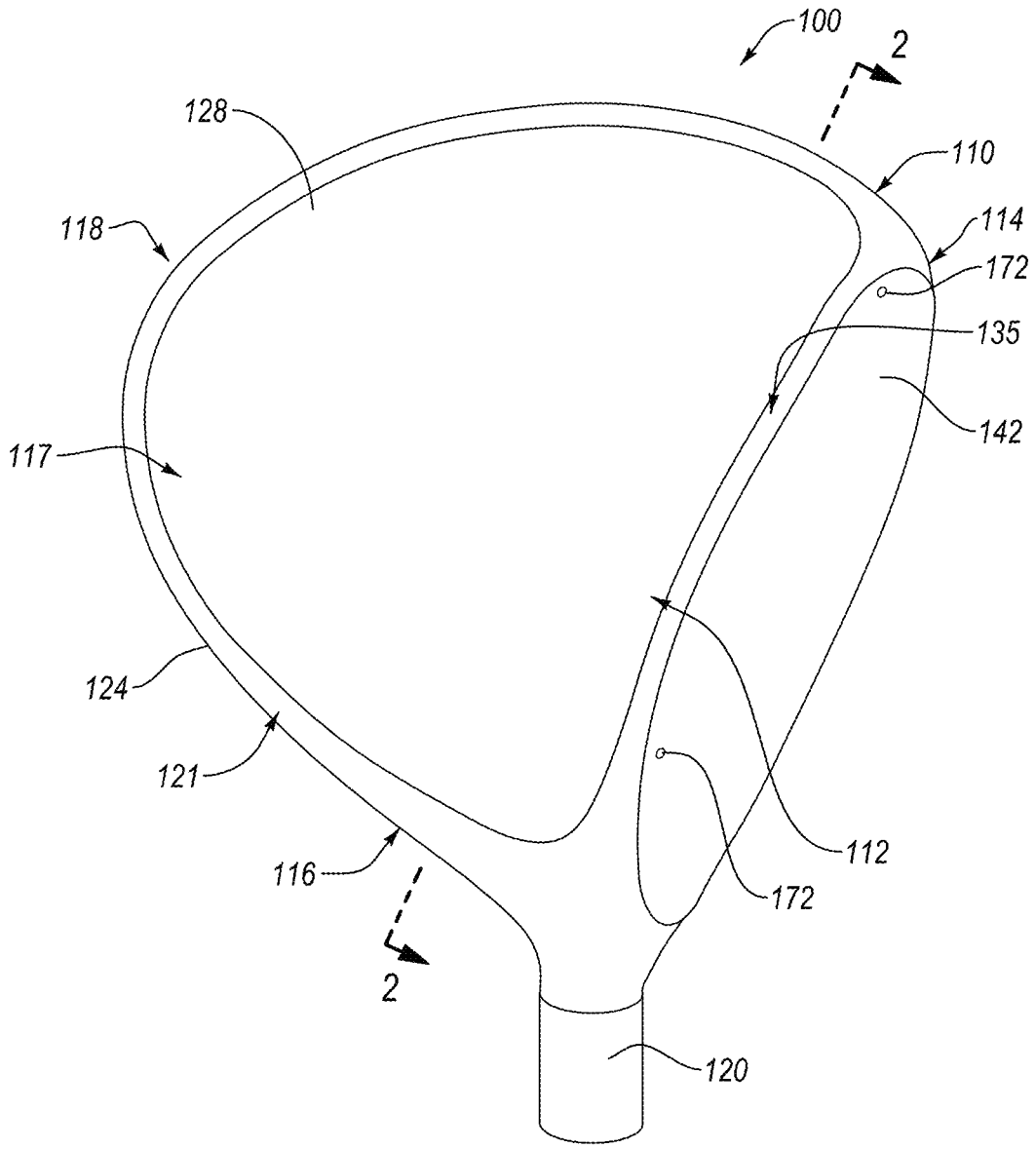
FIG. 1 is a perspective view of a golf club head, from a bottom of the golf club head, according to one or more examples of the present disclosure.

The following describes embodiments of golf club heads in the context of a driver-type golf club, but the principles, methods and designs described may be applicable in whole or in part to fairway woods, utility clubs (also known as hybrid clubs) and the like.

U.S. Patent Application Publication No. 2014/0302946 A1 ('946 App), published Oct. 9, 2014, which is incorporated herein by reference in its entirety, describes a "reference position" similar to the address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the club head in the reference position.

FIGS. 5, 6, 8, 9, 11, 12, 14, 15, 17, 18, 20, 21, 23-25, and 27 are examples that show a club head in the address position i.e. the club head is positioned such that the hosel axis is at a 60 degree lie angle relative to a ground plane and the club face is square relative to an imaginary target line. As shown in FIGS. 5, 6, 8, 9, 11, 12, 14, 15, 17, 18, 20, 21, 23-25, and 27, positioning a golf club head 100 in the reference position lends itself to using a club head origin coordinate system 185 for making various measurements. Additionally, the USGA methodology may be used to measure the various parameters described throughout this application including head height, club head center of gravity (CG) location, and moments of inertia (MOI) about the various axes.

For further details or clarity, the reader is advised to refer to the measurement methods described in the '946 App and the USGA procedure. Notably, however, the origin and axes used in this application may not necessarily be aligned or oriented in the same manner as those described in the '946 App or the USGA procedure. Further details are provided below on locating the club head origin coordinate system 185.

The golf club heads described herein may include a driver-type golf club heads with a relatively large strike plate area of at least 3500 mm^2, preferably at least 3800 mm^2, and even more preferably at least 3900 mm^2. Additionally, the driver-type golf club heads may include a center of gravity (CG) projection proximate center face that may be at most 3 mm above or below center face, and preferably may be at most 1 mm above or below center face as measured along a vertical axis (z-axis).

Moreover, the driver-type golf club heads may have a relatively high moment of inertia about a head center of gravity z-axis e.g. Izz>350 kg-mm^2 and preferably Izz>400 kg-mm^2, a relatively high moment of inertia about a head center of gravity x-axis e.g. Ixx>200 kg-mm^2 and preferably Ixx>250 kg-mm^2, and preferably a ratio of Ixx/Izz>0.55. For example, in one implementation, Ixx is no less than 305 $kg \cdot mm^2$ and in another implementation, Ixx is no less than 320 $kg \cdot mm^2$. In some examples, a summation of Izz and Ixx is between about 740 $kg \cdot mm^2$ and about 1100 $kg \cdot mm^2$. According to one example, the summation of Izz and Ixx is greater than about 790 $kg \cdot mm^2$. In another examples, the summation of Izz and Ixx is greater than about 805 $kg \cdot mm^2$.

The head center of gravity x-axis, the head center of gravity y-axis, and the head center of gravity z-axis, which define a head center of gravity origin coordinate system, are centered at the center of gravity of the golf club head. Moreover, the head center of gravity x-axis, the head center of gravity y-axis, and the head center of gravity z-axis are parallel to the corresponding x-axis, y-axis, and z-axis of the club head origin coordinate system 185 as defined herein. The location of the center of gravity can be defined relative to a center face head origin coordinate system defined by a head center face origin x-axis, a head center face origin y-axis, and a head center face origin z-axis centered at a center face of the strike face of the golf club head. The head center face origin x-axis, the head center face origin y-axis, and the head center face origin z-axis, are parallel to the corresponding x-axis, y-axis, and z-axis of the club head origin coordinate system 185 as defined herein. In some examples, the golf club head has a center of gravity (CG) with a head center face origin x-axis coordinate between about −5 mm and about 5 mm and a head center face origin y-axis coordinate between about 25 mm and about 50 mm, and a center face head origin z-axis coordinate less than 2 mm.

Figure 2:
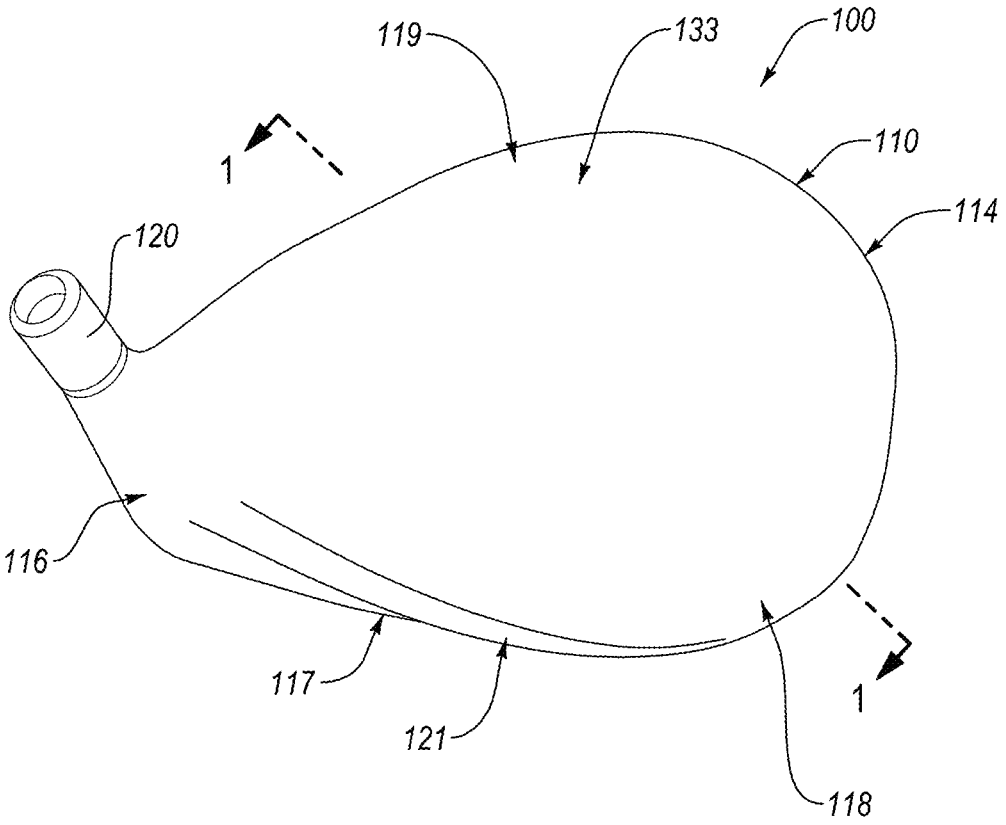
FIG. 2 is a perspective view of a golf club head, from a rear of the golf club head, according to one or more examples of the present disclosure.

Referring to FIGS. 1 and 2, the golf club head 100 of the present disclosure includes a body 110. The body 110 has a toe region 114 and a heel region 116, opposite the toe region 114. Additionally, the body 110 includes a forward region 112 and a rearward region 118, opposite the forward region 112. The body 110 further includes a face portion 142 at the forward region 112 of the body 110. The body 110 of the golf club head 100 additionally includes a sole portion 117, at a bottom region 135 of the golf club head 100, and a crown portion 119, opposite the sole portion 117 and at a top region 133 of the golf club head 100. Also, the body 110 of the golf club head 100 includes a skirt portion 121 that defines a transition region where the body 110 of the golf club head 100 transitions between the crown portion 119 and the sole portion 117. Accordingly, the skirt portion 121 is located between the crown portion 119 and the sole portion 117 and extends about a periphery of the golf club head 100. The face portion 142 extends along the forward region 112 from the sole portion 117 to the crown portion 119. Moreover, the exterior surface, and at least a portion of the interior surface, of the face portion 142 is planar in a top-to-bottom direction. As further defined, the face portion 142 is the portion of the body 110 at the forward region 112 with an exterior surface that faces in the generally forward direction.

Figure 5:
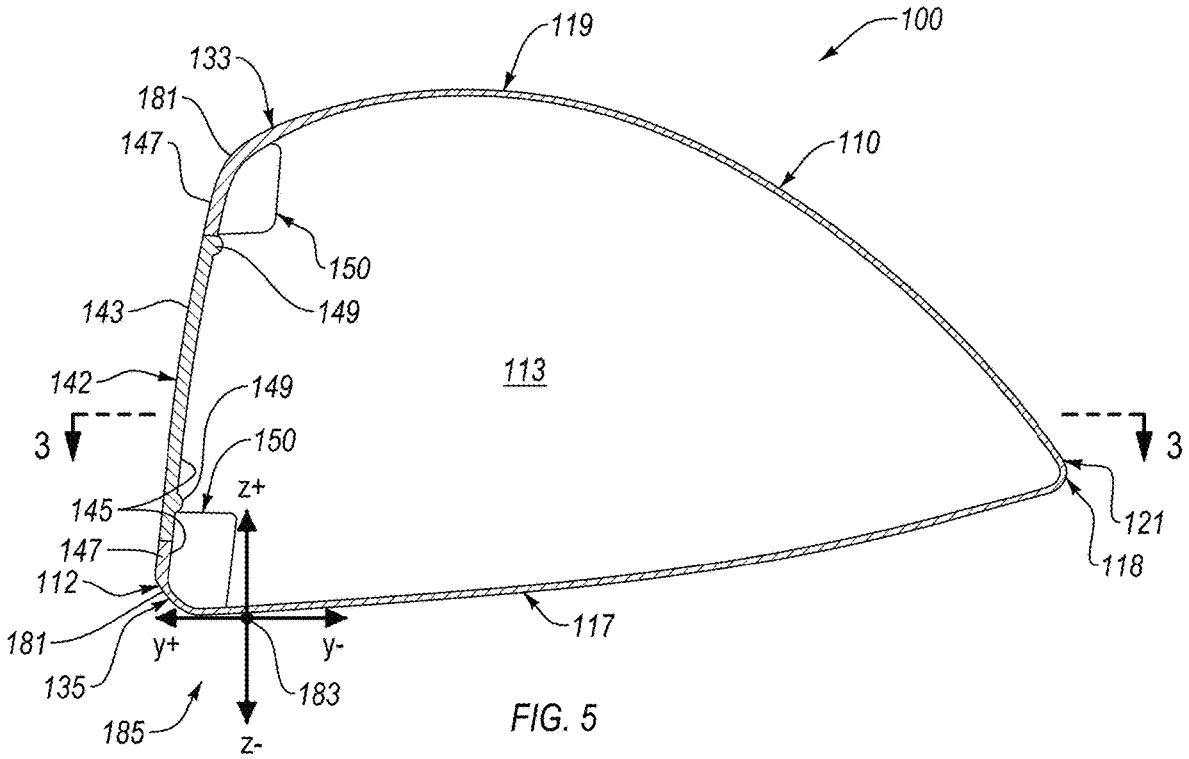
FIG. 5 is a cross-sectional side elevation view of a golf club head, taken along a line similar to line 1-1 of FIG. 2, according to one or more examples of the present disclosure.

The face portion 142 includes lip 147 and a strike plate 143 that defines a strike face 144. The lip 147 is circumferentially closed, defines a face opening, and extends around an outer periphery of the forward region 112 of the body 110. The lip 147 peripherally surrounds the strike plate 143 and is co-formed (e.g., forms a one-piece, continuous, monolithic construction) with the crown portion 119, the skirt portion 121, and the sole portion 117 of the body 110. The strike plate 143 defines a strike face configured to impact and drive the golf ball during a normal swing of the golf club head 100. Referring to FIG. 5, the strike plate 143 can be attached to or co-formed with the lip 147 to form the face portion 142 of the body 110. In one example, the strike plate 143 is attached to the lip 147 by fixedly attaching (e.g., welding) the strike plate 143 to the lip 147 or the face opening. According to another example, the strike plate 143 is co-formed (e.g., integral) with the lip 147 by casting the strike plate 143 together with the lip 147 and other portions of the body 110 to form a one-piece, continuous, monolithic construction with the body 110. For example, the strike face can be co-cast with the body of the golf club head in a manner similar to, or the same as, that shown and described in U.S. patent application Ser. No. 16/161,337, filed Oct. 16, 2018, which is incorporated herein by reference in its entirety.

When cast together, the strike plate 143, the lip 147, and other portions of the body 110 are made of the same material, such as any of various materials described below. However, welding the strike plate 143 to the lip 147, as opposed to co-forming the strike plate 143 and the lip 147 as a one-piece construction, allows the strike plate 143 to be made from a different material, such as any of those described below, and/or made by a different manufacturing process than the lip 147 and other portions of the body 110. According to certain implementations, the golf club head 100 includes variable thickness face portion features similar to those described in more detail in U.S. patent application Ser. No. 12/006,060; and U.S. Pat. Nos. 6,997,820; 6,800,038; and 6,824,475, which are incorporated herein by reference in their entirety. Within a central region, as defined below, the face portion 142 has a maximum face thickness no more than 4.5 mm and a minimum face thickness no less than 2.0 mm in some examples. According to certain examples, a maximum thickness of the face portion is no more than 5 mm and a minimum thickness of the face portion is less than 3 mm.

In some examples, the golf club head 100 includes a face portion 142 with variable thickness face portion features. According to one example, the variable thickness face portion features of the face portion include an inverted cone protruding from the interior surface 145 of the face portion 142 into an interior cavity of the golf club head 100. The inverted cone is centered at a center face of the face portion 142. In this example, the variable thickness face portion features of the face portion 142 further include a plurality of thickness zones that are circumferentially spaced about the inverted cone or the center face of the face portion 142. Each one of the thickness zones extends radially outwardly away from the inverted cone toward an outer periphery of the face portion 142. In some implementations, one or more of the thickness zones terminate before the outer periphery of the face portion 142 and/or one or more of the thickness zones extends all the way to the outer periphery of the face portion 142. Moreover, each one of the thickness zones defines a portion of the face portion 142 with a constant thickness. In other words, the thickness of the face portion 142 within a given one of the thickness zones is the same or does not vary. However, the thickness of the face portion 142 within one thickness zone is different than that of an adjacent thickness zone. In this manner, the thickness of the face portion 142 varies from one thickness zone to the next in a circumferential direction around the inverted cone.

According to one example, the plurality of thickness zones includes a plurality of elevated thickness zones and a plurality of reduced thickness zones. Each one of the elevated thickness zones has a thickness that is greater than each one of the elevated thickness zones. In some implementations, the thickness of each one of the reduced thickness zones is greater than a minimum thickness of the face portion 142. The plurality of elevated thickness zones and the plurality of reduced thickness zones alternate between elevated thickness zone and reduced thickness zone about the inverted cone 608.

Figure 55:
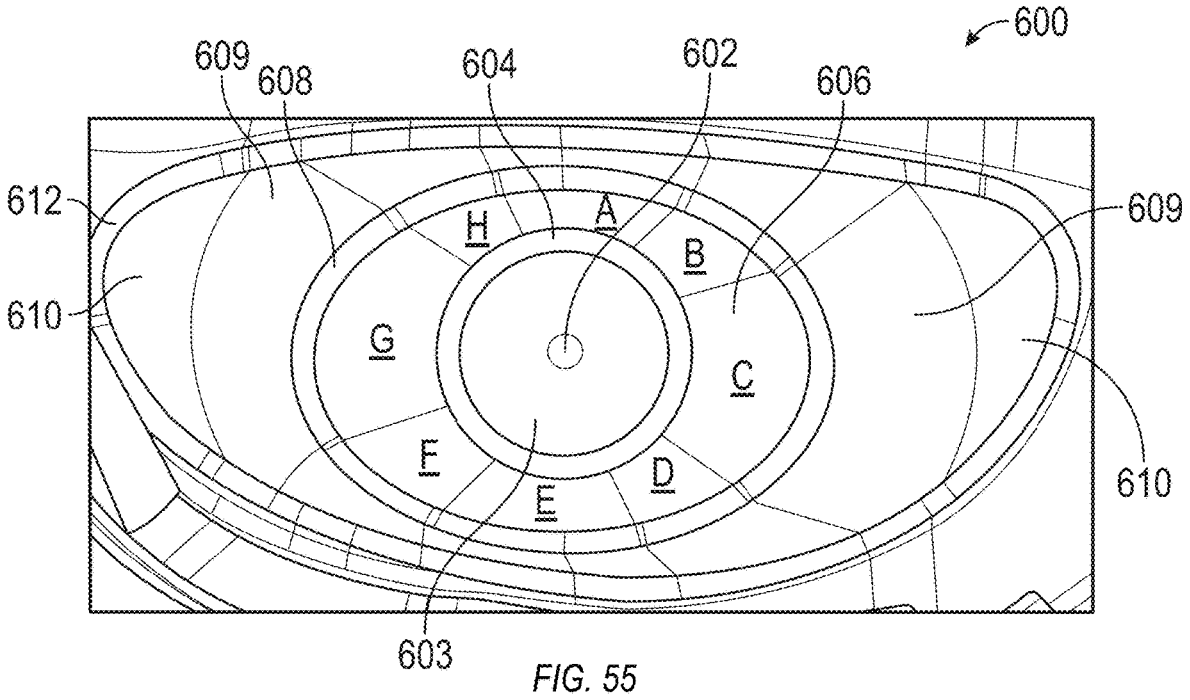
FIG. 55 is a rear view of a face portion of a golf club head, according to one or more examples of the present disclosure.
Figure 56:
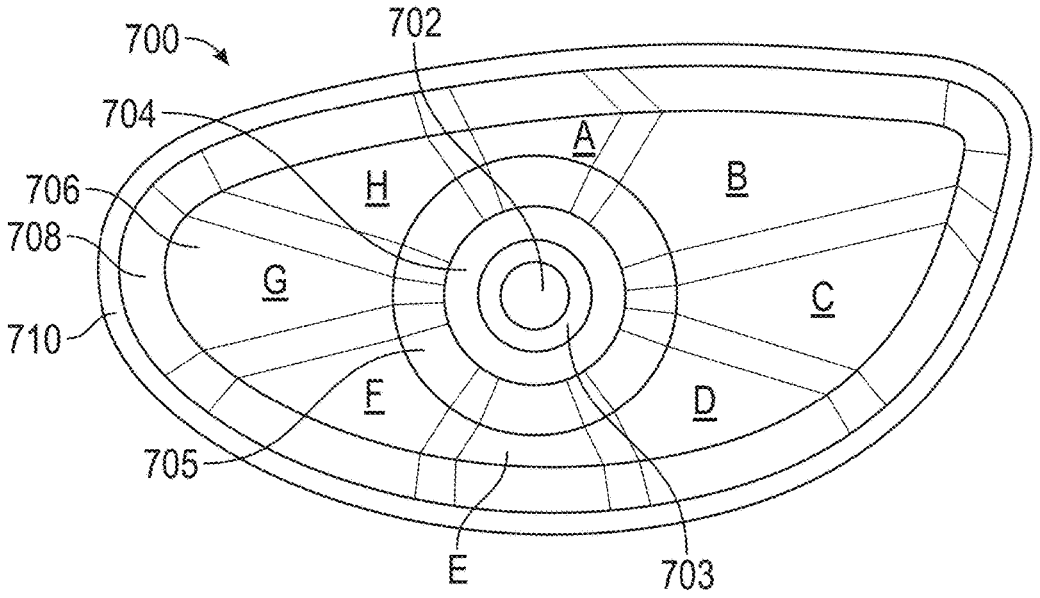
FIG. 56 is a rear view of a face portion of a golf club head, according to one or more examples of the present disclosure.
Figure 57:
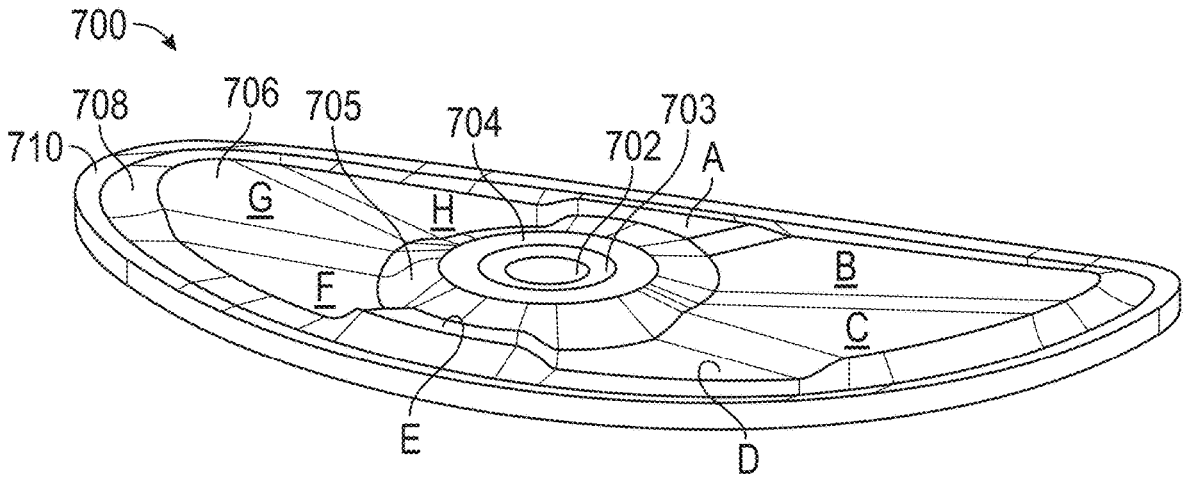
FIG. 57 is a perspective view of the face portion of FIG. 56, according to one or more examples of the present disclosure.
Figure 58:
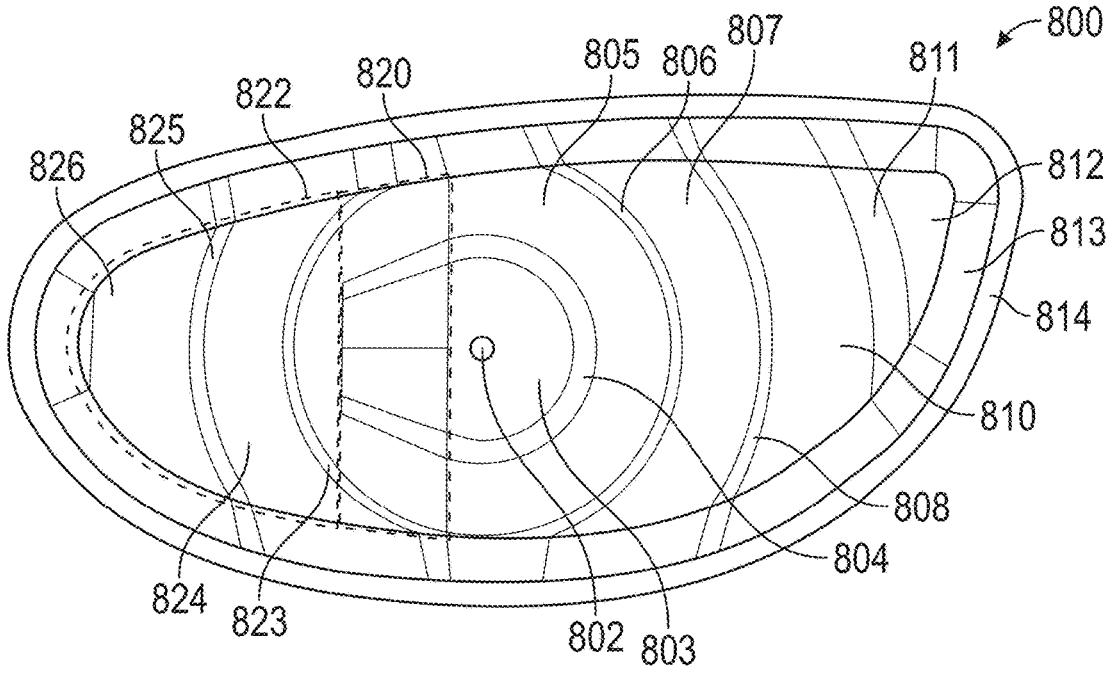
FIG. 58 is a rear view of a face portion of a golf club head, according to one or more examples of the present disclosure.

FIG. 55 illustrates an exemplary rear surface of a face portion 600 of the golf club 100 disclosed herein. The face portion 142 can form part of a cast cup of the golf club head 100, such as described in U.S. patent application Ser. No. 16/161,337, filed Oct. 16, 2018, which is incorporated herein by reference in its entirety. The face portion 142 is viewed from the rear with the hosel/heel to the left and the toe to the right. FIGS. 56 and 57 illustrate another exemplary face portion 700 having a variable thickness profile, and FIG. 58 illustrates yet another exemplary face portion 800 having a variable thickness profile. The face portions disclosed herein can be formed as a result of a casting process and optional post-casting modifications to the face portions. Accordingly, the face portion can have a great variety of novel thickness profiles. By casting the face into a desired geometry, rather than forming the face plate from a flat rolled sheet of metal in a traditional process, the face can be created with greater variety of geometries and can have different material properties, such as different grain direction and chemical impurity content, which can provide advantages for a golf performance and manufacturing.

In a traditional process, the face plate is formed from a flat sheet of metal having a uniform thickness. Such a sheet of metal is typically rolled along one axis to reduce the thickness to a certain uniform thickness across the sheet. This rolling process can impart a grain direction in the sheet that creates a different material properties in the rolling axis direction compared to the direction perpendicular to the rolling direction. This variation in material properties can be undesirable and can be avoided by using the disclosed casting methods instead to create face portion.

Furthermore, because a conventional face plate starts off as a flat sheet of uniform thickness, the thickness of the whole sheet has to be at least as great as the maximum thickness of the desired end product face plate, meaning much of the starting sheet material has to be removed and wasted, increasing material cost. By contrast, in the disclosed casting methods, the face portion is initially formed much closer to the final shape and mass, and much less material has to be removed and wasted. This saves time and cost.

Still further, in a conventional process, the initial flat sheet of metal has to be bent in a special process to impart a desired bulge and roll curvature to the face plate. Such a bending process is not needed when using the disclosed casting methods.

The unique thickness profiles illustrated in FIGS. 55-59 are made possible using casting methods, such as those disclosed in U.S. patent application Ser. No. 16/161,337, and were previously not possible to achieve using conventional processes, such as starting from a sheet of metal having a uniform thickness, mounting the sheet in a lathe or similar machine and turning the sheet to produce a variable thickness profile across the rear of the face plate. In such a turning process, the imparted thickness profile must be symmetrical about the central turning axis, which limits the thickness profile to a composition of concentric circular ring shapes each having a uniform thickness at any given radius from the center point. In contrast, no such limitations are imposed using the disclosed casting methods, and more complex face geometries can be created.

By using casting methods, large numbers of the disclosed club heads can be manufacture faster and more efficiently. For example, 50 or more of the cups 402 can be cast at the same time on a single casting tree, whereas it would take much longer and require more resources to create the novel face thickness profiles on face plates using a conventional milling methods using a lathe, one at a time.

In FIG. 55, the rear face surface or interior surface of the face portion 600 includes a non-symmetrical variable thickness profile, illustrating just one example of the wide variety of variable thickness profiles made possible using the disclosed casting methods. The center 602 of the face can have a center thickness, and the face thickness can gradually increase moving radially outwardly from the center across an inner blend zone 603 to a maximum thickness ring 604, which can be circular. The face thickness can gradually decrease moving radially outwardly from the maximum thickness ring 604 across an variable blend zone 606 to a second ring 608, which can be non-circular, such as elliptical. The face thickness can gradually decrease moving radially outwardly from the second ring 608 across an outer blend zone 609 to heel and toe zones 610 of constant thicknesses (e.g., minimum thickness of the face portion) and/or to a radial perimeter zone 612 defining the extent of the face portion 600 where the face transitions to the rest of the golf club head 100.

The second ring 608 can itself have a variable thickness profile, such that the thickness of the second ring 608 varies as a function of the circumferential position around the center 602. Similarly, the variable blend zone 606 can have a thickness profile that varies as a function of the circumferential position around the center 602 and provides a transition in thickness from the maximum thickness ring 604 to the variable and less thicknesses of the second ring 608. For example, the variable blend zone 606 to a second ring 608 can be divided into eight sectors that are labeled A-H in FIG. 55, including top zone A, top-toe zone B, toe zone C, bottom-toe zone D, bottom zone E, bottom-heel zone F, heel zone G, and top-heel zone H. These eight zones can have differing angular widths as shown, or can each have the same angular width (e.g., one eighth of 360 degrees). Each of the eight zones can have its own thickness variance, each ranging from a common maximum thickness adjacent the ring 604 to a different minimum thickness at the second ring 608. For example, the second ring can be thicker in zones A and E, and thinner in zones C and G, with intermediate thicknesses in zones B, D, F, and H. In this example, the zones B, D, F, and H can vary in thickness both along a radial direction (thinning moving radially outwardly) and along a circumferential direction (thinning moving from zones A and E toward zones C and G).

One example of the face portion 600 can have the following thicknesses: 3.1 mm at center 602, 3.3 mm at ring 604, the second ring 608 can vary from 2.8 mm in zone A to 2.2 mm in zone C to 2.4 mm in zone E to 2.0 mm in zone G, and 1.8 mm in the heel and toe zones 610.

FIGS. 56 and 57 show the rear face surface of another exemplary face portion 700 that includes a non-symmetrical variable thickness profile. The center 702 of the face can have a center thickness, and the face thickness can gradually increase moving radially outwardly from the center across an inner blend zone 703 to a maximum thickness ring 704, which can be circular. The face thickness can gradually decrease moving radially outwardly from the maximum thickness ring 704 across an variable blend zone 705 to an outer zone 706 comprised of a plurality of wedge shaped sectors A-H having varying thicknesses. As best shown in FIG. 57, sectors A, C, E, and G can be relatively thicker, while sectors B, D, F, and H can be relatively thinner. An outer blend zone 708 surrounding the outer zone 706 transitions in thickness from the variable sectors down to a perimeter ring 710 having a relatively small yet constant thickness. The outer zone 706 can also include blend zones between each of the sectors A-H that gradually transition in thickness from one sector to an adjacent sector.

One example of the face portion 700 can have the following thicknesses: 3.9 mm at center 702, 4.05 mm at ring 704, 3.6 mm in zone A, 3.2 mm in zone B, 3.25 mm in zone C, 2.05 mm in zone D, 3.35 mm in zone E, 2.05 mm in zone F, 3.00 mm in zone G, 2.65 mm in zone H, and 1.9 mm at perimeter ring 710.

FIG. 58 shows the rear face of another exemplary face portion 800 that includes a non-symmetrical variable thickness profile having a targeted thickness offset toward the heel side (left side). The center 802 of the face has a center thickness, and to the toe/top/bottom the thickness gradually increases across an inner blend zone 803 to inner ring 804 having a greater thickness than at the center 802. The thickness then decreases moving radially outwardly across a second blend zone 805 to a second ring 806 having a thickness less than that of the inner ring 804. The thickness then decreases moving radially outwardly across a third blend zone 807 to a third ring 808 having a thickness less than that of the second ring 806. The thickness then decreases moving radially outwardly across a fourth blend zone 810 to a fourth ring 811 having a thickness less than that of the third ring 808. A toe end zone 812 blends across an outer blend zone 813 to an outer perimeter 814 having a relatively small thickness.

To the heel side, the thicknesses are offset by set amount (e.g., 0.15 mm) to be slightly thicker relative to their counterpart areas on the toe side. A thickening zone 820 (dashed lines) provides a transition where all thicknesses gradually step up toward the thicker offset zone 822 (dashed lines) at the heel side. In the offset zone 822, the ring 823 is thicker than the ring 806 on the heel side by a set amount (e.g., 0.15 mm), and the ring 825 is thicker that the ring 808 by the same set amount. Blend zones 824 and 826 gradually decrease in thickness moving radially outwardly, and are each thicker than their counterpart blend zones 807 and 810 on the toe side. In the thickening zone 820, the inner ring 804 gradually increases in thickness moving toward the heel.

One example of the face portion 800 can have the following thicknesses: 3.8 mm at the center 802, 4.0 mm at the inner ring 804 and thickening to 4.15 mm across the thickening zone 820, 3.5 mm at the second ring 806 and 3.65 mm at the ring 823, 2.4 mm at the third ring 808 and 2.55 mm at the ring 825, 2.0 mm at the fourth ring 811, and 1.8 mm at the perimeter ring 814.

The targeted offset thickness profile shown in FIG. 58 can help provide a desirable CT profile across the face. Thickening the heel side can help avoid having a CT spike at the heel side of the face, for example, which can help avoid having a non-conforming CT profile across the face. Such an offset thickness profile can similarly be applied to the toe side of the face, or to both the toe side and the heel side of the face to avoid CT spikes at both the heel and toe sides of the face. In other embodiments, an offset thickness profile can be applied to the upper side of the face and/or toward the bottom side of the face.

Figure 28:
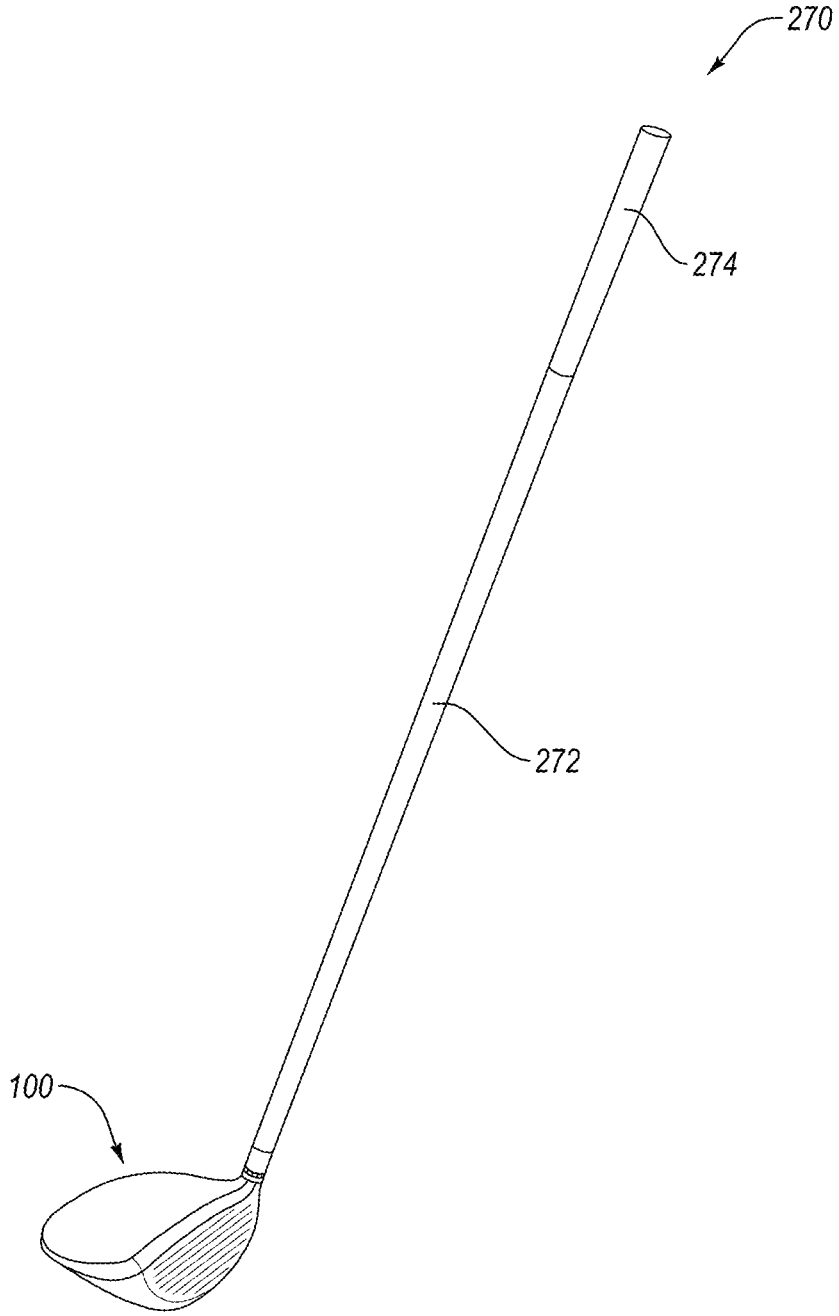
FIG. 28 is a perspective view of a golf club, according to one or more examples of the present disclosure.

The golf club head 100 also includes a hosel 120 extending from the heel region 116 of the golf club head 100. As shown in FIG. 28, a shaft 272 of a golf club 270 may be attached directly to the hosel 120 or, alternatively, attached indirectly to the hosel 120, such as via a flight control technology (FCT) component 122 (e.g., an adjustable lie/loft assembly) coupled with the hosel 120 (see, e.g., FIG. 3). The golf club 270 also includes a grip 274 fitted around a distal end or free end of the shaft 272. The grip 104 of the golf club 270 helps promote the handling of the golf club 270 by a user during a golf swing. The golf club head 100 includes a hosel axis 191 (see, e.g., FIG. 3), which is coaxial with the shaft 272, defining a central axis of the hosel 120.

Figure 3:
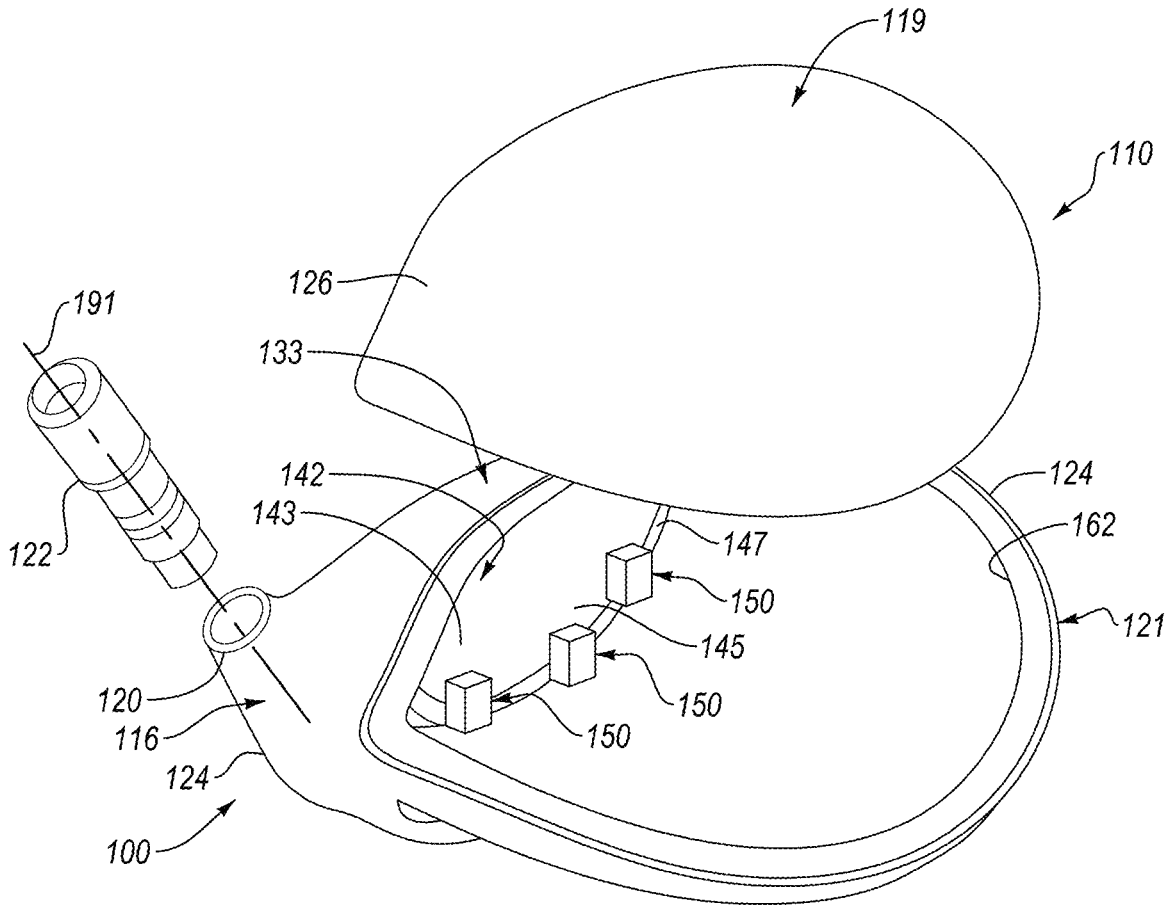
FIG. 3 is an exploded perspective view of a golf club head, from a top of the golf club head, according to one or more examples of the present disclosure.

In some embodiments, such as shown in FIG. 3, the body 110 of the golf club head 100 includes a frame 124 to which one or more inserts of the body 110 are coupled. For example, the crown portion 119 of the body 110 includes a crown insert 126 attached to the frame 124 at the top region 133 of the golf club head 100. Similarly, the sole portion 117 of the body 110 may include a sole insert attached to the frame 124 at the bottom region 135 of the golf club head 100. For example, the frame 124 of the body 110 may have at least one of a sole opening, sized and configured to receive a sole insert or a crown opening 162, sized and configured to receive the crown insert 126. More specifically, the sole opening receives and fixedly secures a sole insert. Similarly, the crown opening 162 receives and fixedly secures the crown insert 126. The sole and crown openings are each formed to have a peripheral edge or recess to seat, respectively, a sole insert and a crown insert, such that the sole and crown inserts are either flush with the frame 124 to provide a smooth seamless outer surface or, alternatively, slightly recessed.

Though not shown, the frame 124 may have a face opening, at the forward region 112 of the body 110, to receive and fixedly secure the strike plate 143 of the golf club head 100. In some implementations, the strike plate 143 is be fixedly secured to the face opening of the frame 124 by welding, braising, soldering, screws, or other coupling means. Generally, the frame 124 provides a framework or skeleton of the golf club head 100 to strengthen the golf club head 100 in areas of high stress caused by the impact of a golf ball with the face portion 142. Such areas include a transition region where the golf club head 100 transitions from the face portion 142 to the crown portion 119, the sole portion 117, and the skirt portion 121 of the body 110.

In some examples, the body 110 (e.g., just the frame 124 of the body 110) and/or the face portion 142 are made of one or more of the following materials: carbon steel, stainless steel (e.g. 17-4 PH stainless steel), alloy steel, Fe—Mn—Al alloy, nickel-based ferroalloy, cast iron, super alloy steel, aluminum alloy (including but not limited to 3000 series alloys, 5000 series alloys, 6000 series alloys, such as 6061-T6, and 7000 series alloys, such as 7075), magnesium alloy, copper alloy, titanium alloy (including but not limited to 6-4 titanium, 3-2.5, 6-4, SP700, 15-3-3-3, 10-2-3, or other alpha/near alpha, alpha-beta, and beta/near beta titanium alloys) or mixtures thereof. In yet other examples, the body 110 (e.g., a crown insert and/or a sole insert) and/or the face portion 142 are formed of a non-metal material with a density less than about 2 g/cm$^3$, such as between about 1 g/cm$^3$ to about 2 g/cm$^3$. The non-metal material may include a polymer or polymer-reinforced composite material. The polymer can be either thermoset or thermoplastic, and can be amorphous, crystalline and/or a semi-crystalline structure.

The body 110 is made of a titanium alloy in some examples, which can be titanium or any of various titanium-based alloys. In certain examples, the body 110 is made of a titanium alloy, including, but not limited to, 9-1-1 titanium, 6-4 titanium, 3-2.5, 6-4, SP700, 15-3-3-3, 10-2-3, or other alpha/near alpha, alpha-beta, and beta/near beta titanium alloys) or mixtures thereof. Titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys. Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation.

Golf club head bodies that are cast including the face as an integral part of the body (e.g., cast at the same time as a single cast object) can provide superior structural properties compared to club heads where the face is formed separately and later attached (e.g., welded or bolted) to a front opening in the club head body. However, the advantages of having an integrally cast Ti face are mitigated by the need to remove the alpha case on the surface of cast Ti faces.

With the herein disclosed club head bodies comprising an integrally cast 9-1-1 Ti face, the drawback of having to remove the alpha case can be eliminated, or at least substantially reduced. For a cast 9-1-1 Ti face, using a conventional mold pre-heat temperature of 1000 C or more, the thickness of the alpha case can be about 0.15 mm or less, or about 0.20 mm or less, or about 0.30 mm or less, such as between 0.10 mm and 0.30 mm in some embodiments, whereas for a cast 6-4 Ti face the thickness of the alpha case can be greater than 0.15 mm, or greater than 0.20 mm, or greater than 0.30 mm, such as from about 0.25 mm to about 0.30 mm in some examples.

In some cases, the reduced thickness of the alpha case for 9-1-1 Ti face portions (e.g., 0.15 mm or less) may not be thin enough to provide sufficient durability needed for a face portion and to avoid needing to etch away some of the alpha case with a harsh chemical etchant, such as HF acid. In such cases, the pre-heat temperature of the mold can be lowered (such as to less than 800 C, less than 700 C, less than 600 C, and/or less than or equal to 500 C) prior to pouring the molten titanium alloy into the mold. This can further reduce the amount of oxygen transferred from the mold to the cast titanium alloy, resulting in a thinner alpha case (e.g., less than 0.15 mm, less than 0.10 mm, and/or less than 0.07 mm). This provides better ductility and durability for the body with integral face, which is especially important for the face portion.

The thinner alpha case in cast 9-1-1 Ti faces helps provide enhanced durability, such that the face is durable enough that the removal of part of the alpha case from the face via chemical etching is not needed. Thus, hydrofluoric acid etching can be eliminated from the manufacturing process when the body and face are unitarily cast using 9-1-1 Ti, especially when using molds with lower pre-heat temperatures. This can simplify the manufacturing process, reduce cost, reduce safety risks and operation hazards, and eliminate the possibility of environmental contamination by HF acid. Further, because HF acid is not introduced to the metal, the body with integral face, or even the whole club head, can comprise very little or substantially no fluorine atoms, which can be defined as less than 1000 ppm, less than 500 ppm, less than 200 ppm, and or less than 100 ppm, wherein the fluorine atoms present are due to impurities in the metal material used to cast the body.

In some examples, the body 110 is made of an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" titanium alloy). In another representative example, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti. In yet another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti. In a further representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti. In another representative embodiment, the alloy may comprise 8% Al by weight, 2.5% Mo by weight, 2% Cr by weight, 1% V by weight, and/or 0.5% Fe by weight, with the balance comprising Ti (such titanium alloys can have the formula Ti-8A1-2.5Mo-2Cr-1V-0.5Fe). As used herein, reference to "Ti-8A1-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8A1-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8A1-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8A1-2.5Mo-2Cr-1V-0.5Fe alloy can have a tensile strength of about 1320 MPa, a yield strength of about 1284 MPa, and an elongation of about 10%. The Ti-8A1-2.5Mo-2Cr-1V-0.5Fe alloy, particularly when used to cast golf club head bodies, promotes less deflection for the same thickness due to a higher ultimate tensile strength compared to other materials. In some implementations, providing less deflection with the same thickness benefits golfers with higher swing speeds because over time the face of the golf club head will maintain its original shape (e.g., bulge and roll) and have a lower tendency to flatten over time.

The polymer may also be formed of an engineering plastic such as a crystalline or semi-crystalline engineering plastic or an amorphous engineering plastic. Potential engineering plastic candidates include polyphenylene sulfide ether (PPS), polyethelipide (PEI), polycarbonate (PC), polypropylene (PP), acrylonitrile-butadience styrene plastics (ABS), polyoxymethylene plastic (POM), nylon 6, nylon 6-6, nylon 12, polymethyl methacrylate (PMMA), polypheylene oxide (PPO), polybothlene terephthalate (PBT), polysulfone (PSU), polyether sulfone (PES), polyether ether ketone (PEEK) or mixtures thereof. Organic fibers, such as fiberglass, carbon fiber, or metallic fiber, can be added into the engineering plastic, so as to enhance structural strength. The reinforcing fibers can be continuous long fibers or short fibers. One of the advantages of PSU is that it is relatively stiff with relatively low damping which produces a better sounding or more metallic sounding golf club compared to other polymers which may be overdamped. Additionally, PSU requires less post processing in that it does not require a finish or paint to achieve a final finished golf club head.

One exemplary material from which a sole insert and/or the crown insert 126 may be made from is a thermoplastic continuous carbon fiber composite laminate material having long, aligned carbon fibers in a PPS (polyphenylene sulfide) matrix or base. A commercial example of a fiber-reinforced polymer, from which a sole insert and/or the crown insert 126 may be made, is TEPEX® DYNALITE 207 manufactured by Lanxess®. TEPEX® DYNALITE 207 is a high strength, lightweight material, arranged in sheets, having multiple layers of continuous carbon fiber reinforcement in a PPS thermoplastic matrix or polymer to embed the fibers. The material may have a 54% fiber volume, but can have other fiber volumes (such as a volume of 42% to 57%). According to one example, the material weighs 200 g/m$^2$. Another commercial example of a fiber-reinforced polymer, from which a sole insert and/or the crown insert 126 is made, is TEPEX® DYNALITE 208. This material also has a carbon fiber volume range of 42 to 57%, including a 45% volume in one example, and a weight of 200 g/m2. DYNALITE 208 differs from DYNALITE 207 in that it has a TPU (thermoplastic polyurethane) matrix or base rather than a polyphenylene sulfide (PPS) matrix.

By way of example, the fibers of each sheet of TEPEX® DYNALITE 207 sheet (or other fiber-reinforced polymer material, such as DYNALITE 208) are oriented in the same direction with the sheets being oriented in different directions relative to each other, and the sheets are placed in a two-piece (male/female) matched die, heated past the melt temperature, and formed to shape when the die is closed. This process may be referred to as thermoforming and is especially well-suited for forming a sole insert and the crown insert 126. After the crown insert 126 and/or a sole insert are formed (separately, in some implementations) by the thermoforming process, each is cooled and removed from the matched die. In some implementations, the crown insert 126 and/or a sole insert have a uniform thickness, which facilitates use of the thermoforming process and ease of manufacture. However, in other implementations, the crown insert 126 and/or a sole insert may have a variable thickness to strengthen select local areas of the insert by, for example, adding additional plies in select areas to enhance durability, acoustic properties, or other properties of the respective inserts.

In some examples, the crown insert 126 and/or a sole insert can be made by a process other than thermoforming, such as injection molding or thermosetting. In a thermoset process, the crown insert 126 and/or a sole insert may be made from "prepreg" plies of woven or unidirectional composite fiber fabric (such as carbon fiber composite fabric) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the crown insert 126 and/or a sole insert. Each insert is cooled and removed from its respective mold.

The carbon fiber reinforcement material for the crown insert 126 and/or a sole insert, made by the thermoset manufacturing process, may be a carbon fiber known as "34-700" fiber, available from Grafil, Inc., of Sacramento, Calif., which has a tensile modulus of 234 Gpa (34 Msi) and a tensile strength of 4500 Mpa (650 Ksi). Another suitable fiber, also available from Grafil, Inc., is a carbon fiber known as "TR50S" fiber which has a tensile modulus of 240 Gpa (35 Msi) and a tensile strength of 4900 Mpa (710 Ksi). Exemplary epoxy resins for the prepreg plies used to form the thermoset crown and sole inserts include Newport 301 and 350 and are available from Newport Adhesives & Composites, Inc., of Irvine, Calif. In one example, the prepreg sheets have a quasi-isotropic fiber reinforcement of 34-700 fiber having an areal weight between about 20 g/m^2 to about 200 g/m^2 preferably about 70 g/m^2 and impregnated with an epoxy resin (e.g., Newport 301), resulting in a resin content (R/C) of about 40%. For convenience of reference, the plipary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%. According to some examples, an areal weight of the crown portion of the golf club head is less than about 0.35 g/cm$^2$ over more than about 50% of an entire surface area of the crown portion. In the same or other examples, an areal weight of the sole portion of the golf club head is less than about 0.35 g/cm$^2$ over more than about 50% of an entire surface area of the sole portion.

The crown insert 126, as well as a sole insert in some implementations, has a complex three-dimensional shape and curvature corresponding generally to a desired shape and curvature of the crown portion 119 of the golf club head 100. It will be appreciated that other types of club heads, such as fairway wood-type clubs, may be manufactured using one or more of the principles, methods, and materials described herein.

Referring to FIGS. 10, 11, and 16-18, in some implementations, the golf club head 100 includes a slot 170 formed in the sole portion 117 of the body 110. The slot 170 is open to an exterior of the golf club head 100 and extends lengthwise from the heel region 116 to the toe region 114. More specifically, the slot 170 is elongate in a lengthwise direction substantially parallel to, but offset from, the face portion 142. Generally, the slot 170 is a groove or channel formed in the sole portion 117 of the body 110 of the golf club head 100. In some implementations, the slot 170 is a through-slot, or a slot that is open on a sole portion side of the slot 170 and open on an interior cavity 113 side or interior side of the slot 170. However, in other implementations, as shown in FIGS. 10, 11, and 16-18, the slot 170 is not a through-slot, but rather is closed on an interior cavity side or interior side of the slot 170. For example, the slot 170 is defined by a portion 171 of the side wall of the sole portion 117 of the body 110 that protrudes into the interior cavity 113 and has a concave exterior surface having any of various cross-sectional shapes, such as a substantially U-shape, V-shape, and the like.

The slot 170 can be any of various flexible boundary structures (FBS) as described in U.S. Pat. No. 9,044,653, filed Mar. 14, 2013, which is incorporated by reference herein in its entirety. Additionally, or alternatively, the golf club head 100 can include one or more other FBS at any of various other locations on the golf club head 100. The slot 170 may be made up of curved sections, or several segments that may be a combination of curved and straight segments. Furthermore, the slot 170 may be machined or cast into the golf club head 100. Although shown in the sole portion 117 of the golf club head 100, the slot 170 may, alternatively or additionally, be incorporated into the crown portion 119 of the golf club head 100.

In some implementations, the slot 170 is filled with a filler material. The filler material can be made from a non-metal, such as a thermoplastic material, thermoset material, and the like, in some implementations. The slot 170 may be filled with a material to prevent dirt and other debris from entering the slot and possibly the interior cavity 113 of the golf club head 100 when the slot 170 is a through-slot. The filler material may be any relatively low modulus materials including polyurethane, elastomeric rubber, polymer, various rubbers, foams, and fillers. The filler material should not substantially prevent deformation of the golf club head 100 when in use as this would counteract the pelipeter flexibility.

According to one embodiment, the filler material is initially a viscous material that is injected or otherwise inserted into the slot 170. Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In some embodiments, a solid filler material may be press-fit or adhesively bonded into a slot, channel, or other flexible boundary structure. In other embodiments, a filler material may poured, injected, or otherwise inserted into a slot or channel and allowed to cure in place, forming a sufficiently hardened or resilient outer surface. In still other embodiments, a filler material may be placed into a slot or channel and sealed in place with a resilient cap or other structure formed of a metal, metal alloy, metallic, composite, hard plastic, resilient elastomeric, or other suitable material.

In other implementations, the slot 170 is not filled with a filler material, but rather maintains an open, vacant, space within the slot 170.

Figure 11:
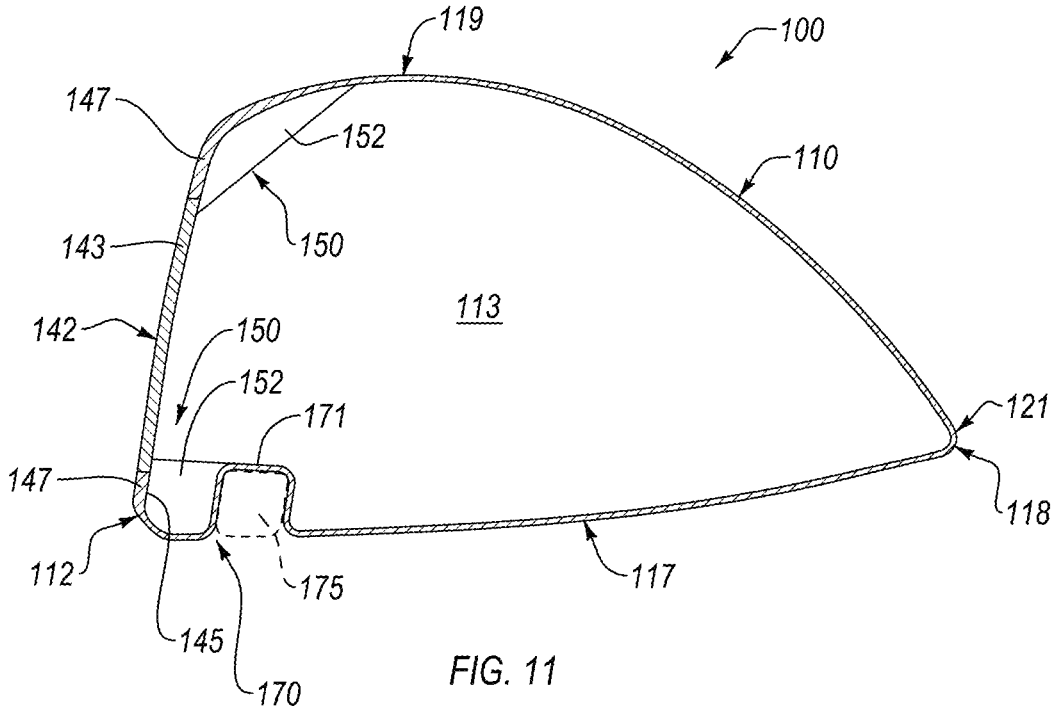
FIG. 11 is a cross-sectional side elevation view of a golf club head, taken along a line similar to line 1-1 of FIG. 2, according to one or more examples of the present disclosure.

Referring to FIG. 11, the slot 170 functions as a weight track for adjustably retaining at least one weight 175 within the slot 170. Accordingly, the slot 170 is defined as a forward or lateral weight track in some implementations. As presented above, the slot 170 can be integrally formed with the body 110. The slot 170 can define a track or port to which the at least one weight 175 is slidably mounted. In one example, the at least one weight 175 includes a first weight (or weight assembly) having two pieces, and a second weight (or weight assembly) having two pieces. Each of the first and second weights are fastened by fastening means, such as respective screws to the slot 170. In some implementations, the first and second weights may be secured to the slot 170 by clamping a portion of the track, such as at least one ledge, such that the fastening means is put in tension. Additionally or alternatively, the first and second weights may be secured to the slot 170 by compressing against a portion of the track such that the fastening means is put in compression. The first and second weights can take any of various shapes and can be mounted to the slot 170 in any of various ways. Moreover, the at least one weight 175 can take the form of a single-piece design or multi-piece design (e.g., more than two pieces).

The slot 170 may allow one or more weights 175 to be selectively loosened and tightened for slidable adjustment laterally, in the heel-to-toe direction, to adjust an effective center-of-gravity (CG) of the golf club head 100 in the heel-to-toe direction. By adjusting the CG of the golf club head 100 laterally, the performance characteristics of the golf club head 100 are adjusted, which promotes an adjustment to the flight characteristics of a golf ball struck by the golf club head 100, such as the sidespin characteristics of the golf ball. Notably, the use of two weights (e.g., first and second weights), that are independently adjustable relative to each other, allows for adjustment and interplay between the weights. For example, both weights can be positioned fully in the toe region 114, fully in the heel region 116, spaced apart a maximum distance from each other, with one weight fully in the toe region 114, and the other weight fully in the heel region 116, positioned together in the center or intermediate location of the slot 170, or in other weight location patterns.

In some embodiments, the slot 170 is offset from the face portion 142 by an offset distance, which is the minimum distance between a first vertical plane passing through a center of the strike plate of the face portion 142 and the slot at the same x-axis coordinate as the center of the strike plate, between about 5 mm and about 50 mm, such as between about 5 mm and about 35 mm, such as between about 5 mm and about 30 mm, such as between about 5 mm and about 20 mm, or such as between about 5 mm and about 15 mm.

Although not shown, the body 110 of the golf club head 100 may include a rearward slot, with a configuration similar to the slot 170, but oriented in a forward-to-rearward direction, as opposed to a heel-to-toe direction. The body 110 includes a rearward slot, but no slot 170 in some implementations, and both a rearward slot and the slot 170 in other implementations. In one example, the rearward slot is positioned rearwardly of the slot 170. The rearward slot can act as a weight track in some implementations. Moreover, the rearward track can be offset from the face portion 142 by an offset distance, which is the minimum distance between a first vertical plane passing through the center of the strike plate of the face portion 142 and the rearward track at the same x-axis coordinate as the center of the strike plate 43, between about 5 mm and about 50 mm, such as between about 5 mm and about 40 mm, such as between about 5 mm and about 30 mm, or such as between about 10 mm and about 30 mm.

In certain embodiments, the slot 170, as well as the rearward slot if present, has a certain slot width, which is measured as a horizontal distance between a first slot wall and a second slot wall. For the slot 170, as well as the rearward track, the slot width may be between about 5 mm and about 20 mm, such as between about 10 mm and about 18 mm, or such as between about 12 mm and about 16 mm. According to some embodiments, the depth of the slot 170 (i.e., the vertical distance between a bottom slot wall and an imaginary plane containing the regions of the sole adjacent the first and second slot walls of the slot 170) may be between about 6 mm and about 20 mm, such as between about 8 mm and about 18 mm, or such as between about 10 mm and about 16 mm.

Additionally, the slot 170, as well as the rearward slot if present, has a certain slot length, which can be measured as the horizontal distance between a slot end wall and another slot end wall. For both the slot 170 and rearward slot, their lengths may be between about 30 mm and about 120 mm, such as between about 50 mm and about 100 mm, or such as between about 60 mm and about 90 mm. Additionally, or alternatively, the length of the slot 170 may be represented as a percentage of a length of the strike plate of the face portion 142. For example, the slot 170 may be between about 30% and about 100% of the length of the strike plate, such as between about 50% and about 90%, or such as between about 60% and about 80% mm of the length of the strike plate.

In some instances, the slot 170 is a feature to improve and/or increase the coefficient of restitution (COR) across the strike plate 143 of the face portion 142. In regards to a COR feature, the slot 170 may take on various forms such as a channel or through slot. The COR of the golf club head 100 is a measurement of the energy loss or retention between the golf club head 100 and a golf ball when the golf ball is struck by the golf club head 100. Desirably, the COR of the golf club head 10 is high to promote the efficient transfer of energy from the golf club head 100 to the ball during impact with the ball. Accordingly, the COR feature of the golf club head 100 promotes an increase in the COR of the golf club head 100. Generally, the slot 170 increases the COR of the golf club head 100 by increasing or enhancing the pelipeter flexibility of the strike plate of the face portion 142 of the golf club head 100.

Further details concerning the slot 170 as a COR feature of the golf club head 100 can be found in U.S. patent application Ser. Nos. 13/338,197, 13/469,031, 13/828,675, filed Dec. 27, 2011, May 10, 2012, and Mar. 14, 2013, respectively, U.S. patent application Ser. No. 13/839,727, filed Mar. 15, 2013, U.S. Pat. No. 8,235,844, filed Jun. 1, 2010, U.S. Pat. No. 8,241,143, filed Dec. 13, 2011, U.S. Pat. No. 8,241,144, filed Dec. 14, 2011, all of which are incorporated herein by reference in their entirety.

The golf club head 100 disclosed herein may have a volume equal to the volumetric displacement of the body 110 of the golf club head 100. For example, the golf club head 100 of the present application can be configured to have a head volume between about 110 $cm^3$ and about 600

$cm^3$. In more particular embodiments, the head volume may be between about 250 $cm^3$ and about 500 $cm^3$. In yet more specific embodiments, the head volume may be between about 300 $cm^3$ and about 500 $cm^3$, between about 300 $cm^3$ and about 360 $cm^3$, between about 300 $cm^3$ and about 420 $cm^3$, between about 350 $cm^3$ and about 500 $cm^3$, or between about 420 $cm^3$ and about 500 $cm^3$. In the case of a driver, the golf club head 100 may have a volume between about 300 $cm^3$ and about 460 $cm^3$, and a total mass between about 145 g and about 245 g. In the case of a fairway wood, the golf club head 100 may have a volume between about 100 $cm^3$ and about 250 $cm^3$, and a total mass between about 145 g and about 260 g. In the case of a utility or hybrid club the golf club head 100 may have a volume between about 60 $cm^3$ and about 150 $cm^3$, and a total mass between about 145 g and about 280 g.

Figure 4:
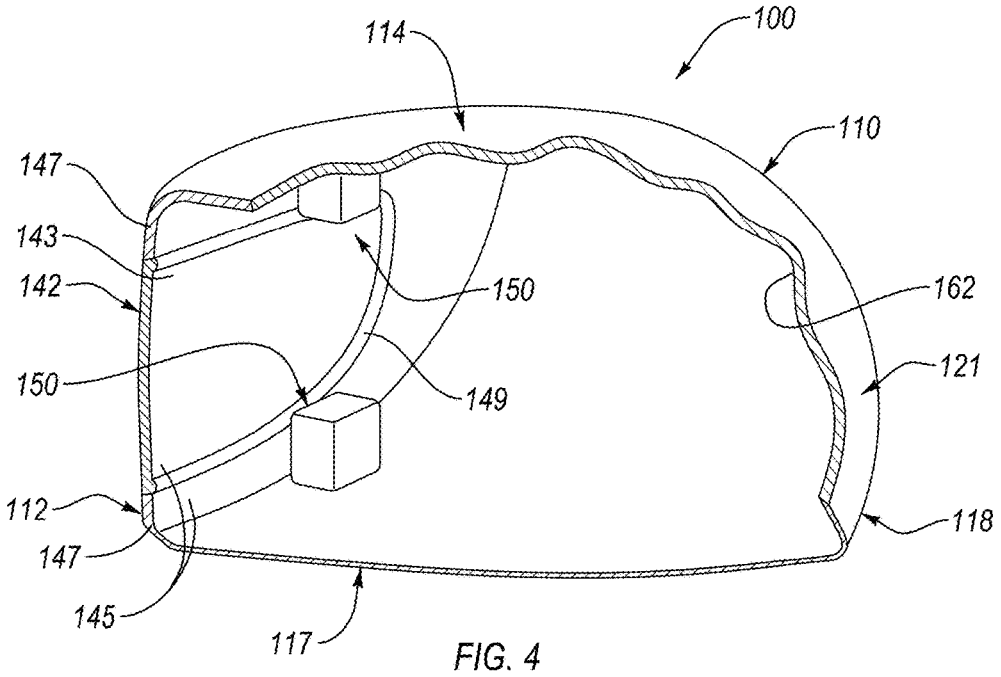
FIG. 4 is a cross-sectional perspective view of a golf club head, taken along a line similar to line 1-1 of FIG. 2, from a side of the golf club head, and shown with a crown insert of the golf club head removed, according to one or more examples of the present disclosure.
Figure 6:
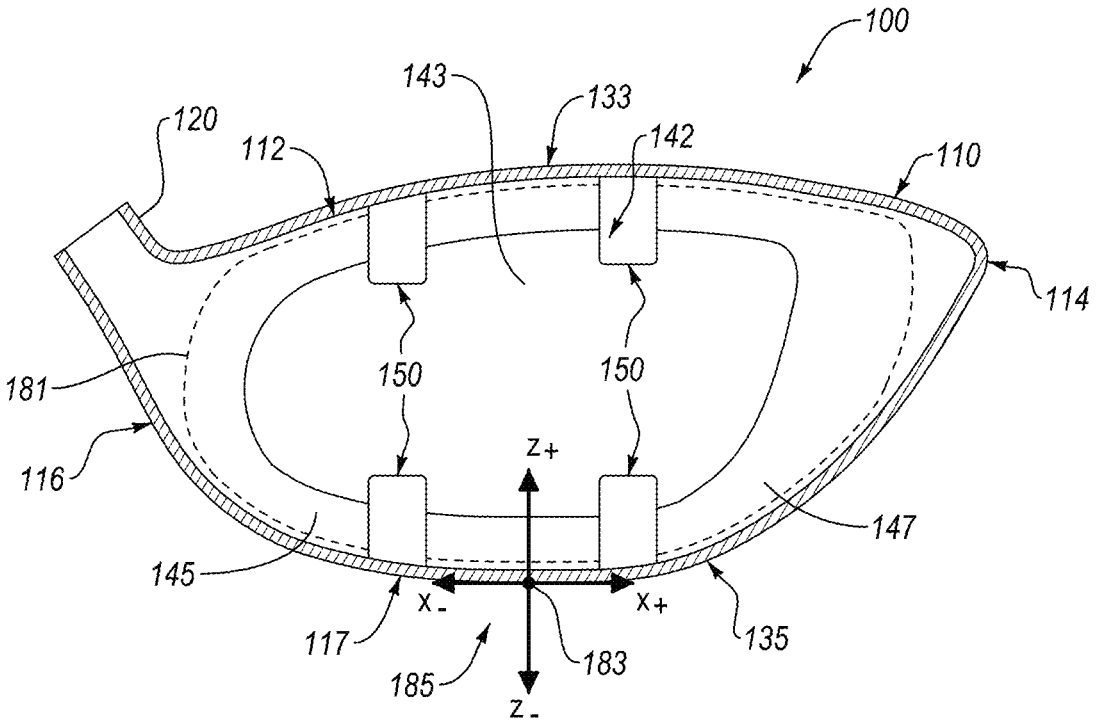
FIG. 6 is a cross-sectional rear view of a golf club head, taken along a line similar to line 2-2 of FIG. 1, according to one or more examples of the present disclosure.

The golf club head 100 includes at least one stiffener 150, shown schematically in FIGS. 4-6, positioned at least partially within the interior cavity 113. The stiffener 150 is directly coupleable to (e.g., contactable with or in abutting engagement with) the face portion 142 of the body 110. More specifically, the stiffener 150 is directly coupleable to an interior surface 145 of the face portion 142 of the body 110. The interior surface 145 is opposite the strike face 144, which defines an exterior surface of the face portion 142. In some implementations, the stiffener 150 is directly coupleable to the interior surface 145 of just the lip 147 of the face portion 142. However, in other implementations, the stiffener 150 is directly coupleable to the interior surface 145 of both the lip 147 and the strike plate 143. In implementations where the strike plate 143 is welded to the lip 147, the stiffener 150 can be directly coupleable to the weld. The stiffener 150 may be non-adjustably directly coupled to the interior surface 145 of the face portion 142 or adjustably directly coupled to the interior surface 145 of the face portion 142. As defined herein, the stiffener 150 is non-adjustably directly coupled to the interior surface 145 when permanent deformation is required to decouple the stiffener 150 from the face portion 142. In contrast, as defined herein, the stiffener 150 is adjustable directly coupled to the interior surface 145 when the stiffener 150 can be decoupled from the face portion 142 without permanent deformation of the stiffener 150.

The stiffener 150 is configured to locally stiffen the face portion 142, when directly coupled to the face portion 142, such that a characteristic time (CT) of the golf club head 100 within an area of the strike plate 143 proximate the stiffener 150 is lower than without the stiffener 150. Generally, the stiffener 150 is offset from the origin 183 of the club head origin coordinate system 185 along the x-axis of the club head origin coordinate system 185 to stiffen the face portion 142 and lower the CT within an area of the strike plate 143 at a location away from the origin 183 along the x-axis of the club head origin coordinate system 185. In this manner, the CT of the golf club head 100 at locations with an x-axis coordinate that is toeward (e.g., towards the toe region 114) and/or heelward (e.g., towards the heel region 116) away from the origin 183 can be locally reduced without significantly affecting the CT of the golf club head 100 at locations with an x-axis coordinate proximate that of the origin 183. Additionally, using the stiffener 150 to discretely reduce the CT of the golf club head 100 just at locations with an x-axis coordinate that is toeward and/or heelward away from the origin 183 helps to achieve a desirable COR of the strike plate 143 by promoting a lower thickness of the strike plate 143, particularly at toeward and/or heelward locations of the strike plate 143.

Figure 9:
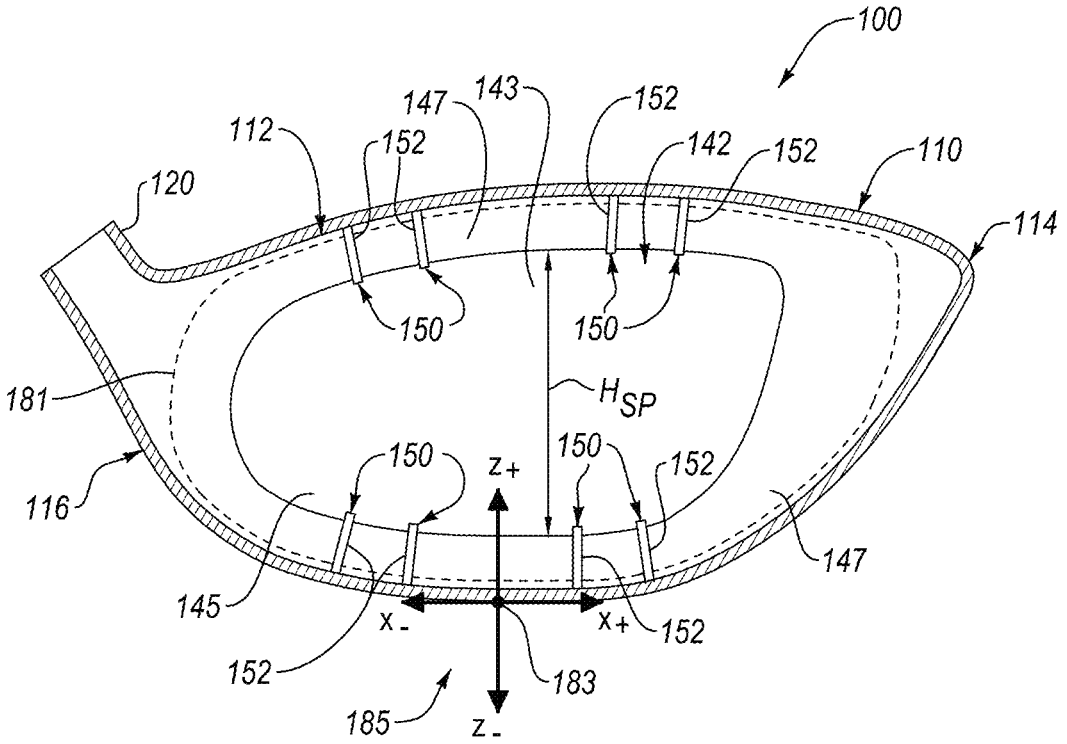
FIG. 9 is a cross-sectional rear view of a golf club head, taken along a line similar to line 2-2 of FIG. 1, according to one or more examples of the present disclosure.

The golf club head 100 may have any number of stiffeners 150 at any of various locations having an x-axis coordinate greater than or less than zero. A stiffener 150 with an x-axis coordinate greater than zero is located closer to the toe region 114 than the heel region 116 and thus can be considered a toe stiffener. In contrast, a stiffener 150 with an x-axis coordinate less than zero is located closer to the heel region 116 than the toe region 114 and thus can be considered a heel stiffener. Referring to FIG. 6, the golf club head 100 has two stiffeners 150 with an x-axis coordinate greater than zero and two stiffeners 150 with an x-axis coordinate less than zero. In other embodiments, such as shown in FIG. 9, the golf club head 100 has more than two stiffeners 150 with an x-axis coordinate greater than zero and more than two stiffeners 150 with an x-axis coordinate less than zero. However, in yet other embodiments, the golf club head 100 has fewer than two stiffeners 150 (e.g., zero stiffeners or one stiffener) with an x-axis coordinate greater than zero and/or fewer than two stiffeners 150 (e.g., zero stiffeners or one stiffener) with an x-axis coordinate less than zero.

Additionally, each stiffener 150 of the golf club head 100 can be coupleable (e.g., directly coupleable) to the interior surface of the body 110 at the top region 133 and/or the bottom region 135 of the golf club head 100. Referring to FIGS. 4 and 5, according to one embodiment, the golf club head 100 includes at least one stiffener 150 directly coupleable to the interior surface of the body 110 at the top region 133 and at least one stiffener 150 directly coupleable to the interior surface of the body 110 at the bottom region 135 of the golf club head 100. It is recognized that in some implementations, one stiffener 150 may be directly coupleable to the interior surface of the body 110 at both the top region 133 and the bottom region 135 (e.g., extend continuously from the top region 133 to the bottom region 135).

As shown in FIG. 6, in one embodiment, the golf club head 100 includes two stiffeners 150 directly coupleable to the interior surface of the body 110 at the top region 133 and two stiffeners 150 directly coupleable to the interior surface of the body 110 at the bottom region 135 of the golf club head 100. According to other embodiments, the golf club head 100 includes one or more stiffeners 150 directly coupleable to the interior surface of the body 110 at the top region 133, but no stiffeners 150 directly coupleable to the interior surface of the body 110 at the bottom region 135, or includes one or more stiffeners 150 directly coupleable to the interior surface of the body 110 at the bottom region 135, but no stiffeners 150 directly coupleable to the interior surface of the body 110 at the top region 133.

Also, the quantity of stiffeners 150 directly coupleable to the interior surface of the body 110 at the top region 133 can be the same or different than the quantity of stiffeners 150 directly coupleable to the interior surface of the body 110 at the bottom region 135. For example, in one implementation, the quantity of stiffeners 150 directly coupleable to the interior surface of the body 110 at the bottom region 135 is more than the quantity of stiffeners 150 directly coupleable to the interior surface of the body 110 at the top region 133. However, the stiffeners 150 are sized such that a combined area of the interior surface 145 of the face portion 142 contacted by the stiffeners 150 is less than an entire area of the interior surface 145 of the face portion 142.

The stiffeners 150 are significantly offset from the origin along the x-axis of the club head origin coordinate system 185 to correspondingly reduce the CT at locations offset from the origin along the x-axis. In one embodiment, one or more of the stiffeners 150 of the golf club head 100 has an x-axis coordinate of the club head origin coordinate system 185 that is either greater than 10 mm and less than 50 mm or greater than −50 mm and less than −10 mm. According to another embodiment, one or more of the stiffeners 150 of the golf club head 100 has an x-axis coordinate of the club head origin coordinate system 185 that is either greater than 20 mm and less than 50 mm or greater than −50 mm and less than −20 mm. In another embodiment, one or more of the stiffeners 150 of the golf club head 100 has an x-axis coordinate of the club head origin coordinate system 185 that is either greater than 30 mm and less than 40 mm or greater than −40 mm and less than −30 mm. In another embodiment, one or more of the stiffeners 150 of the golf club head 100 has an x-axis coordinate of the club head origin coordinate system 185 that is either greater than 40 mm and less than 50 mm or greater than −50 mm and less than −40 mm. The location of a stiffener 150 is defined as the location of either a midpoint (e.g., geometric center) or center of mass of the portion of the stiffener 150 contactable with the face portion or a center.

In embodiments having a plurality of stiffeners 150, two or more stiffeners 150 may be different types. In other words, not all of the stiffeners 150 are the same type of stiffener in some embodiments. More specifically, one of the stiffeners 150 may be a certain type of the several types of stiffeners described herein and another one of the stiffeners 150 may be another type of the several types of stiffeners described herein. For example, the stiffeners 150 at the top region 133 may be one type of stiffener 150 (such as ribs) and the stiffeners 150 at the bottom region 135 may be another type of stiffener 150 (such as discrete masses of polymeric material).

Referring again to FIGS. 4 and 5, in some examples, the interior surface 145 of the face portion 142 includes a continuous bead 149 about a center of the face portion 142. In other words, the continuous bead 149 defines part of the interior surface 145 of the face portion 142. The continuous bead 149 can be a weld bead formed when a strike place 143 is welded to an opening in the face portion 142. Alternatively, the continuous bead 149 can be a cast bead co-casted with the face portion 142 and the body 110 following a wax-welding casting technique, such as one described in more detail in U.S. patent application Ser. No. 16/161,337, filed Oct. 16, 2018, which is hereby incorporated by reference in its entirety. In yet another example, the continuous bead 149 is formed by chemically etching the interior surface 145 with a chemical, such as hydrochloric acid. In either example, the thickness of the face portion 142 at the continuous bead 149 is greater than at the parts of the face portion immediately adjacent the continuous bead 149. As shown, the stiffener 150, in certain examples, extends from the interior surface of the body 110 (e.g., the interior surface of the crown portion 114 or the sole portion 117) to at least the continuous bead 149 such that the stiffener 150 contacts at least a peripheral edge of the continuous bead 149. In some examples, the stiffener 150 extends beyond or past the continuous bead 149 such that the stiffener 150 contacts the entirety of the continuous bead 149 at the location of the stiffener 150.

Figure 7:
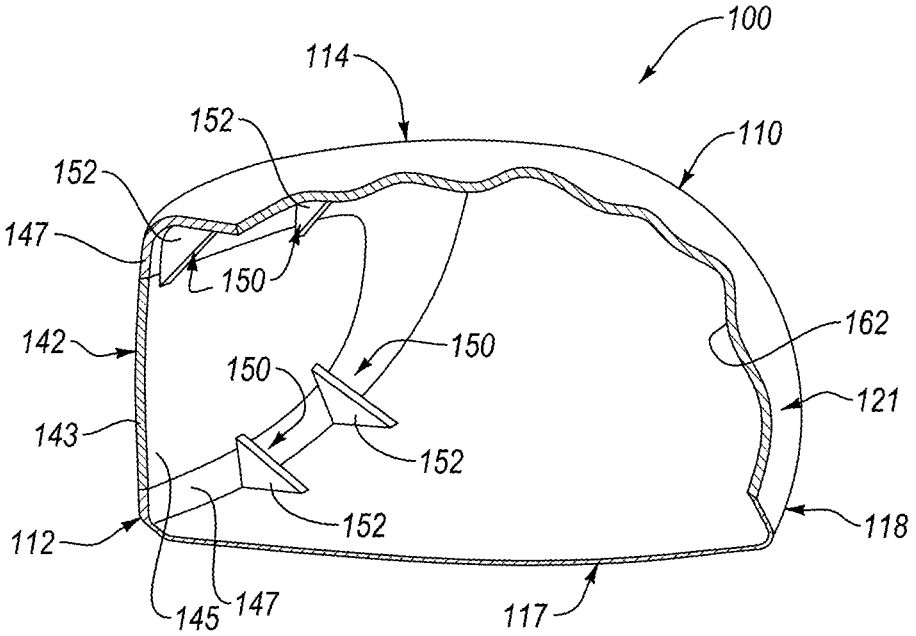
FIG. 7 is a cross-sectional perspective view of a golf club head, taken along a line similar to line 1-1 of FIG. 2, from a side of the golf club head, and shown with a crown insert of the golf club head removed, according to one or more examples of the present disclosure.
Figure 8:
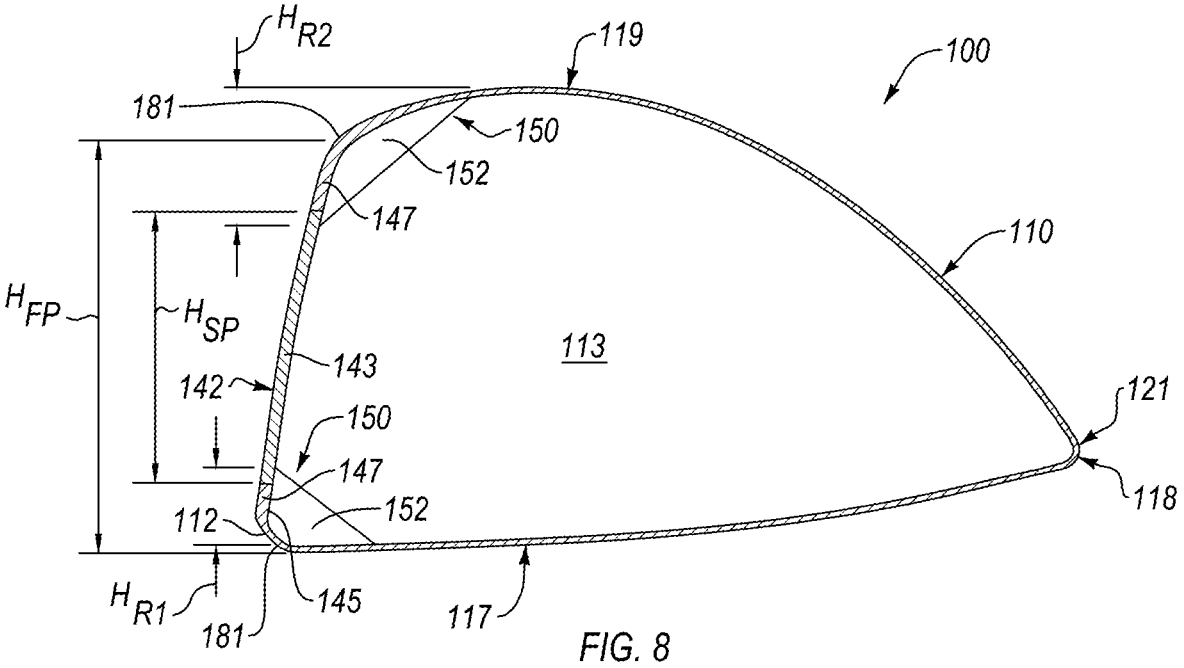
FIG. 8 is a cross-sectional side elevation view of a golf club head, taken along a line similar to line 1-1 of FIG. 2, according to one or more examples of the present disclosure.

Referring to FIGS. 7-9, in one embodiment, the stiffener 150 is a rib 152 that is non-adjustably directly coupled to the face portion 142. When the rib 152 is directly coupled to the face portion 142 at the bottom region 135 of the golf club head 100, the rib 152 can be considered a lower rib. In contrast, when the rib 152 is directly coupled to the face portion 142 at the top region 133 of the golf club head 100, the rib 152 can be considered an upper rib. The rib 152 is directly coupled to the interior surface of the lip 147, and in certain implementations, also directly coupled to the interior surface of the strike plate 143. In addition to the face portion 142, the rib 152, at the bottom region 135, can be non-adjustably directly coupled to the interior surface of the sole portion 117 and/or the skirt portion 121 and the rib 152, at the top region 133, can be non-adjustable directly coupled to the interior surface of the crown portion 119 and/or the skirt portion 121. The rib 152 is co-formed with the body 110 to form a one-piece, continuous, monolithic construction with the body 110. For example, in one implementation, the rib 152 is co-formed together with the crown portion 119, skirt portion 121, and the sole portion 117 of the body 110 in the same casting process. Accordingly, the rib 152 is made of the same material as the body 110. However, in other examples, the rib 152 is formed separately from the body 110 and welded onto the body 110.

The rib 152 is a thin-walled sheet-like structure, with a thickness significantly smaller than a height and length, that protrudes substantially transversely away from the face portion 142 and the sole portion 117 of the body 110. In one implementation, the rib 152 is substantially wedge-shaped with a height that only decreases in a direction from the forward region 112 to the rearward region 118. Accordingly, in such an implementation, the rib 152 does not have an inflection point. Moreover, referring to FIG. 8, in a vertical direction when the golf club head 100 is in proper address position, the rib 152, at the bottom region 135, has a height $H_{R1}$, the rib 152, at the top region 133, has a height $H_{R2}$, and the face portion 142 has a height $H_{FP}$. The height $H_{FP}$ of the face portion 142 is equal to the vertical distance between the ground plane and the top of the face portion 142. In one implementation, a ratio of the height $H_{R1}$ of the rib 152 at the bottom region 135 to the height $H_{FP}$ of the face portion 142 is greater than or equal to 0.15, greater than or equal to 0.17, or greater than or equal to 0.23. In one implementation, a ratio of the sum, of the height $H_{R1}$ of the rib 152 at the bottom region 135 and the height $H_{R2}$ of the rib 152 at the top region 133, to the height $H_{FP}$ of the face portion 142 is greater than or equal to 0.15, greater than or equal to 0.20, or greater than or equal to 0.25. The strike plate 143 has a height $H_{SP}$ that is less than the height $H_{FP}$ of the face portion 142. As defined herein, the height of a rib is defined as the maximum distance between a bottom of the rib and a top of the rib and thus is not a measurement of the position of the rib on the face portion. However, the heights of the ribs can be set such that the ribs contact the face portion at locations away from the outer peripheral edge of the face portion equal to, or similar to, the ranges of locations $L_{DM}$ associated with the discrete masses 176, as described in more detail below. Moreover, the rib height and face portion ratios disclosed above are equally applicable to discrete mass height and face portion ratios of the discrete masses 176.

The golf club head 100 can have any number of ribs 152. For example, in one implementation, the golf club head 100 has four ribs 152 at the bottom region 135, with two toeward ribs 152 and two heelward ribs 152, and four ribs 154 at the top region 133, with two toeward ribs 154 and two heelward ribs 154. The ribs 152 are spaced apart from each other, in a direction parallel to the x-axis of the golf club head origin coordinate system 185.

Figure 10:
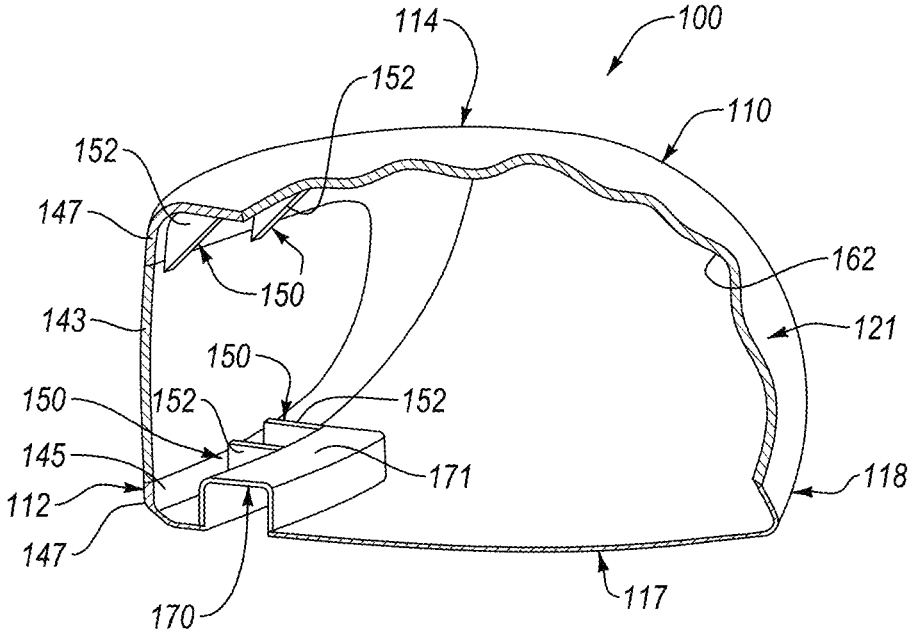
FIG. 10 is a cross-sectional perspective view of a golf club head, taken along a line similar to line 1-1 of FIG. 2, from a side of the golf club head, and shown with a crown insert of the golf club head removed, according to one or more examples of the present disclosure.

As shown in FIGS. 10 and 11, the golf club head 100 may include the slot 170, which can be a COR feature and/or a weight track. The ribs 152 may be further directly coupled to an interior surface of the slot 170 and interposed between the slot 170 and the face portion 142. The ribs 152 provide a stiffening bridge to structurally link the face portion 142, particularly the lip 147, to the slot 170.

According to one example, the CT at the center of the face portion 142 and at a location on the face portion 142 with an x-axis coordinate of 20 mm was determined for a golf club head 100 with a slot 170, but without a stiffener 150 (e.g., rib 152) at the location with the x-axis coordinate of 20 mm, and a golf club head 100 without a slot 170, but with the stiffener 150 at the location with the x-axis coordinate of 20 mm was determined at the location with the x-axis coordinate of 20 mm. The CT at the center of the face portion 142 of the golf club head 100 without the stiffener 150 was 246 microseconds and the CT at the center of the face portion 142 of the golf club head 100 with the stiffener 150 was 243 microseconds. The CT of the face portion 142 at the location with the x-axis coordinate of 20 mm of the golf club head 100 without the stiffener 150 was 256 microseconds and the CT of the face portion 142 at the location with the x-axis coordinate of 20 mm of the golf club head 100 with the stiffener 150 was 246 microseconds. The drop in CT at the location with the x-axis coordinate of 20 mm had a larger drop (i.e., 12 microseconds) than at the center of the face portion 142 (i.e., 3 microseconds). Accordingly, the stiffener 150 helps to lower the CT of the face portion at locations away from the center of the face portion without a comparative drop in the CT at the center of the face portion. Also, it was determined that the difference between the COR and the CT of the golf club head 100 with the stiffener 150 was less than that of the golf club head 100 without the stiffener 150, which means the COR more closely tracks the CT in the golf club head 100 with the stiffener 150 than the golf club head 100 without the stiffener 150.

Figure 12:
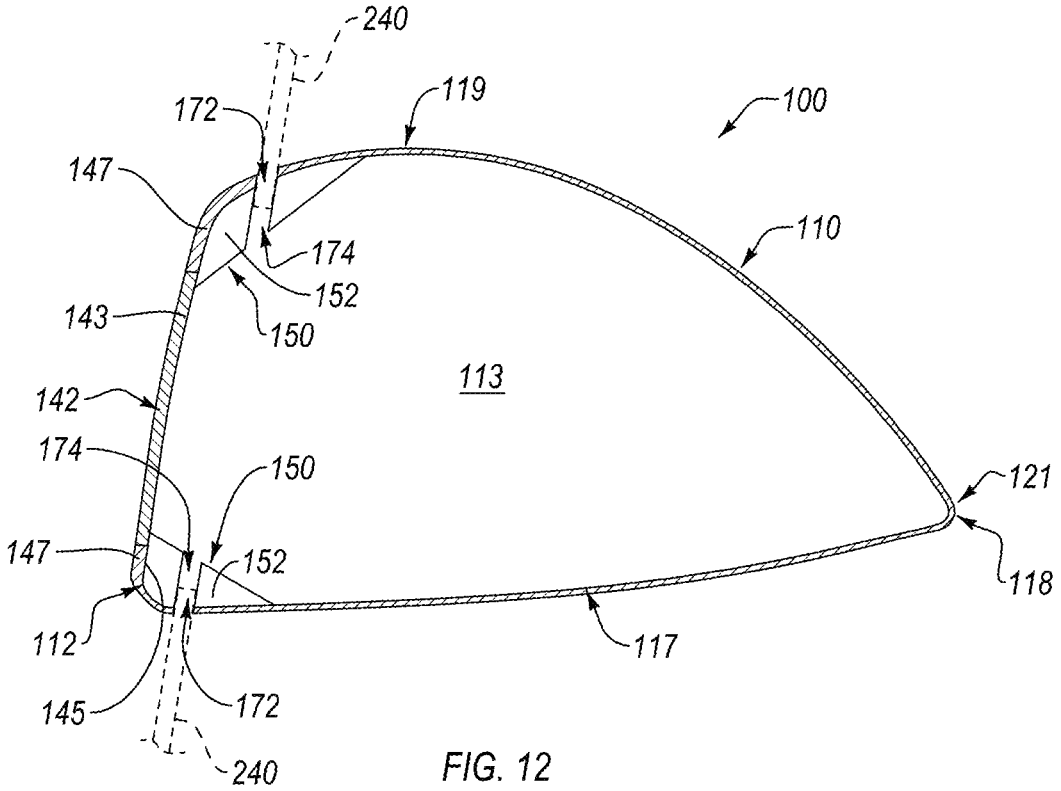
FIG. 12 is a cross-sectional side elevation view of a golf club head, taken along a line similar to line 1-1 of FIG. 2, according to one or more examples of the present disclosure.

Referring to FIG. 12, the golf club head 100 can further include an aperture 172 (e.g., hole or port) formed in an exterior wall of the body 110 proximate a respective one or more ribs 152 or ribs 154. As shown, in one example, each aperture 172 is open to a respective one of the rib 152 or the rib 154. Accordingly, one of the ribs 152 is directly or indirectly accessible from an exterior of the body 110 via one of the apertures 172 and one of the ribs 154 is directly or indirectly accessible from an exterior of the body 110 via another one of the apertures 172. Although not shown, the golf club head 100 may additionally include plugs each configured to plug a respective one of the apertures 172 and thus prevent access to the ribs from an exterior of the golf club head 100. The plugs can be removable from and reinsertable into the apertures 172 to selectively allow and prevent access to the ribs. As will be described in more detail, the apertures 172 may be used to remove portions of the ribs post-manufacturing of the golf club head 100 for adjusting (e.g., tuning) the CT of the golf club head 100 post-manufacturing.

Figure 13:
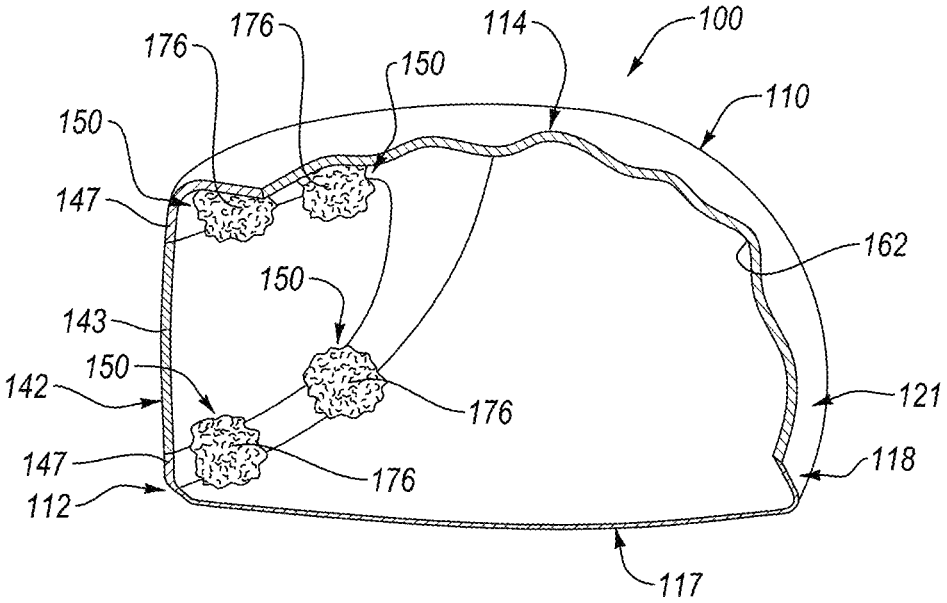
FIG. 13 is a cross-sectional perspective view of a golf club head, taken along a line similar to line 1-1 of FIG. 2, from a side of the golf club head, and shown with a crown insert of the golf club head removed, according to one or more examples of the present disclosure.
Figure 14:
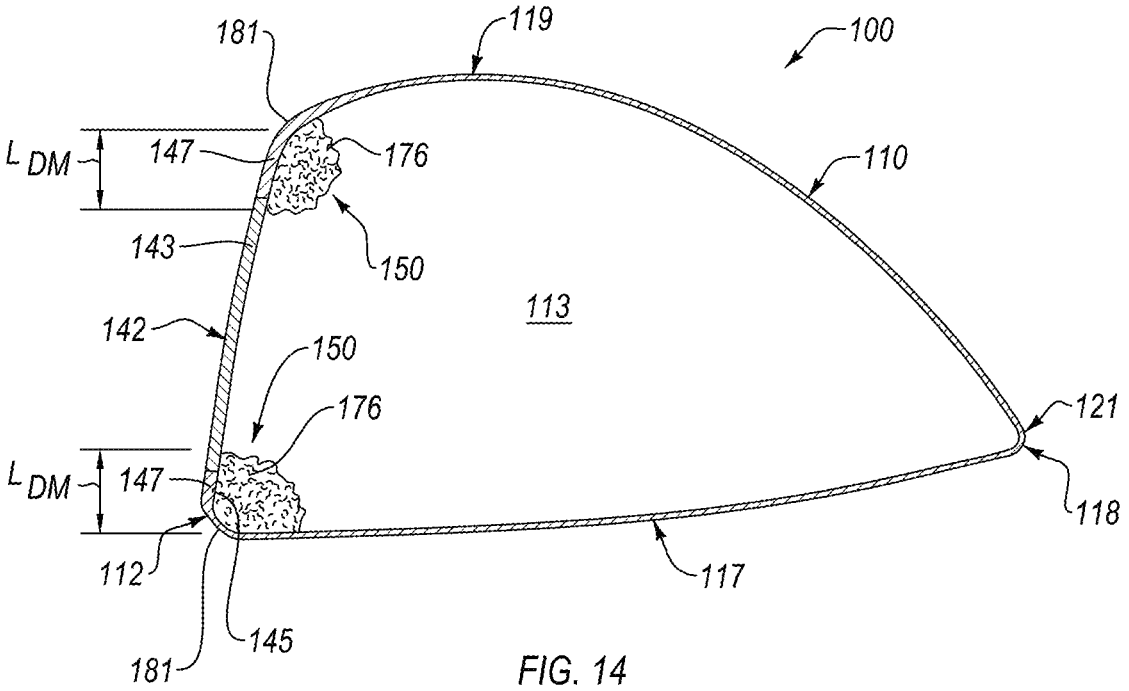
FIG. 14 is a cross-sectional side elevation view of a golf club head, taken along a line similar to line 1-1 of FIG. 2, according to one or more examples of the present disclosure.
Figure 15:
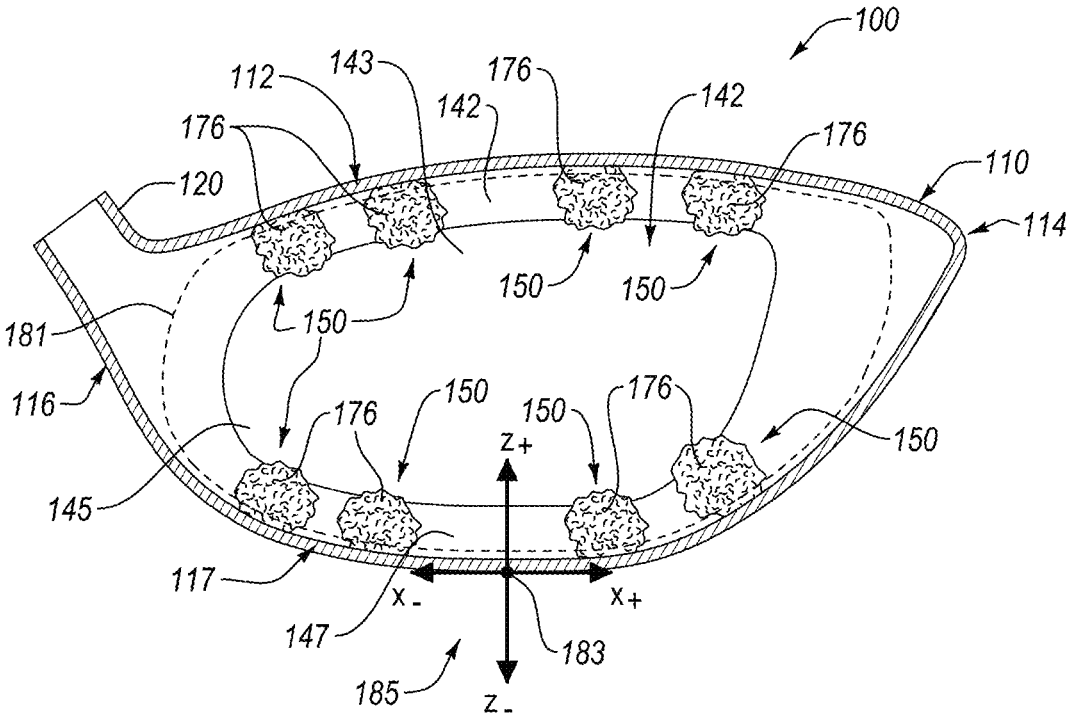
FIG. 15 is a cross-sectional rear view of a golf club head, taken along a line similar to line 2-2 of FIG. 1, according to one or more examples of the present disclosure.

Referring to FIGS. 13-15, in one embodiment, the stiffener 150 is a discrete mass 176 that is non-adjustably directly coupled to the face portion 142. The discrete mass 176 is directly coupled to the face portion 142 at the bottom region 135 of the golf club head 100. Such a discrete mass 176 can be considered a lower discrete mass. In contrast, the discrete mass 176 is directly coupled to the face portion 142 at the top region 133 of the golf club head 100. Accordingly, this discrete mass 176 can be considered an upper discrete mass. The discrete mass 176 is directly coupled to the interior surface of the lip 147, and in certain implementations, also directly coupled to the interior surface of the strike plate 143. In addition to the face portion 142, the discrete mass 176, at the bottom region 135, can be non-adjustably directly coupled to the interior surface of the sole portion 117 and/or the skirt portion 121 and the discrete mass 176, at the top region 133, can be non-adjustable directly coupled to the interior surface of the crown portion 119 and/or the skirt portion 121.

The discrete mass 176 is made of a polymeric material. According to one example, the polymeric material of the discrete mass 176 is any of various polymeric materials having a hardness equal to or greater than about Shore 20D. In another example, the polymeric material of the discrete mass 176 is any of various polymeric materials having a hardness equal to or greater than about Shore 45D. In yet another example, the polymeric material of the discrete mass 176 is any of various polymeric materials having a hardness equal to or greater than about Shore 85D. The polymeric material is acrylic in one implementation. In some examples, the discrete mass 176 has a hardness between Shore 40D and Shore 80D or between Shore 75D and Shore 85D. In yet some examples, the discrete mass 176 has a hardness of at least Shore 50D, at least Shore 60D, or at least Shore 70D. In yet some examples, the discrete mass 176 is any of various polymeric materials having a hardness equal to or greater than about Shore 5.95D.

In other implementations, some examples of the polymeric material include, without limitation, viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchdamp™ from 3M, Sorbothane® from Sorbothane, Inc., DYAD® and GP® from Soundcoat Company Inc., Dynamat® from Dynamat Control of North America, Inc., NoViFlex™ Sylomer® from Pole Star Maritime Group, LLC, Isoplast® from The Dow Chemical Company, and Legetolex™ from Piqua Technologies, Inc. In one embodiment the polymeric material may be a material having a modulus of elasticity ranging from about 0.001 GPa to about 25 GPa, and a durometer ranging from about 10 to about 30 on a Shore D scale. In a preferred embodiment, the polymeric material may be a material having a modulus of elasticity ranging from about 0.001 GPa to about 10 GPa, and a durometer ranging from about 15 to about 25 on a Shore D scale. In another embodiment, the polymeric material is a material having a modulus of elasticity ranging from about 0.001 GPa to about 5 GPa, and a durometer ranging from about 18 to about 22 on a Shore D scale. In some examples, a material providing vibration damping is preferred.

The polymeric material is a thermoset material, such as epoxies, resins, and the like, in some implementations. A thermoset material is any of various polymer materials that undergo a chemical transformation, which hardens and strengthens the material, when heated above a cure temperature of the material. The chemical transformation of thermoset materials is non-reversible. The polymeric material is a thermoplastic material, such as polyester, polyethylene, and the like, in other implementations. In contrast to thermoset materials, a thermoplastic material is any of various polymer materials that undergo a physical transformation when heated, which softens the material, and cooled, which hardens the material. The physical transformation of thermoplastic materials is reversible.

The golf club head 100 can have any number of discrete masses 176 at the bottom region 135 and/or any number of discrete masses 176 at the top region 133. For example, in one implementation, the golf club head 100 has four discrete masses 176 at the bottom region 135, with two toeward discrete masses 176 and two heelward discrete masses 176, and four discrete masses 176 at the top region 133, with two toeward discrete masses 176 and two heelward discrete masses 176. The discrete masses 176 are considered discrete because they are spaced apart from each other in a direction parallel to the x-axis of the golf club head origin coordinate system 185. The discrete mass 176 can have any of various shapes and sizes. Although shown as substantially ball-shaped in FIGS. 13-15, the discrete mass 176 can be flatter or more polygonal.

Referring to FIG. 14, the discrete mass 176 of polymeric material is directly coupled to the face portion at a location $L_{DM}$ away from an outer peripheral edge 181 of the face portion 142. The discrete mass 176 is not directly coupled to the face portion at just the location $L_{DM}$. Rather, the discrete mass 176 can be directly coupled to the face portion 142 all the way, or only part of the way, from the outer peripheral edge 181 of the face portion 142 up to or down to the location $L_{DM}$. In some implementations, the location $L_{DM}$ is at least 5 mm, 10 mm, 15 mm, 20 mm, or 30 mm depending on the lateral location of the discrete mass on the face portion and the desired decrease to the CT of the face portion 142. For example, the greater the location $L_{DM}$ away from the outer peripheral edge 181 of the face portion 142, the greater the impact on the CT of the face portion 142. The outer peripheral edge 181 is defined as the outermost boundary of the face portion 142 radially away from the geometric center of the face portion 142 or otherwise defined as the imaginary line where the face portion 142 transitions into the crown portion 119, the sole portion 117, and the skirt portion 121. Accordingly, the outer peripheral edge 181 is not the same as the outer peripheral edge of the strike plate 143. Rather, as shown in FIG. 6, for example, the outer peripheral edge 181 of the face portion 142 is radially away from and encompasses the edge of the strike plate 143.

The discrete mass 176 of polymeric material is directly coupled to the face portion 142 such that the discrete mass 176 contacts a particular amount of surface area of the face portion (e.g., the interior surface 145 of the face portion 142). Generally, the more surface area contacted by the discrete mass 176, the greater the impact on the CT of the face portion 142. In one implementation, the discrete mass 176 contacts a surface area of the face portion of at least 50 $mm^2$, 150 $mm^2$, or 225 $mm^2$. In embodiments having a plurality of discrete masses 176, the surface area of the face portion 142 contacted by one of the discrete masses 176 can be different than another one of the discrete masses 176. Additionally, in certain implementations having a plurality of discrete masses 176, the combined surface area of the face portion 142 contacted by the discrete masses 176 can be at least 100 $mm^2$ or 800 $mm^2$, or 1,600 $mm^2$, for example. According to certain implementations, a ratio of the surface area of the face portion 142 contacted by one or more of the discrete masses 176 and a total internal surface area (e.g., total surface area of the interior surface 145) of the face portion 142 is at least 0.01, 0.05, or 0.1, for example. In some implementations, the total surface area of the face portion 142 is between 2,500 $mm^2$ and 6,000 $mm^2$. The strike plate 143 can have a total surface area of between 2,600 $mm^2$ and 3,300 $mm^2$ in some implementations.

In embodiments having a plurality of discrete masses 176, the material of one discrete mass 176 can be different than another one of the discrete masses 176. For example, one discrete mass 176 can have a modulus of elasticity or a hardness different than another one of the discrete masses 176, with such differences being dependent on the corresponding locations of the discrete masses 176 relative to the face portion 142. In one implementation, a discrete mass 176 offset toewardly from the center of the face portion 142 may have a higher modulus of elasticity or a higher hardness than a discrete mass 176 heelward from the center of the face portion 142.

Figure 17:
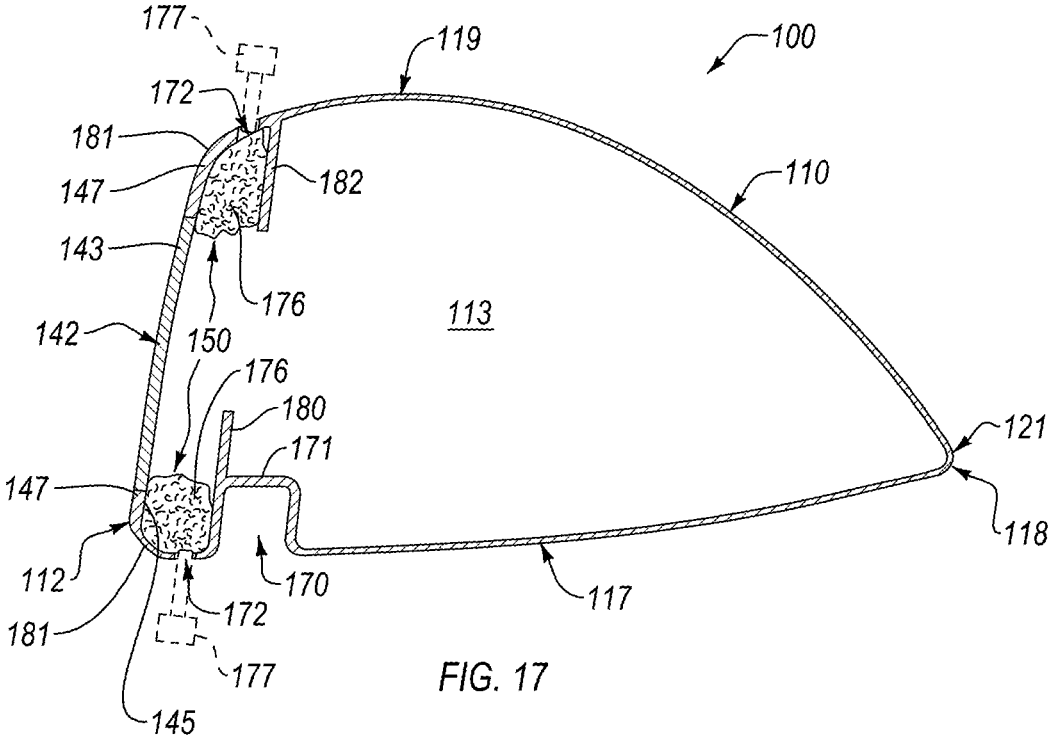
FIG. 17 is a cross-sectional side elevation view of a golf club head, taken along a line similar to line 1-1 of FIG. 2, according to one or more examples of the present disclosure.
Figure 18:
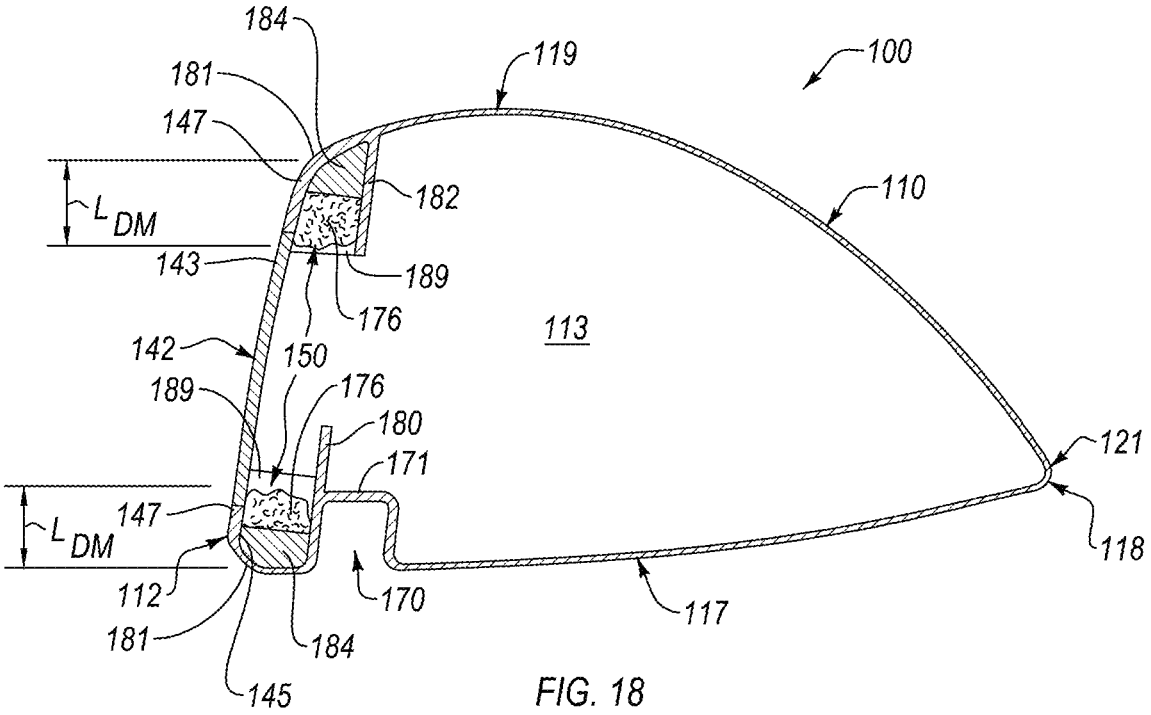
FIG. 18 is a cross-sectional side elevation view of a golf club head, taken along a line similar to line 1-1 of FIG. 2, according to one or more examples of the present disclosure.

Referring to FIG. 18, the discrete mass 176 can be applied onto the interior surface 145 of the face portion 142 using any of various techniques, such as injecting the polymeric material, in a flowable state, using an injection tool (see, e.g., the injection tool 177 of FIG. 17) and allowing the polymeric material to cool or curing the polymeric material. Because the polymeric material is injected in a flowable state, the polymeric material is not under compression. In one implementation of a golf club head 100 with a crown insert 126, the discrete masses 176 are applied onto the interior surface 145 of the face portion 142 after the frame 124 is formed, but before the crown insert 126 is attached to the frame 124. More specifically, after the frame 124 is formed and before the crown insert 126 is attached to the frame 124, access through the crown opening 162 can be utilized to apply the discrete masses 176 onto the interior surface 145 of the face portion 142. Alternatively, the discrete masses 176 can be applied onto the interior surface 145 of the face portion 142 after the body 110 is completely formed (e.g., after the crown insert 126 is attached to the frame 124 of the body 110) by accessing the interior cavity 113 through one or more ports formed in the body 110. For example, referring to FIG. 17, an injection tool 177 can inject polymeric material onto the interior surface 145 of the face portion 142 through an aperture 172, formed in an exterior wall of the body 110 (such as the wall of the face portion 142) and open to the interior cavity 113.

Figure 16:
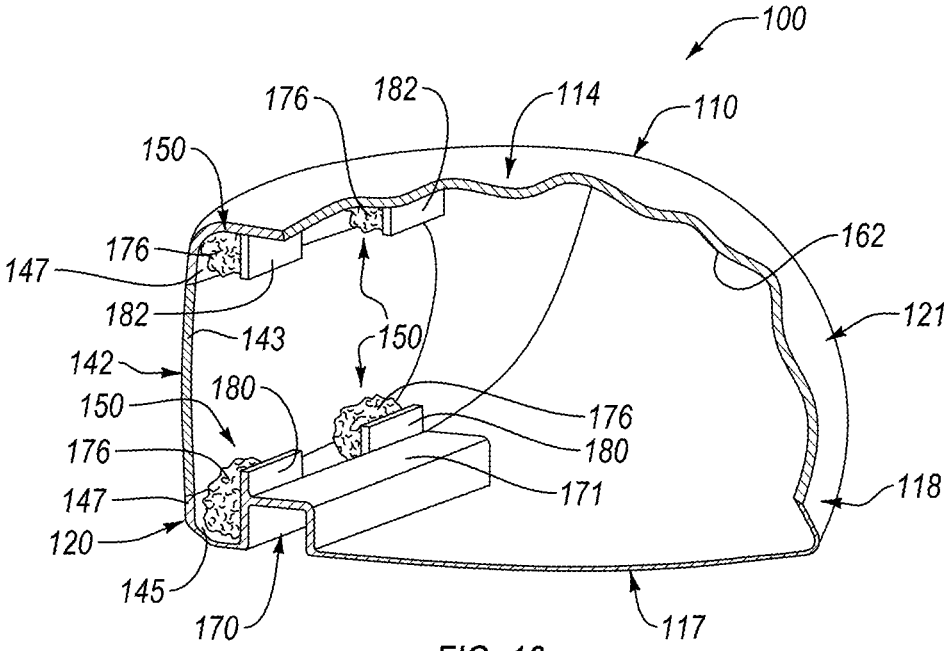
FIG. 16 is a cross-sectional perspective view of a golf club head, taken along a line similar to line 1-1 of FIG. 2, from a side of the golf club head, and shown with a crown insert of the golf club head removed, according to one or more examples of the present disclosure.

Referring now to FIGS. 16 and 17, the discrete mass 176 may be further directly coupled to an interior surface of a slot 170 of the golf club head 100 and interposed between the slot 170 and the face portion 142. The discrete mass 176 provides a stiffening bridge to structurally link the face portion 142, particularly the lip 147, to the slot 170.

As shown, in some embodiments, the golf club head 100 includes at least one retaining wall 180 coupled to the sole portion 117. The retaining wall 180 protrudes uprightly from the sole portion 117. Moreover, the retaining wall 180 can have a thin-walled construction and extend lengthwise in a heel-to-toe direction (e.g., substantially parallel to the face portion 142). In some examples, the bottom region 135 of the golf club head 100 includes a single retaining wall 180, which can extend from the heel region 116 to the toe region 114. However, in other examples, the bottom region 135 of the golf club head 100 includes multiple discrete retaining walls 180, such as shown in FIG. 16, which are spaced apart from each other in the heel-to-toe direction. Each discrete retaining wall 180 is associated with a respective one of the discrete masses 176. The retaining wall 180 is a stand-alone structure in some implementations. But in other implementations, the retaining wall 180 is integrated into other structures. For example, the retaining wall 180 can form part of the slot 170. In certain implementations, such as shown in FIGS. 16 and 17, the retaining wall 180 protrudes from the slot 170 at a forward wall of the slot 170 such that the retaining wall 180 protrudes further away from the sole portion 117 than the slot 170. Although not shown, the golf club head 100 may also have one or more retaining walls 180 protruding uprightly from the crown portion 119.

Not only does the retaining wall 180 provide a structure to which one or more discrete masses 176 can be structurally linked, but the retaining wall 180 also helps to locate the discrete masses 176, at the bottom region 135, higher on the face portion 142 and/or locate the discrete masses 176, at the top region 133, lower on the face portion 142 by providing backing at those higher or lower locations. Generally, the closer the discrete mass 176, in contact with the face portion 142 at a given x-axis location, is to a center of the strike plate 143, the greater the impact the discrete mass 176 has on lowering the CT of the strike plate 143 at that location. Accordingly, by locating a discrete mass 176 closer to the center of the strike plate 143, the CT of the strike plate 143 can be correspondingly lowered.

Corresponding to that presented above, the further away the discrete mass 176, in contact with the face portion 142 at a given x-axis location, is to a center of the strike plate 143, the less the impact the discrete mass 176 has on lowering the CT of the strike plate 143 at that location. Accordingly, in some implementations, such as shown in FIG. 18, the stiffener 150 includes both a discrete mass 176 and foam 184. In the case of the stiffener 150 being located at the bottom region 135, the foam 184 is positioned between the discrete mass 176 and the sole portion 117. Moreover, in the case of the stiffener 150 being located at the top region 133, the foam 184 is positioned between the discrete mass 176 and the crown portion 119. As shown, if the golf club head 100 includes a slot 170 or a retaining wall 180, the foam 184 is interposed between the slot 170 or the retaining wall 180 and the face portion 142.

The foam 184 provides a platform (e.g., acts as a spacer) to position the discrete mass 176, at the bottom region 135, higher up on the face portion 142 or the discrete mass 176, at the top region 133, lower down on the face portion 142. The foam 184 is lighter than the polymeric material of the discrete mass 176. Therefore, effectively replacing a portion of the discrete mass 176 of FIG. 17 with the foam 184 reduces the overall weight of the stiffener 150 without compromising the CT reduction performance of the stiffener 150. In some implementations, the foam 184 of each stiffener 150 is a discrete piece of foam, such that the foam 184 of one stiffener 150 is separate from the foam 184 of another stiffener 150. The foam 184 can be any of various types of foam, such as polyurethane, polyethylene, and the like, with a lightweight cellular form resulting from the introduction of gas bubbles during manufacture.

The foam 184 of each stiffener 150 can be applied onto the interior surface 145 of the body 110, such as at the sole portion 117, the crown portion 119, and/or the face portion 142 using any of various techniques, such as adhesion. In other words, the foam 184 can be adhered to the interior surface 145 of the body 110. Then, the discrete mass 176 can be applied onto the foam 184 using the same or similar techniques as those described above in relation to FIGS. 16 and 17. In one implementation of a golf club head 100 with a crown insert 126, the foam 184 is coupled to the interior surface 145 of the body 110 after the frame 124 is formed and the strike plate 143 is coupled to the lip 147 (whether attached to or co-formed with the lip 147), but before the crown insert 126 is attached to the frame 124. More specifically, after the frame 124 is formed and the strike plate 143 in place on the body 110, and before the crown insert 126 is attached to the frame 124, access through the crown opening 162 can be utilized to secure the foam 184 onto the interior surface 145 of the body. Accordingly, if the strike plate 143 is welded to the lip 147, the heat from the welding process will not melt the foam 184 because the foam 184 is not secured to the body 110 until after the strike plate 143 is welded to the lip 147 and the weld has cooled. Additionally, due to the cellular, light-weight, nature of the foam 184, it does not significantly impact the acoustics of the golf club head 100.

Figure 19:
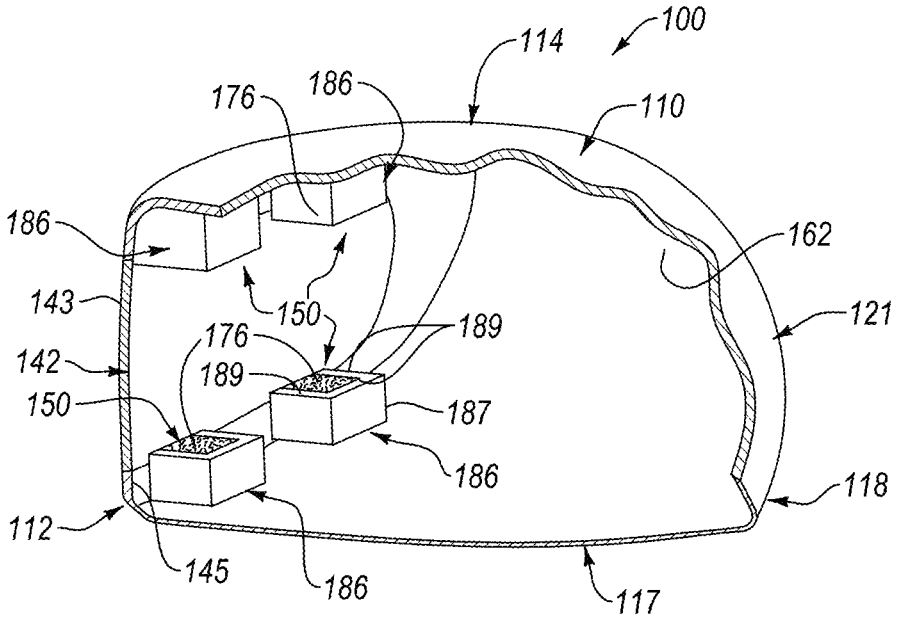
FIG. 19 is a cross-sectional perspective view of a golf club head, taken along a line similar to line 1-1 of FIG. 2, from a side of the golf club head, and shown with a crown insert of the golf club head removed, according to one or more examples of the present disclosure.
Figure 20:
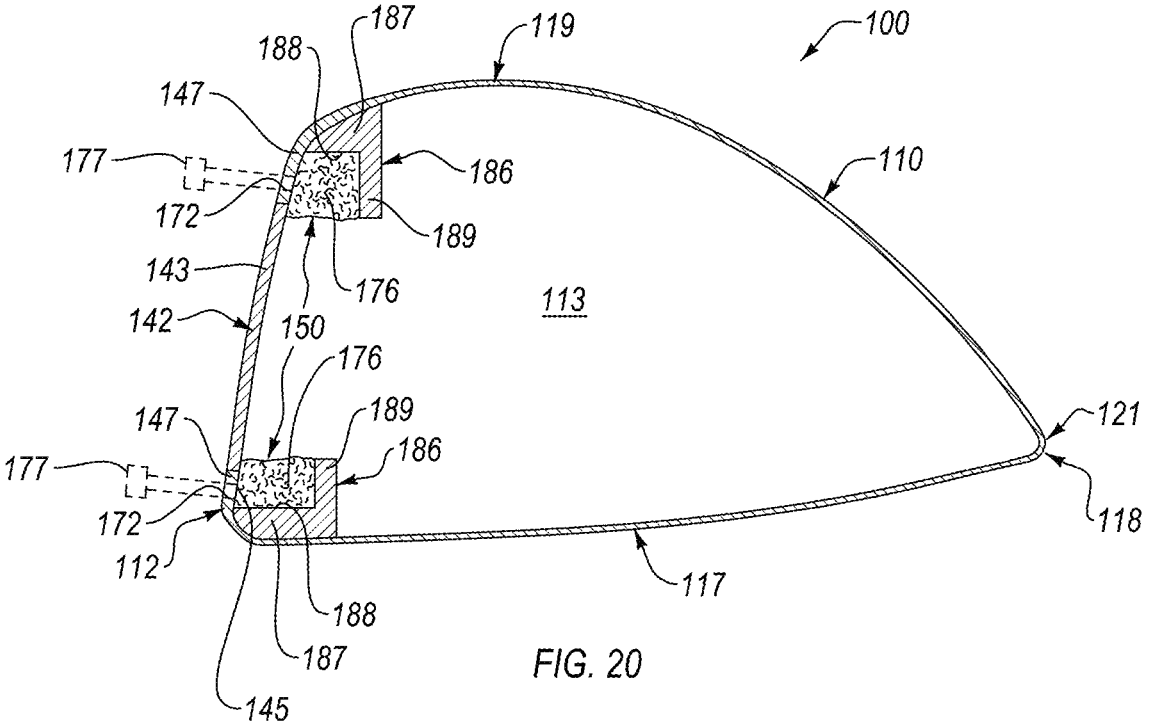
FIG. 20 is a cross-sectional side elevation view of a golf club head, taken along a line similar to line 1-1 of FIG. 2, according to one or more examples of the present disclosure.
Figure 21:
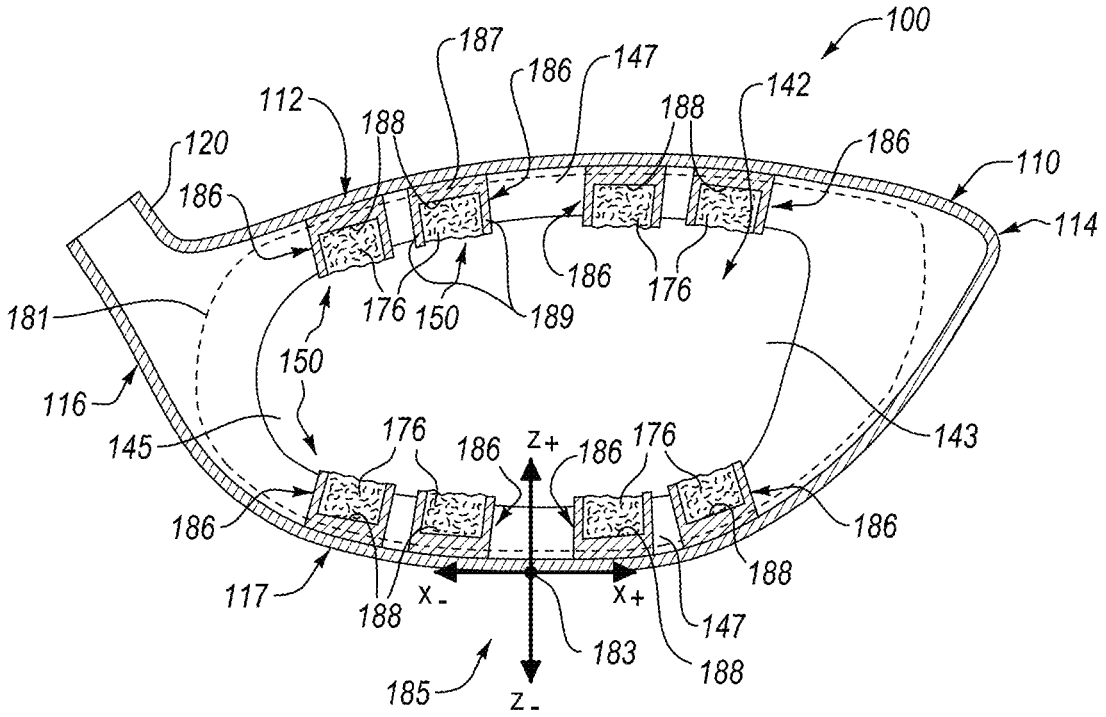
FIG. 21 is a cross-sectional rear view of a golf club head, taken along a line similar to line 2-2 of FIG. 1, according to one or more examples of the present disclosure.

Referring to FIGS. 19-21, the foam 184 of the stiffener 150 can be formed into an enclosure 186 made of foam. As shown, the enclosure 186 can be configured (e.g., shaped) to be in seated engagement or complementary engagement with the interior surface of the body 110. The foam of the enclosure 186 can be the same type of foam as described above in association with the foam 184. The enclosure 186 defines a cavity 188 with a side open to the face portion 142. More specifically, in one example, the enclosure includes a base 187 secured directly to the interior surface of the body 110 at the sole portion, 117, the crown portion 119, or the skirt portion 121. One or more walls 189 protrude from the base 187 and together with the base 187 define the cavity 188. The base 187 and walls 189 of the enclosure 186 abut the interior surface of the face portion 142 such that the interior surface of the face portion 142 effectively closes the open side of the cavity 188, while the open end of the cavity 188 remains open. Accordingly, the cavity 188 has a closed end defined by the base 187, an open end, opposite the closed end, at least one closed side defined by the walls 189 of the enclosure 186, and one open side that is open to the face portion 142. In the illustrated implementation, the base 187 is four-sided and the enclosure 186 includes three walls 189 that protrude orthogonally from the base 187. Therefore, in the illustrated implementation, the cavity 188 is substantially square shaped. However, in other implementations, the enclosure 186 and the cavity 188 can have any of various shapes as long as the cavity 188 has a side open to the face portion 142.

The discrete mass 176 of the stiffener 150 is located within and retained by the cavity 188 of the enclosure 186. Like the foam 184, the base 187 of the enclosure 186 provides a platform to position the discrete mass 176 at the bottom region 135, higher up on the face portion 142 or the discrete mass 176, at the top region 133, lower down on the face portion 142. The walls 189 of the enclosure 186 help to retain and localize the discrete mass 176 at a location on the face portion 142 where adjustability of the CT is desired. Although not identified as such, the foam 184 in FIG. 18 can be part of an enclosure, similar to the enclosure 186. For example, a side wall 189 of the enclosure can be used to laterally retain the discrete mass 176 while the retaining wall 180 and/or the slot 170 rearwardly retains the discrete mass 176. Accordingly, in some implementations, the foam 184 is in direct contact with the retaining wall 180 and/or the slot 170 to form a seal for preventing the discrete mass 176 from leaking between the foam 184 and/or the slot 170.

As shown in FIG. 19, in some implementations, the golf club head 100 includes multiple enclosures 186, and multiple corresponding discrete masses 176, spaced apart from each other in a direction parallel to the x-axis of the golf club head origin coordinate system 185. Multiple enclosures 186 can be located at the bottom region 135 and/or the top region 133 of the golf club head 100.

In one implementation of a golf club head 100 with a crown insert 126, the enclosure 186 is coupled to the interior surface 145 of the body 110 after the frame 124 is formed and the strike plate 143 is coupled to the lip 147 (whether attached to or co-formed with the lip 147), but before the crown insert 126 is attached to the frame 124. More specifically, after the frame 124 is formed and the strike plate 143 in place on the body 110, and before the crown insert 126 is attached to the frame 124, access through the crown opening 162 can be utilized to secure the enclosure 186 onto the interior surface 145 of the body.

The discrete mass 176 can be applied into the cavity 188 of the enclosure 186 using the same or similar techniques as those described above in relation to FIGS. 16 and 17. For example, the discrete mass 176 can be injected into the cavity 188 through the crown opening 162 before a crown insert 126 is attached to the frame 124 of the golf club head 100. Alternatively, for example, the discrete mass 176 can be injected into the cavity 188 via an aperture 172 (see, e.g., the aperture 172 of FIG. 23) formed in the exterior wall of the body 110. In some implementations, the aperture 172 is aligned with an aperture 173 formed in the base 187, which is open to the cavity 188 of the enclosure 186. In other words, the aperture 173 of the base 187 effectively forms a continuation of the aperture 172. In this manner, an injection tool 177 can inject polymeric material into the cavity 188 of the enclosure 186 through the aperture 172 in the exterior wall of the body 110 and the aperture 173 of the base 187 of the enclosure 186 (see, e.g., FIG. 23). After the polymeric material is injected, and cured, the aperture 172 can be plugged with polymeric material, or another material, such as aluminum or titanium.

Figure 22:
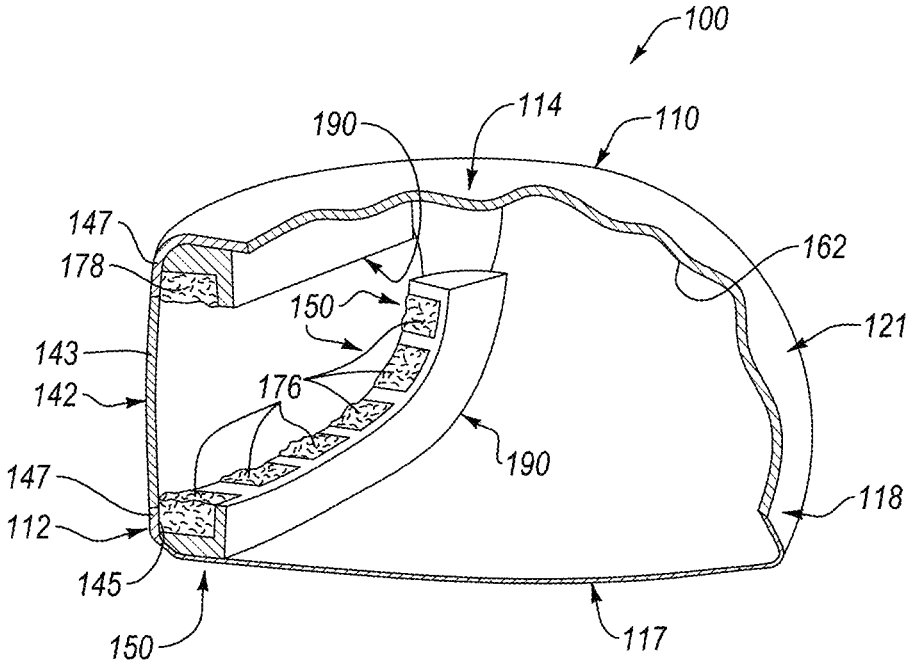
FIG. 22 is a cross-sectional perspective view of a golf club head, taken along a line similar to line 1-1 of FIG. 2, from a side of the golf club head, and shown with a crown insert of the golf club head removed, according to one or more examples of the present disclosure.
Figure 23:
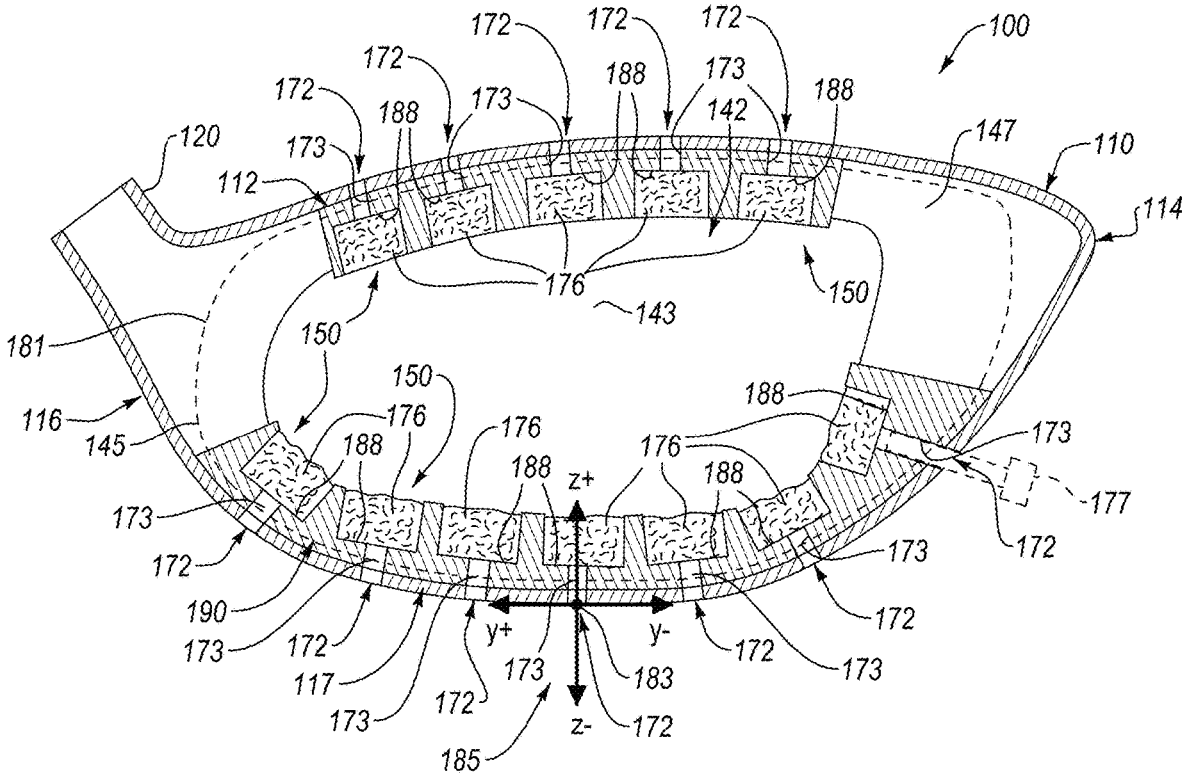
FIG. 23 is a cross-sectional rear view of a golf club head, taken along a line similar to line 2-2 of FIG. 1, according to one or more examples of the present disclosure.

Referring now to FIGS. 22 and 23, in some embodiments, the foam enclosures of multiple stiffeners 150 are effectively combined to form a one-piece, continuous, monolithic construction. In other words, while the discrete masses 176 and cavities 188 of each of the multiple stiffeners 150 are spaced apart from each other in a direction parallel to the x-axis of the golf club head origin coordinate system 185, the enclosures are combined to form an enclosure ladder 190. The enclosure ladder 190 includes a single piece of foam with multiple spaced-apart cavities 188 formed in the foam. The cavities 188 are formed in the enclosure latter 190 at the desired locations of the discrete masses 176 on the face portion 142. The golf club head 100 can include multiple enclosure ladders, such as one (or more) enclosure ladder 186 located at the bottom region 135 and/or one (or more) enclosure ladder 186 located at the top region 133 of the golf club head 100. Although the enclosure ladders 190 shown in FIG. 23 include five and seven cavities 188, respectively, in other embodiments, each enclosure ladder 190 can include fewer than five, six, or greater than seven cavities 188. Each enclosure ladder 190 can include any number of cavities 188.

The enclosure ladder 190 is coupled to the interior surface 145 of the body 110 after the frame 124 is formed and the strike plate 143 is coupled to the lip 147 (whether attached to or co-formed with the lip 147), but before the crown insert 126 is attached to the frame 124. More specifically, after the frame 124 is formed and the strike plate 143 in place on the body 110, and before the crown insert 126 is attached to the frame 124, access through the crown opening 162 can be utilized to secure the enclosure ladder 190 onto the interior surface 145 of the body.

The discrete mass 176 can be applied into the cavity 188 of the enclosure 186 using the same or similar techniques as those described above in relation to FIGS. 16 and 17. For example, the discrete mass 176 can be injected into the cavity 188 through the crown opening 162 before a crown insert 126 is attached to the frame 124 of the golf club head 100. Alternatively, for example, the discrete mass 176 can be injected into the cavity 188 via an aperture 172 (see, e.g., the aperture 172 of FIG. 23) formed in the exterior wall of the body 110. In some implementations, the aperture 172 is aligned with an aperture 173 form in the base 187, which is open to the cavity 188 of the enclosure 186. In other words, the aperture 173 of the base 187 effectively form a continuation of the aperture 172. In this manner, an injection tool 177 can inject polymeric material into the cavity 188 of the enclosure 186 through the aperture 172 in the exterior wall of the body 110 and the aperture 173 of the base 187 of the enclosure 186 (see, e.g., FIG. 23).

In some examples, as shown in FIGS. 24-27, the stiffener 150 of the golf club head 100 includes a fastener 198. The fastener 198 of each stiffener 150 is at least partially within the interior cavity 113 of the body 110. For example, a part of the fastener 198 at the top region 133 of the golf club head 100 is located outside of the interior cavity 113 and another part of the fastener 198 is located inside the interior cavity 113. Such a fastener 198 is engageable by an adjustment tool at a location outside of the interior cavity 113. In another example, such as the fastener 198 at the bottom region 135 of the golf club head 100, an entirety of the fastener 198 is located inside the interior cavity 113. Such a fastener 198 is engageable by an adjustment tool at a location inside the interior cavity 113. The fastener 198 can be any of various types of fasteners, such as screws, bolts, nails, pins, nuts, washers, pegs, and the like. In one implementation, the fastener 198 is a threaded fastener (i.e., a fastener with threads) with a head portion, engageable by an adjustment tool 200, and a threaded shank extending from the head portion.

The fastener 198 is adjustably coupled to the body 110 and adjustable to contact the interior surface 145 of the face portion 142 at a location LF away from an outer peripheral edge 181 of the face portion 142 where adjustability of the CT is desired. In some implementations, the fastener 198 is adjustable to position the fastener 198 into contact with the interior surface 145 of the face portion 142 and out of contact with the interior surface 145 of the face portion 142. However, in other implementations, the fastener 198 stays in contact with the interior surface 145 of the face portion 142, with the amount of area of the fastener 198 in contact with the interior surface 145 being adjustable. The fastener 198 of each stiffener 150 can be adjustably coupled to the body 110 in any of various ways. In some implementations, the location LF is at least 5 mm, 10 mm, 15 mm, 20 mm, or 30 mm depending on the lateral location of the fastener 198 on the face portion and the desired decrease to the CT of the face portion 142.

Figure 24:
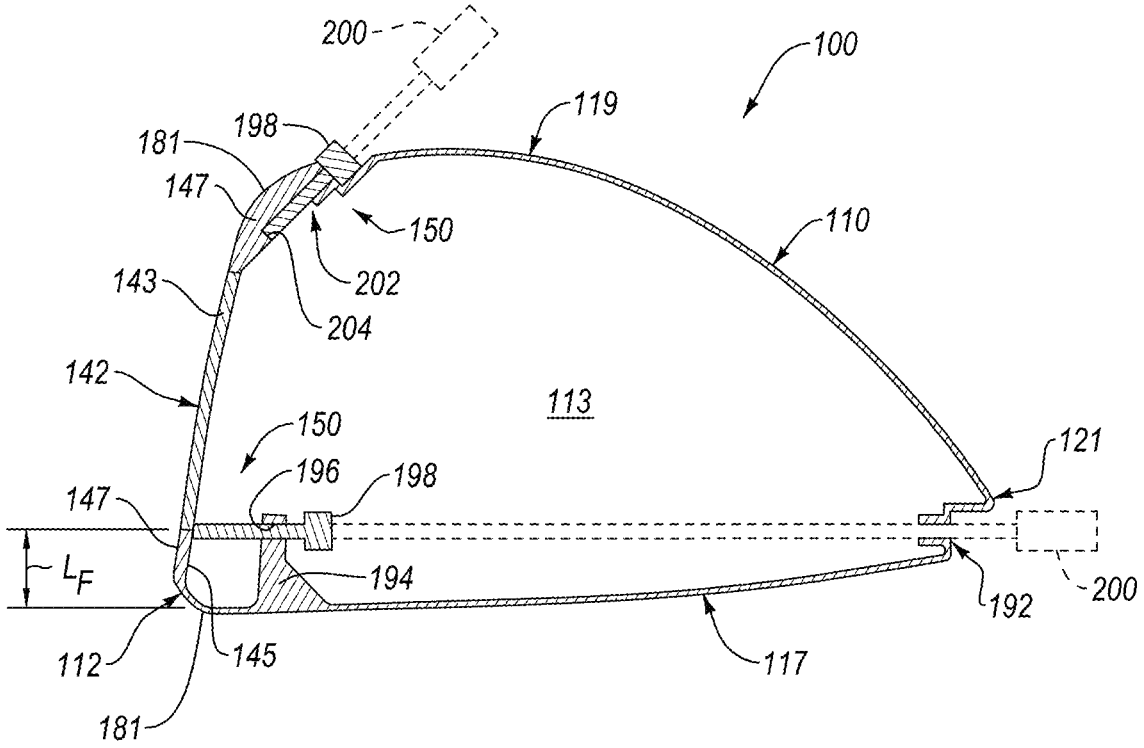
FIG. 24 is a cross-sectional side elevation view of a golf club head, taken along a line similar to line 1-1 of FIG. 2, according to one or more examples of the present disclosure.

In one example shown in FIG. 24, the fastener 198 of the stiffener 150 at the bottom region 135 of the golf club head 100 is adjustably coupled to the body 110 using a fastener rib 194 or tab. The fastener rib 194 is non-movably attached to or co-formed with the body 110 of the golf club head 100 and protrudes from the interior surface of the body 110 into the interior cavity 113 of the body 110. The fastener rib 194 includes an aperture 196 through which the fastener 198 extends. The aperture 196 supports the fastener 198 as the fastener 198 is adjusted relative to the body 110. In one implementation, the fastener 198 is a threaded fastener, the aperture 196 is a threaded aperture, and the fastener 198 threadably engages the aperture 196. According to such an implementation, threaded engagement between the fastener 198 and the aperture 196 causes translational movement of the fastener 198 toward or away from the face portion 142 as the fastener 198 is rotated relative to the fastener rib 194. The fastener 198 can be rotated with an adjustment tool 200, which can be any of various fastener adjustment tools known in the art, such as screwdrivers, ratchets, drills, wrenches, etc. As shown, in some implementations, the fastener 198 is accessible by the adjustment tool 200 through a port 192 formed in the body 110 of the golf club head 100. The port 192 can be a dedicated stiffener adjustment port or a port designed for other uses, such as a weight port for retaining an adjustable weight. The port 192 can be located anywhere on the body 110 as desired, such as at the skirt portion 121 of the rearward region 118 of the golf club head 100. In certain implementations, when the fastener 198 is located entirely within the interior cavity 113, the adjustment tool 200 is configured to extend through the port 192, through the interior cavity 113, and into engagement with the fastener 198.

Figure 25:
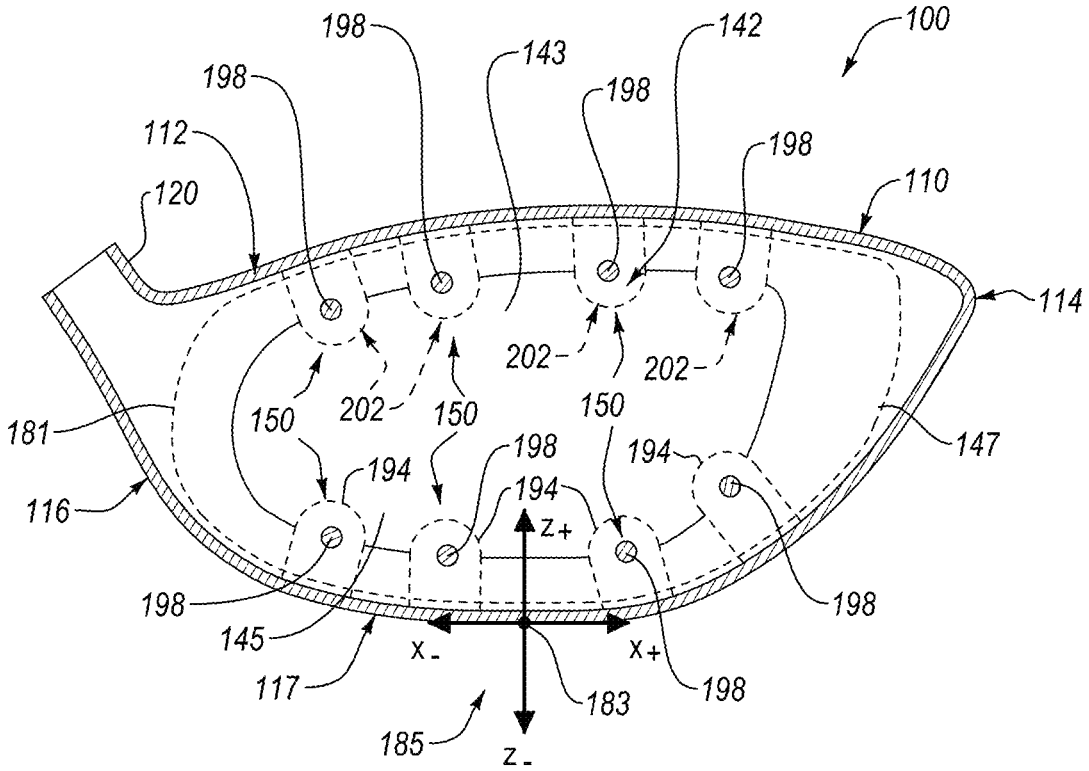
FIG. 25 is a cross-sectional rear view of a golf club head, taken along a line similar to line 2-2 of FIG. 1, according to one or more examples of the present disclosure.

Referring to FIG. 25, the golf club head 100 can have any number of fastener ribs 194. Moreover, although each fastener rib 194 is shown to support one fastener 198, in some implementations, one fastener rib 194 can support more than one fastener 198. Also, although only the stiffeners 150 at the bottom region 135 are shown to include fastener ribs 194, it is recognized that the stiffeners 150 at the top region 133 may also include fastener ribs 194.

According to another example also shown in FIG. 24, the fastener 198 of the stiffener 150 at the top region 133 of the golf club head 100 is adjustably coupled to the body 110 using a fastener port 202 of the body 110. The fastener port 202 is co-formed with the body 110. Moreover, the fastener port 202 is configured to directly engage and support the fastener 198 as the fastener 198 is adjusted relative to the body 110. For example, in some implementations, the fastener 198 is a threaded fastener, the fastener port 202 is threaded, and the fastener 198 threadably engages the fastener port 202. According to such an implementation, threaded engagement between the fastener 198 and the fastener port 202 causes translational movement of the fastener 198 toward or away from the face portion 142 as the fastener 198 is rotated relative to the fastener port 202. The face portion 142 may include a ledge 204 or shoulder configured to receive an end of the fastener 198 as the fastener 198 is rotated toward the face portion 142.

The fastener 198 can be rotated with the adjustment tool 200. As shown, in some implementations, with a part of the fastener 198 outside of the interior cavity 113, the fastener 198 is accessible by the adjustment tool 200 from outside of the interior cavity 113 by engaging the part the fastener 198 outside of the interior cavity 113. The fastener port 202. The fastener port 202 can be located anywhere on the body 110 as desired.

Referring to FIG. 25, the golf club head 100 can have any number of fastener ports 202 and corresponding fasteners 198. Also, although only the stiffeners 150 at the top region 133 are shown to include fastener ports 202, it is recognized that the stiffeners 150 at the bottom region 135 may also include fastener ports 202, such as instead of fastener ribs 194.

Figure 26:
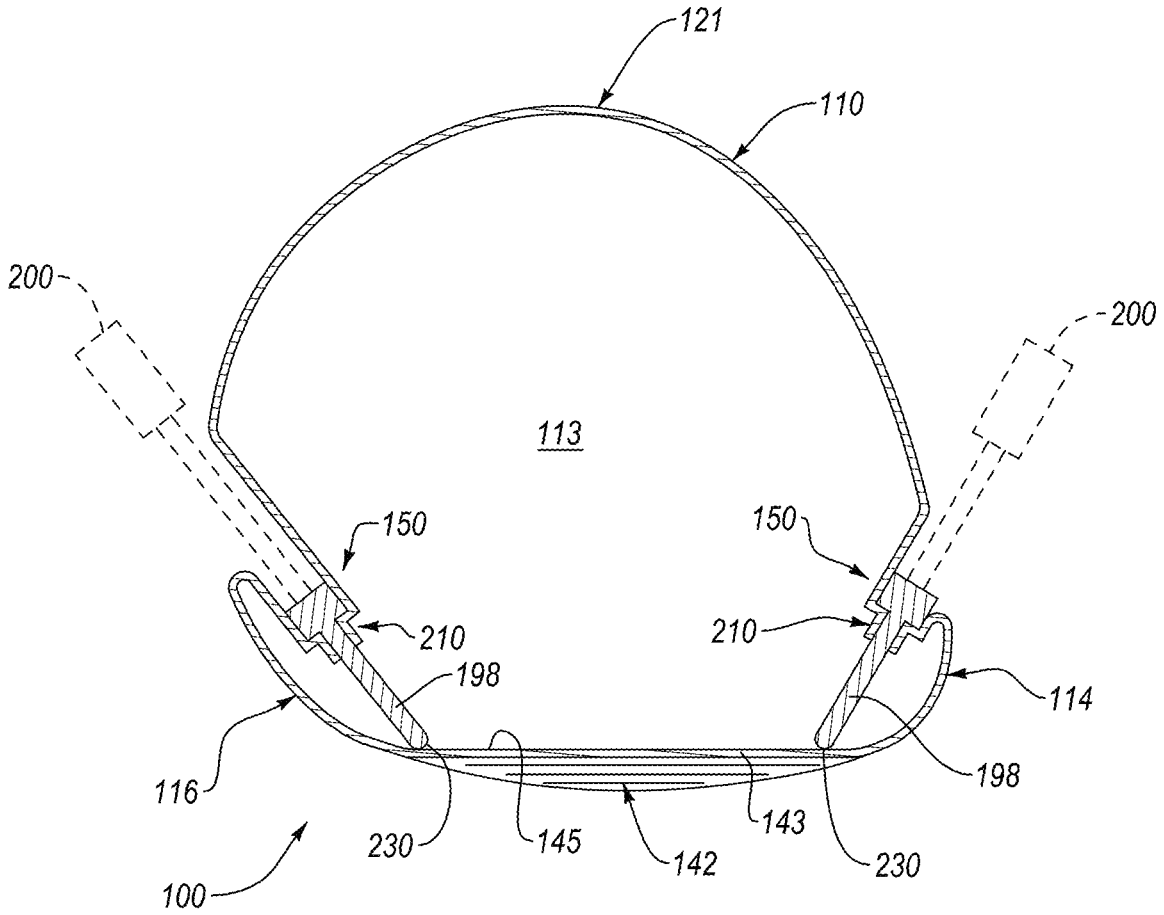
FIG. 26 is a cross-sectional top view of a golf club head, taken along a line similar to line 3-3 of FIG. 5, according to one or more examples of the present disclosure.

Referring to FIG. 26, the golf club head 100 includes side fastener ports 210. Each side fastener port 210 is similar to the fastener port 202. The fastener 198 of each stiffener 150 is adjustably coupled to the body 110 using a respective one of the side fastener ports 210. The fastener port 210 is co-formed with the body 110. As shown, each side fastener port 210 is formed in a side of the golf club head 100, such as in the skirt portion 121 or sole portion 117 at the toe region 114 or the heel region 116 of the forward region 112. The fastener ports 210 are angled relative to the y-axis of the club head origin coordinate system 185. In contrast, the port 192 and/or the fastener port 202 can be substantially parallel with the y-axis of the club head origin coordinate system 185 in some implementations.

The fastener port 210 is configured to directly engage and support the fastener 198 as the fastener 198 is adjusted relative to the body 110. For example, in some implementations, the fastener 198 is a threaded fastener, the fastener port 210 is threaded, and the fastener 198 threadably engages the fastener port 210. According to such an implementation, threaded engagement between the fastener 198 and the fastener port 210 causes translational movement of the fastener 198 toward or away from the face portion 142 as the fastener 198 is rotated relative to the fastener port 210.

The fastener 198 can be rotated with the adjustment tool 200. As shown, in some implementations, with a part of the fastener 198 outside of the interior cavity 113, the fastener 198 is accessible by the adjustment tool 200 from outside of the interior cavity 113 by engaging the part the fastener 198 outside of the interior cavity 113. The fastener port 202. The fastener port 202 can be located anywhere on the body 110 as desired.

Referring to FIG. 26, the fastener 198 has a rounded end surface 230 in some implementations. The fastener 198 of FIG. 26 is adjustable to adjust the amount of area of the rounded end surface 230 of the fastener 198 in contact with the interior surface 145 of the face portion 142. In other words, the fastener 198 is translatable toward the face portion 142 to increase the area of the rounded end surface 230 in contact with the interior surface 145 of the face portion 142 and away from the face portion 142 to decrease the area of the rounded end surface 230 in contact with the interior surface 145 of the face portion 142. Due to Hertzian contact stress variations caused by adjustment in the amount of area of the rounded end surface 230 in contact with the interior surface 145, the stiffness of the face portion 142 can correspondingly vary (e.g., be incrementally adjustable).

Figure 27:
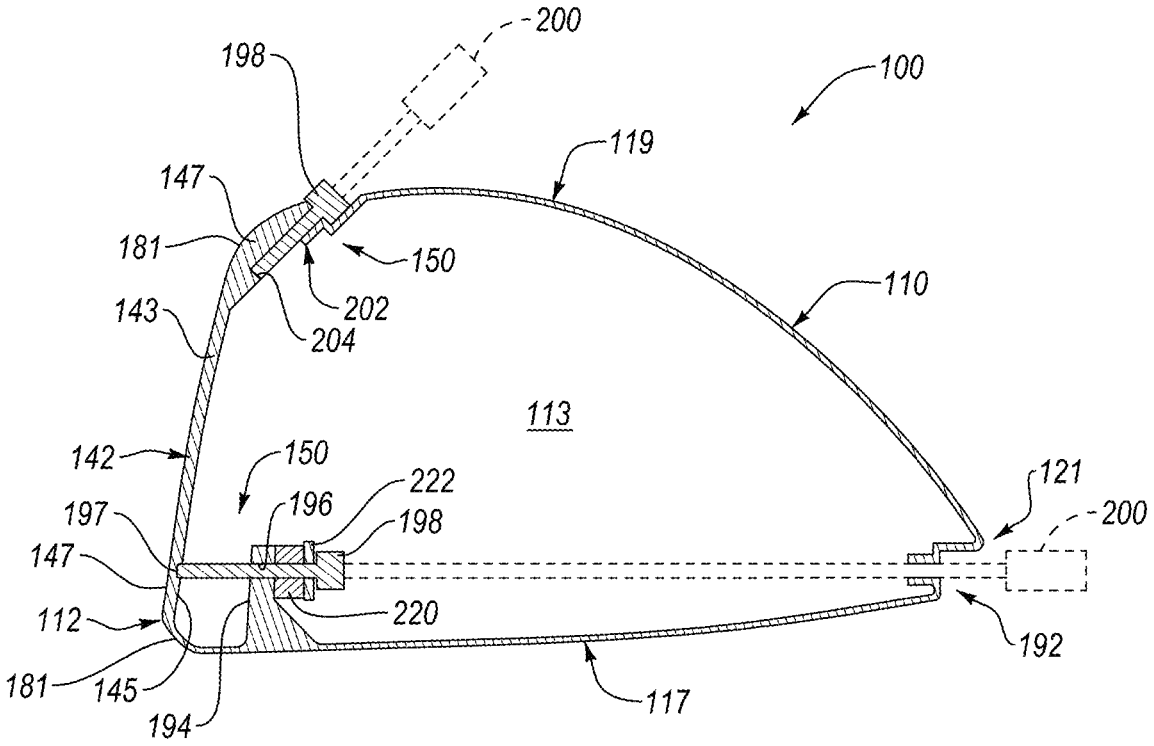
FIG. 27 is a cross-sectional side elevation view of a golf club head, taken along a line similar to line 1-1 of FIG. 2, according to one or more examples of the present disclosure.

According to another example shown in FIG. 27, the stiffness of the face portion 142 can be incrementally adjustable using a spring element 220. More specifically, the stiffener 150 of the golf club head 100 of FIG. 27 includes the spring element 220 interposed between the rib 194 and a washer 222. The stiffener 150 further includes the fastener 198, which extends through the washer 222, the spring element 220, and the aperture 196 of the rib 194. As the fastener 198 translationally moves toward the face portion 142, via adjustment of the fastener 198 (such as by an adjustment tool 200), the fastener 198 causes the washer 222 to compress the spring element 220 against the rib 194. In contrast, as the fastener 198 translationally moves away from the face portion 142, via adjustment of the fastener 198, the spring element 220 is allowed to decompress. The stiffness or elasticity of the spring element 220 incrementally changes as the spring element 220 is incrementally compressed or decompressed. For example, the stiffness of the spring element 220 incrementally increases and the elasticity of the spring element 220 incrementally decreases as the spring element 220 is incrementally further compressed. However, the stiffness of the spring element 220 incrementally decreases and the elasticity of the spring element 220 incrementally increases as the spring element 220 is incrementally further decompressed. In some implementations, the spring element 220 is a solid block of polymeric material, such as acrylic.

An end of the fastener 198 of the stiffener 150 of FIG. 27 is directly engaged with the face portion 142 at a location where adjustability of the CT is desired. In some implementations, the end of the fastener 198 of the stiffener 150 of FIG. 27 is permanently engaged with the face portion 142. For example, the face portion 142 may include a recess 197, formed in the interior surface 145 of the face portion 142, that is configured to receive the end of the fastener 198. The recess 197 may be threaded to threadably engage the end of the fastener 198. The fastener 198 structurally links the face portion 142 with the spring element 220 such that the localized stiffness of the face portion 142, where the end of the fastener 198 contacts the face portion 142, corresponds with the stiffness of the spring element 220. Accordingly, as the stiffness of the spring element 220 is incrementally increased, via adjustment of the fastener 198, the CT of the face portion 142, where the end of the fastener 198 contacts the face portion 142, correspondingly incrementally decreases. In contrast, as the stiffness of the spring element 220 is incrementally decreased, via adjustment of the fastener 198, the CT of the face portion 142, where the end of the fastener 198 contacts the face portion 142, correspondingly incrementally increases.

The stiffeners 150 of the golf club head 100 of the present disclosure advantageously promote a reduction of the CT of the golf club head 100 at locations with an x-axis coordinate that is toeward and/or heelward away from the origin 183 without significantly affecting the CT of the golf club head 100 at locations with an x-axis coordinate proximate that of the origin 183. In some embodiments, to further promote a reduction in the standard deviation of the CT, away from a target CT, at the center face of the strike plate 143, as well as at locations +20 mm and −20 mm horizontally away from the center face (e.g., along the x-axis), for a produced batch of golf club heads 100, the stiffeners 150 of the golf club head 100 can be adjusted, to tune the CT, after the batch of golf club heads 100 is produced. Lowering the standard deviation allows the produced golf club heads 100 of a given batch to have a CT closer to a target CT, which allows selection of a target CT that is closer to a regulated CT threshold for the golf club heads 100. For example, even if a CT of a golf club head 100 of a given batch does not meet the regulated CT threshold after production, one or more stiffeners 150 of the golf club head 100 can be adjusted to tune down the CT such that the regulated CT threshold is met. Similarly, if a CT of a golf club head 100 of a given batch does not meet the target CT after production, one or more stiffeners 150 of the golf club head 100 can be adjusted to tune the CT such that the target CT is achieved.

Accordingly, the standard deviation of the batch of golf club heads 100 can be based on the tunability range of the CT of the golf club heads 100 of the batch. In one embodiment, the standard deviation is about two microseconds. According to other embodiments, the standard deviation is between about one microsecond and about four microseconds. The target CT is between 235 microseconds and 257 microseconds in one example, between 240 microseconds and 250 microseconds in another example, and about 247 microseconds in yet another example. According to some embodiments, the target CT is between one microsecond and 20 microseconds lower than the regulated CT threshold. In one example, the target CT is about 10 microseconds lower than the regulated CT threshold. In yet another embodiment, the target CT is between 0.4% and 7.8% lower than the regulated CT threshold. In one example, the target CT is about 4% lower than the regulated CT threshold.

According to some embodiments, the stiffener 150 of the golf club head 100 is adjusted and the CT of the golf club head 100 is tuned by removing material from the stiffener 150. For example, removing a portion of one or more of the ribs 152 of the golf club head 100 of FIG. 12, such as by using a material removal tool 240, locally increases the CT. The material removal tool 240 can be any of various tools, such as a drill, grinder, sander, etc. configured to cut, shear, grind, etc. metallic materials. The material removal tool 240 can access a rib 152 through an aperture 172 formed in the exterior wall of the body 110 of the golf club head 100. Accordingly, the entirety of the golf club head 100 can be produced, including the ribs 152 and apertures 172. Then, the CT of the produced golf club head 100 can be tested. If the tested CT of the produced golf club head 100 is lower than a target CT, material from one or more ribs 152 can be removed until the CT of the produced golf club head 100 is increased to the target CT. After removing material from the ribs 152, the corresponding apertures 172 can be permanently or non-permanently plugged in preparation for actual use of the golf club head 100 by an end user. In some implementations, the apertures 172 can be non-permanently plugged prior to removing material from the ribs 152 and then permanently or non-permanently plugged after removing material from the ribs 152.

According to some embodiments, the stiffener 150 of the golf club head 100 is adjusted and the CT of the golf club head 100 is tuned by adding material to the stiffener 150. For example, referring to the golf club head 100 of FIGS. 13-23, adding polymeric material into the golf club head 100 to form or add to one or more discrete masses 176, such as by using an injection tool 177, locally decreases the CT. The location of a discrete mass 176, for forming or adding to the discrete mass 176, can be accessed through an aperture 172 formed in the exterior wall of the body 110 of the golf club head 100. Accordingly, the entirety of the golf club head 100 of FIGS. 13-23, including attachment of foam 184, enclosures 186, or enclosure ladders 190, can be produced, including the apertures 172. Then, the CT of the produced golf club head 100 can be tested. If the tested CT of the produced golf club head 100 is higher than a target CT, polymeric material can be added to form or enlarge one or more discrete masses 176 until the CT of the produced golf club head 100 is decreased to or below the target CT. After adding polymeric material to the golf club head 100 through one or more of the apertures 172, the corresponding apertures 172 can be permanently or non-permanently plugged in preparation for actual use of the golf club head 100 by an end user. In some implementations, the apertures 172 can be non-permanently plugged prior to removing material from the ribs 152 and then permanently or non-permanently plugged after removing material from the ribs 152.

According to some implementations, more precise tuning of the CT can be accomplished by varying the quantity or types of polymeric material added to the golf club head 100 of FIGS. 12-23 to form the discrete masses 176. In some implementations, the polymeric material of all the discrete masses 176 of the golf club head 100 is the same while the quantity of the polymeric material of at least one of the discrete masses 176 is different than another of the discrete masses 176. For example, testing of the produced golf club head 100 may reveal the need for greater reduction of the CT at one location on the face portion 142 than at another location. Accordingly, more polymeric material can be added to (i.e., a larger discrete mass 176 can be formed at) the one location compared to the other location. In other implementations, the quantity of the polymeric material of the discrete masses 176 is the same, but the type of polymeric material of at least one discrete mass 176 is different than that of another discrete mass 176. For example, testing of the produced golf club head 100 may reveal the need for greater reduction of the CT at one location on the face portion 142 than at another location. Accordingly, a polymeric material with a higher hardness can be added to the one location compared to the polymeric material at the other location. In one particular example, the type of polymeric material added to the cavities 188 of the enclosure ladder 190 is different for each of the cavities 188, the hardness of the polymeric material being progressively higher the further toeward from the origin 183 and the further heelward from the origin 183.

According to some embodiments, the stiffener 150 of the golf club head 100 of FIGS. 24-27 is adjusted and the CT of the golf club head 100 is tuned by adjusting the fastener 198 of the stiffener 150. The entirety of the golf club head 100 of FIGS. 24-27, including the stiffeners 150, can be produced. Then, the CT of the produced golf club head 100 can be tested. If the tested CT of the produced golf club head 100 is higher than a target CT, the fastener 198 can be adjusted, such as by using an adjustment tool 200, to either bring the fastener 198 into contact with the face portion 142, increase the area of the fastener 198 in contact with the face portion 142, and/or further compress the spring element 220 until the CT of the produced golf club head 100 is decreased to or below the target CT.

In some implementations, more precise tuning of the CT can be accomplished by independently and dissimilarly adjusting the fasteners 198 of the stiffeners 150 of a given golf club head 100 of FIGS. 12-23. For example, one of the fasteners 198 of a golf club head 100 can be adjusted into contact with the face portion 142 while another of the fasteners 198 of the golf club head 100 remains out of contact with the face portion 142. As another example, the fasteners 198 of a given golf club head 100 can be adjusted differently such that the area of one fastener 198 in contact with the face portion 142 can be different than the area of another fastener 198 in contact with the face portion 142. Moreover, in an additional example, the fasteners 198 of a given golf club head 100 can be adjusted differently such that the spring element 220 of one stiffener 150 of the golf club head 100 is compressed differently than the spring element 220 of another stiffener of the golf club head 100.

Figure 29:
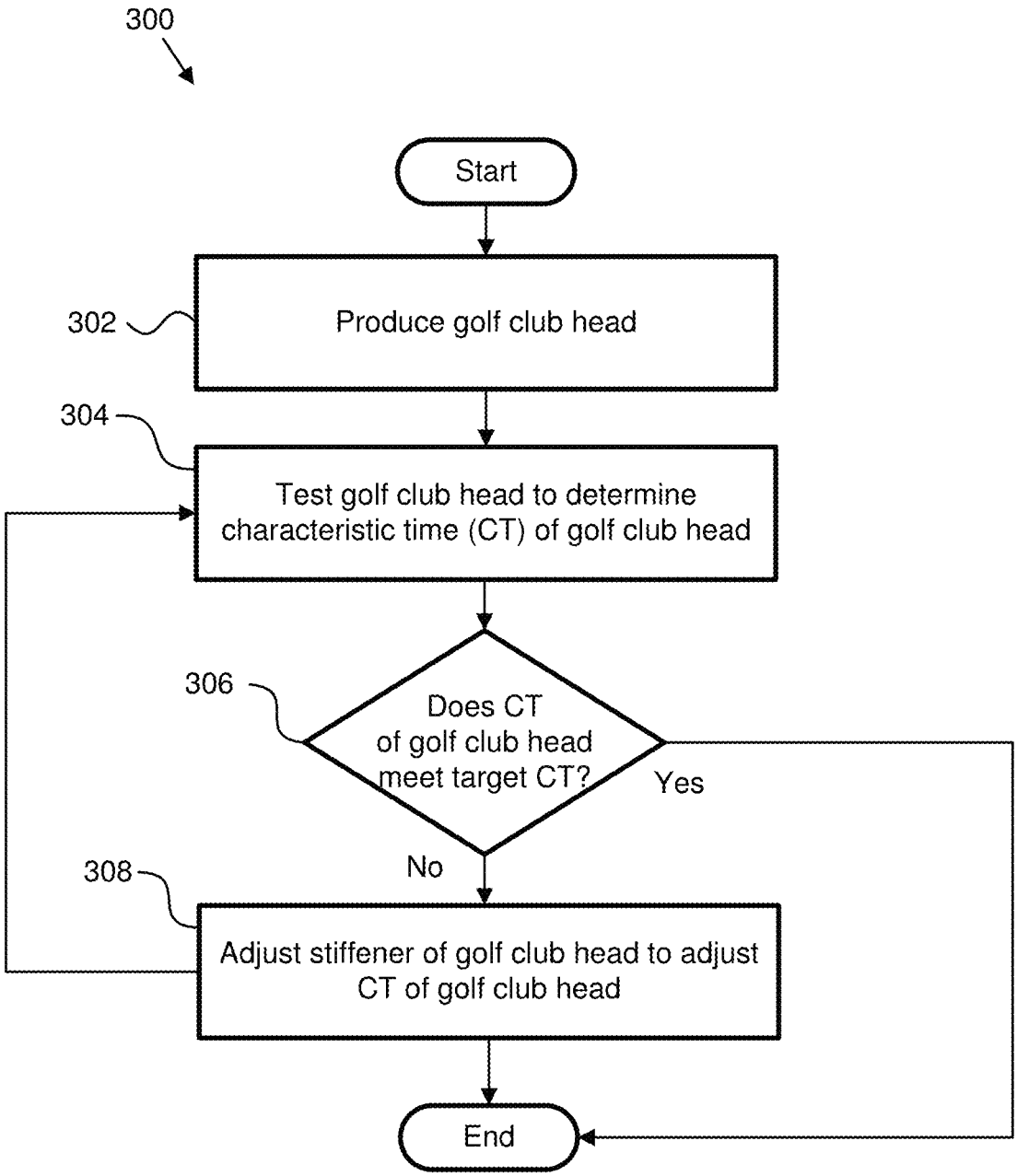
FIG. 29 is a schematic flow diagram of a method of tuning a characteristic time (CT) of a golf club head, after the golf club head is fully manufactured, according to one or more examples of the present disclosure.

Referring to FIG. 29, according to one embodiment, a method 300 of tuning the CT of a golf club head, such as the golf club head 100, after production of the golf club head is disclosed. As defined herein, a golf club head, after production, or a post-production golf club head is a fully functional golf club head with a fully formed body. With the exception of possible ports for securing weights or plugs, the body of a post-production golf club head is fully enclosed. According to another definition, with the possible exception of not meeting a regulated CT threshold, a post-production golf club head meets all other regulated thresholds, such as those thresholds regulated by the USGA.

The method 300 may initially include producing the golf club head at 302. The produced golf club head includes at least one stiffener, such as stiffener 150, for adjusting the CT of the golf club head. The stiffener is at least partially within an interior cavity of the golf club head and directly coupleable to a face portion of the golf club head. The method 300 additionally includes testing the golf club head to determine the CT of the golf club head at 304. The CT test utilize at 304 of the method 300 may be a pendulum-based CT test standardized by the USGA. The method 300 further includes determining whether the CT of the golf club head, determined by testing at 304, meets a desired or target CT at 306. If the CT of the golf club head meets the target CT at 306, then the method 300 ends. However, if the CT of the golf club head does not meet the target CT, then the method 300 proceeds to adjust the stiffener of the golf club head to adjust the CT of the golf club head at 308. In some implementations, after adjusting the stiffener at 308, the method 300 again tests the golf club head to determine the CT of the golf club head at 304 and the method 300 continues from there.

Adjusting the at least one stiffener of the golf club head at 308 can be accomplished in several different ways depending on the configuration of the stiffener. For example, where the stiffener is a rib directly coupled to the face portion of the golf club head (see, e.g., FIGS. 7-12), adjusting the stiffener at 308 includes removing material from at least one rib through a port formed in the body of the golf club head. As another example, where the stiffener includes a discrete mass directly coupled to the face portion of the golf club head (see, e.g., FIGS. 13-23), adjusting the stiffener at 308 includes adding a polymeric material, such as one having a hardness equal to or greater than about Shore 10D, to at least one stiffener through a port or aperture formed in the body of the golf club head. According to yet another example, where the stiffener includes a fastener at least partially within the interior cavity of the golf club head and adjustably coupled to the body of the golf club head (see, e.g., FIGS. 24-27), adjusting the stiffener at 308 includes adjusting (e.g., rotating) the fastener into contact with the face portion of the golf club head or adjusting the fastener while in contact with the face portion of the golf club head.

Figure 30:
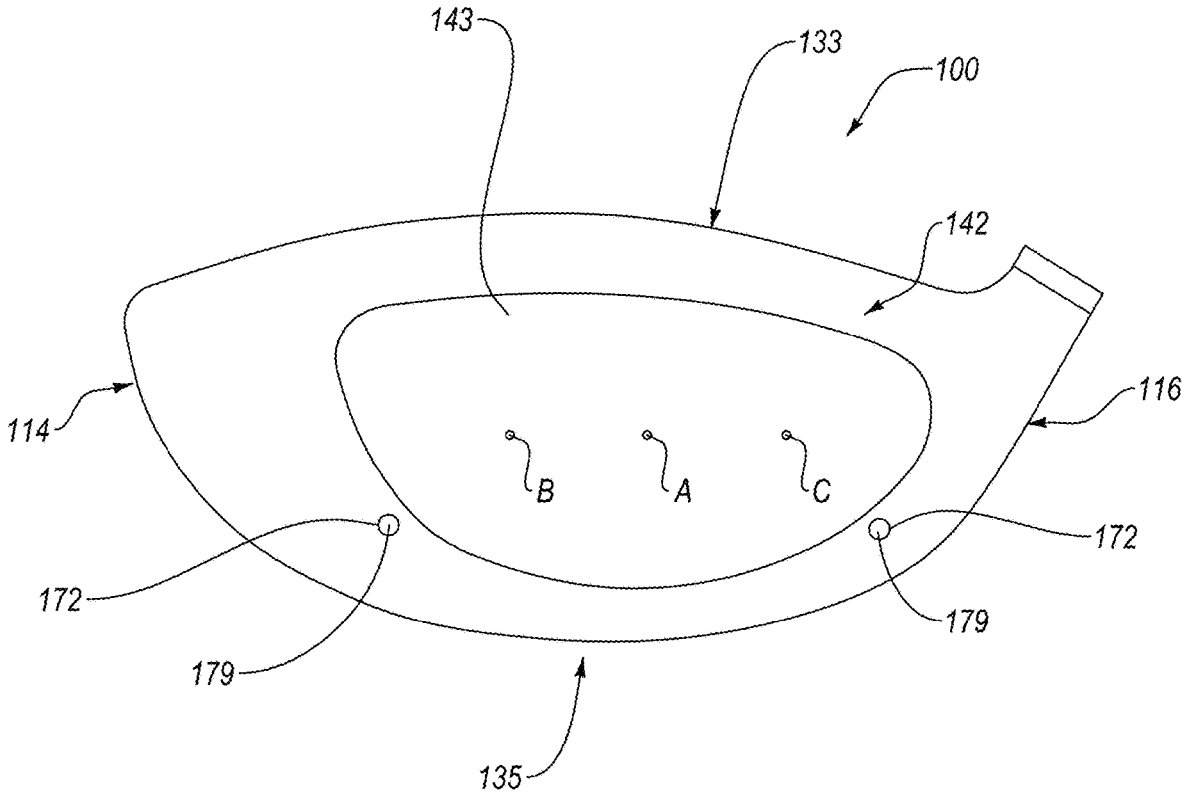
FIG. 30 is a front elevation view of a golf club head, according to one or more examples of the present disclosure.

Referring to FIG. 30, according to one implementation, the CT of a golf club head, configured according to the golf club head 100, was adjusted post-manufacturing of the golf club head and tested before and after adjustment. CT adjustment was accomplished by injecting one gram of a polymeric material through the apertures 172 on the toe side and heel side, respectively, of the face portion 142. In this illustrated implementation, the polymeric material was Scotch Weld Epoxy Adhesive DP420 manufactured by 3M. The epoxy adhesive can be a two-part epoxy adhesive. The injected polymeric material was retained within a respective enclosure made of foam, similar to the enclosure 186, such that discrete masses of polymeric material contacted the interior surface of the face portion 142 in a manner as described above. The polymeric material was then cured.

The CT at three points A, B, C on the strike face of the strike plate 143 was experimentally obtained before and after the polymeric material was injected and cured. Point A was located at center face, point B was located at 20 mm toeward of point A, and point C was located 20 mm heelward of point A. Before the polymeric material was injected and cured, the CT at point A was 256 microseconds, the CT at point B was 267 microseconds, and the CT at point C was 245 microseconds. After injection and curing of the polymeric material, the CT at point A was 249 microseconds (or 7 microseconds less), the CT at point B was 251 microseconds (or 16 microseconds less), and the CT at point C was 247 microseconds (or 2 microseconds more). Accordingly, the injection of polymeric material resulted in a significant reduction in the CT at points A and B and substantially the same CT at point C.

Figure 31A:
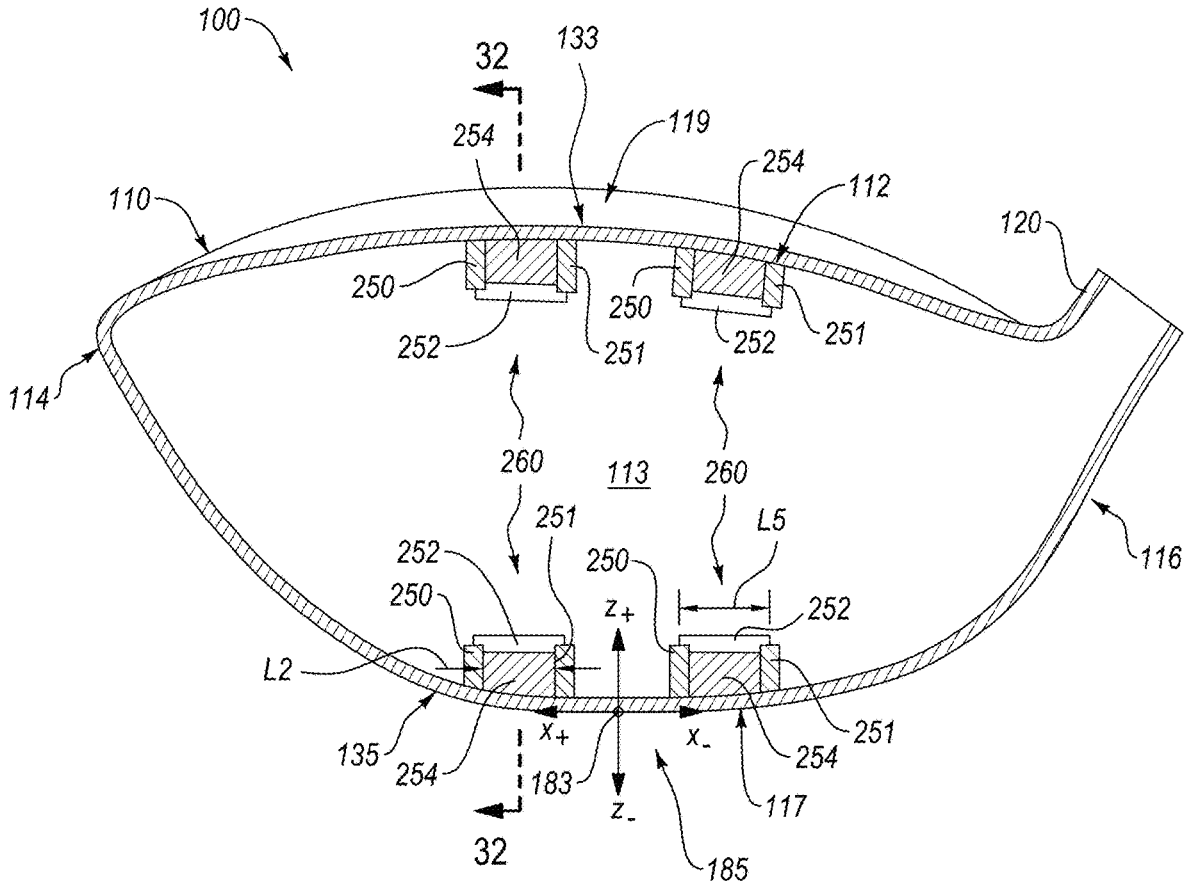
FIG. 31A is a cross-sectional front view of a golf club head, taken along a line similar to line 31-31 of FIG. 2, according to one or more examples of the present disclosure.
Figure 32A:
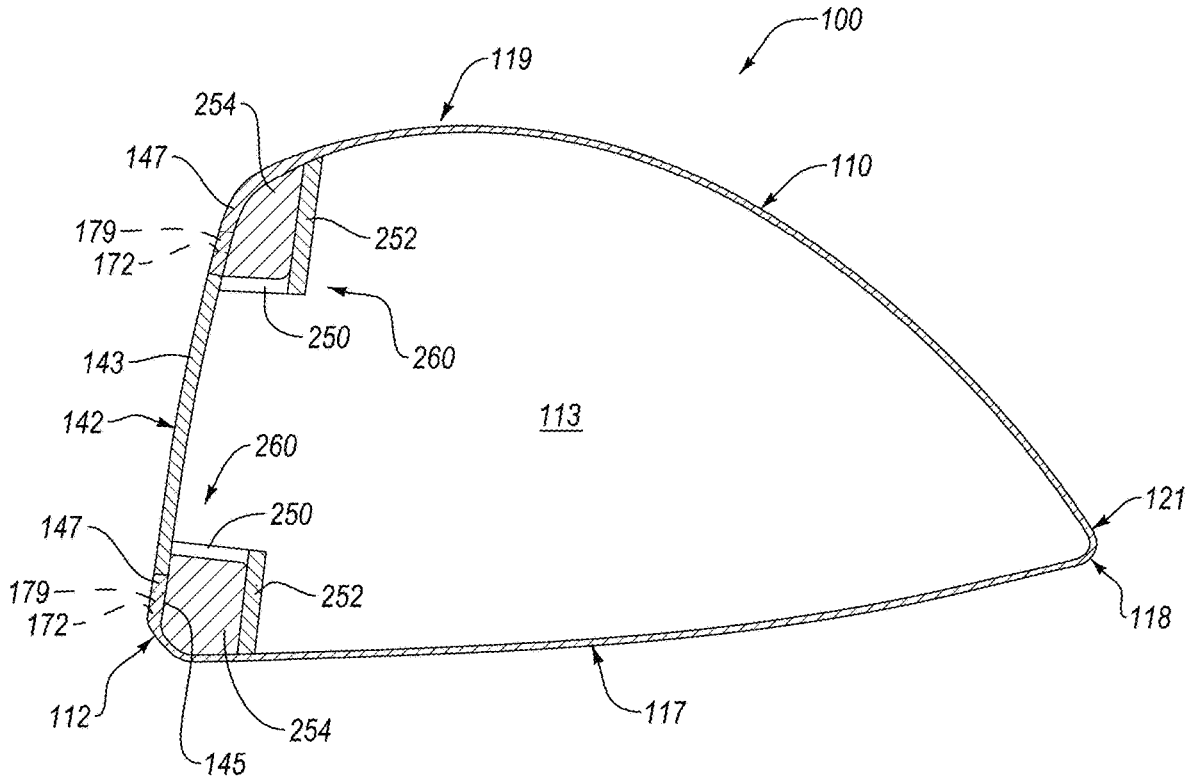
FIG. 32A is a cross-sectional side elevation view of a golf club head, taken along a line similar to line 1-1 of FIG. 2, according to one or more examples of the present disclosure.

Referring to FIGS. 31A and 32A, in another embodiment, the golf club head 100 includes a stiffener 254. The placement of the stiffener 254, relative to the center of the face portion 142, can be similar to the placement of the stiffener 150 described above in association with FIGS. 3-6. The stiffener 254 forms part of a stiffener assembly 260 comprised of a first wall 252, a second wall 250, and a third wall 251. Accordingly, the stiffener assembly 260 comprises the first wall 252, the second wall 250, the third wall 251, and the stiffener 254.

The first wall 252 protrudes uprightly from the sole portion 117 of the body 110. In some examples, the first wall 252 extends perpendicularly from the sole portion 117 and in other examples, the first wall 252 may form an acute or obtuse angle with the part of the sole portion 117 from which the first wall 252 protrudes. The first wall 252 is separately formed from the body 110 and attached to the body 110, such as via a welding or bonding technique, in some examples. However, in other examples, the first wall 252 is co-formed with the body 110 so as to form a one-piece, continuous, and monolithic construction with the body 110. In certain examples, the first wall 252 has a thin-walled construction such that a thickness of the first wall 252 is significantly less than a length and a height of the first wall 252. The first wall 252 extends lengthwise in a generally heel-to-toe direction, which can be parallel to the x-axis of the golf club head origin coordinate system 185 or angled with respect to the x-axis of the golf club head. For example, in some implementations, the first wall 252 defines an angle with the x-axis of the golf club head that is between −30° and −15° and between 15° and 30°.

As shown in FIG. 31A, the first wall 252 has a length L5. The length L5 is less than an entire length L3 of the face portion 142. In other words, the first wall 252 is a discrete wall relative to the entire length L3 of the face portion 142. According to another example, the length L5 is also less than an entire length L4 of the entire section of the face portion 142 that is contiguous with (e.g., abutting or directly coupled to) the sole portion 117 of the body 110. Therefore, the first wall 252 can also be a discrete wall relative to the entire length L4 of the entire section of the face portion 142 that is contiguous with the sole portion 117. In one example, the length L5 of the first wall 252 is less than 30 millimeters.

The first wall 252 is made of a first material having a first modulus of elasticity. In some examples, the first modulus of elasticity is between 15 and 350 GPa. According to other examples, the first modulus of elasticity is between 90 and 210 GPa. In one example, the first modulus of elasticity is the same as the modulus of elasticity of the body 110. For example, the first material can be one of titanium or steel. However, in other examples, the first material is different than that of the body 110 and the first modulus of elasticity is different than that of the body 110. As an example, the first material can be a non-metal, such as a plastic or polymer. Generally, the first wall 252 is stiffer than the second wall, 250, the third wall 252, and the stiffener 254, as explained in more detail below. For example, the stiffener 254 is made of a second material having a second modulus of elasticity that is less than the first modulus of elasticity. The first wall 252 has a relatively higher modulus of elasticity to support the stiffener 254 under the application of front-to-back loads placed on the stiffener 254 caused by impact of a golf ball against the face portion 152 during a swing.

Each of the second wall 250 and the third wall 251 protrudes uprightly from the sole portion 117 of the body 110. In some examples, each of the second wall 250 and the third wall 251 extends perpendicularly from the sole portion 117 and in other examples, each of the second wall 250 and the third wall 251 may form an acute or obtuse angle with the part of the sole portion 117 from which the first wall 252 protrudes. The second wall 250 and the third wall 251 are formed separately formed from the body 110 and attached to the body 110, such as via a welding or bonding technique, in some examples. The second wall 250 and the third wall 251 extend lengthwise parallel to a front-to-back direction, which can be parallel to the y-axis of the golf club head origin coordinate system 185. The length of each of the second wall 250 and the third wall 251 is equal to the distance between the interior surface 145 of the face portion 142 and the first wall 252.

The second wall 250 and the third wall 251 are made of a third material having a third modulus of elasticity. The third modulus of elasticity is less than the first modulus of elasticity. In some examples, the third modulus of elasticity is between 0.01 GPa and 8.0 GPa. According to other examples, the third modulus of elasticity is between 0.05 GPa and 2.0 GPa. The third material is foam in one example. In other examples, the third material is a relatively soft polymer or low-strength metal. Generally, the second wall 250 and the third wall 251 are less stiff than the first wall 252 because the second wall 250 and the third wall 251 are configured to laterally retain the stiffener 254 in place and the lateral loads (e.g., heel-to-toe loads) placed on the stiffener 254 during a golf swing are less than the front-to-back loads placed on the stiffener 254.

The second wall 250 and the third wall 251 are spaced apart from each other, in the heel-to-toe direction, a distance equal to the length L2 of the stiffener 254. In this manner, the second wall 250 and the third wall 251 help laterally retain the stiffener 254 within the gap between the second wall 250 and the third wall 251.

The stiffener 254 is located within the interior cavity 113 of the body 110 and is directly coupled to the interior surface 145 of the face portion 142. The stiffener 254 helps reduce the CT of the golf club head 100 compared to the golf club head without the stiffener 254. As shown in FIG. 31A, the stiffener 254 has a length L2. The length L2 is less than an entire length L3 of the face portion 142. In other words, the stiffener 254 is a discrete feature relative to the entire length L3 of the face portion 142. According to another example, the length L2 is also less than an entire length L4 of the entire section of the face portion 142 that is contiguous with (e.g., abutting or directly coupled to) the sole portion 117 of the body 110. Therefore, the stiffener 254 can also be a discrete feature relative to the entire length L4 of the entire section of the face portion 142 that is contiguous with the sole portion 117. In one example, the length L2 of the stiffener 254 is less than 30 millimeters. According to certain examples, the length L2 of the stiffener 254 is not more than the length L5 of the first wall 252.

As presented above, the stiffener 254 is made of a second material having a second modulus of elasticity. The second modulus of elasticity is less than the first modulus of elasticity of the first material of the first wall 252 and greater than the third modulus of elasticity of the third material of the second wall 250 and the third wall 251. In some examples, the second modulus of elasticity is between 0.5 GPa and 30 GPa. According to other examples, the second modulus of elasticity is between 1 GPa and 5.0 GPa. The second material is acrylic in one example.

In the assembly 260, the stiffener 254 is interposed between the interior surface 145 of the face portion 142 and the first wall 252 and the stiffener 254 is interposed between the second wall 250 and the third wall 251. In some examples, the second wall 250 is directly coupled to (e.g., abuts) the interior surface 145 of the face portion 142 and directly coupled to the first wall 252. Similarly, in some examples, the third wall 251 is directly coupled to the interior surface 145 of the face portion 142 and directly coupled to the first wall 252. The second wall 250 and the third wall 251 can be directly coupled to the interior surface 145 and the first wall 252 by directly abutting the interior surface 145 and the first wall 252 or by being bonded to the interior surface 145 and the first wall. The stiffener 254 is directly coupled to the first wall 252, the second wall 250, and the third wall 251. Accordingly, the stiffener 254 is at least laterally confined or housed between the interior surface 145, the first wall 252, the second wall 250, and the third wall 251. In some examples, the maximum height of the first wall 252, the second wall 250, and the third wall 251 is greater than the maximum height of the stiffener 254.

Figure 31B:
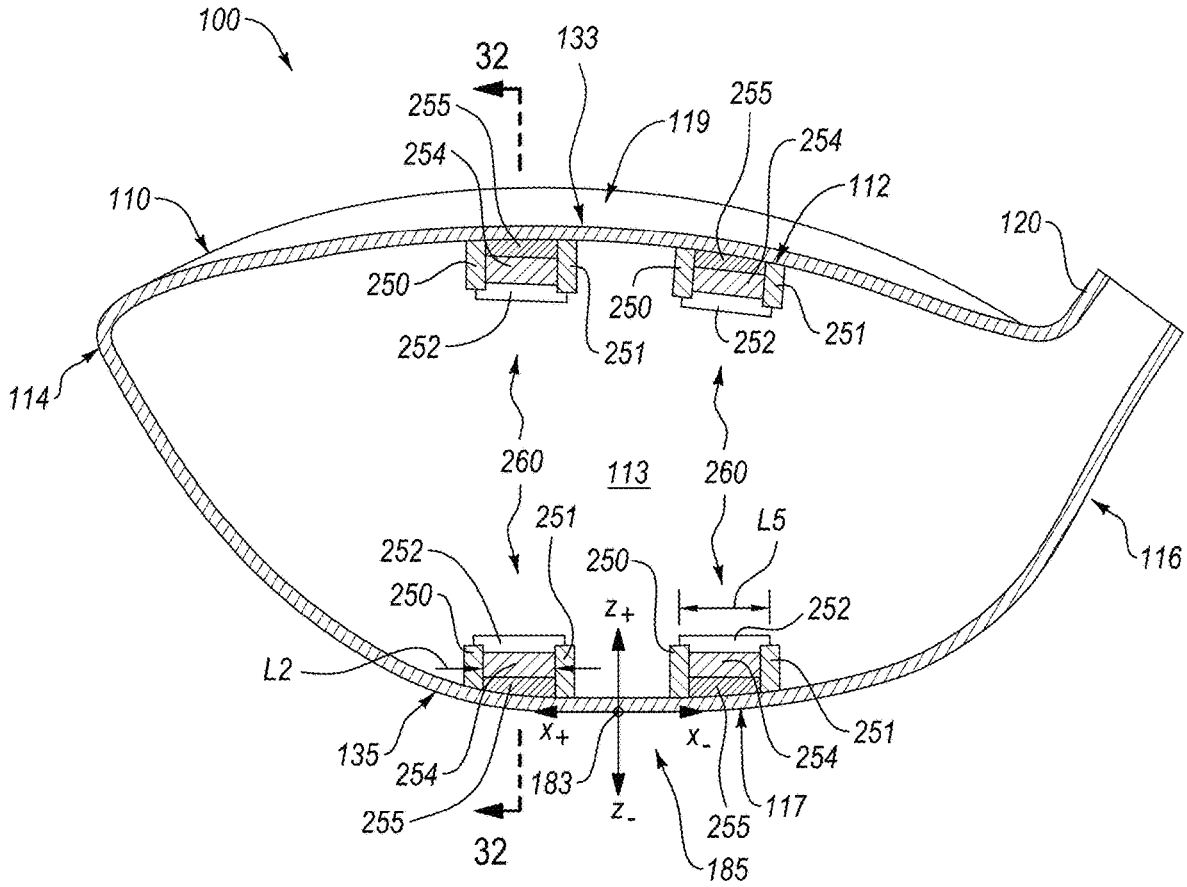
FIG. 31B is a cross-sectional front view of a golf club head, taken along a line similar to line 31-31 of FIG. 2, according to one or more examples of the present disclosure.
Figure 32B:
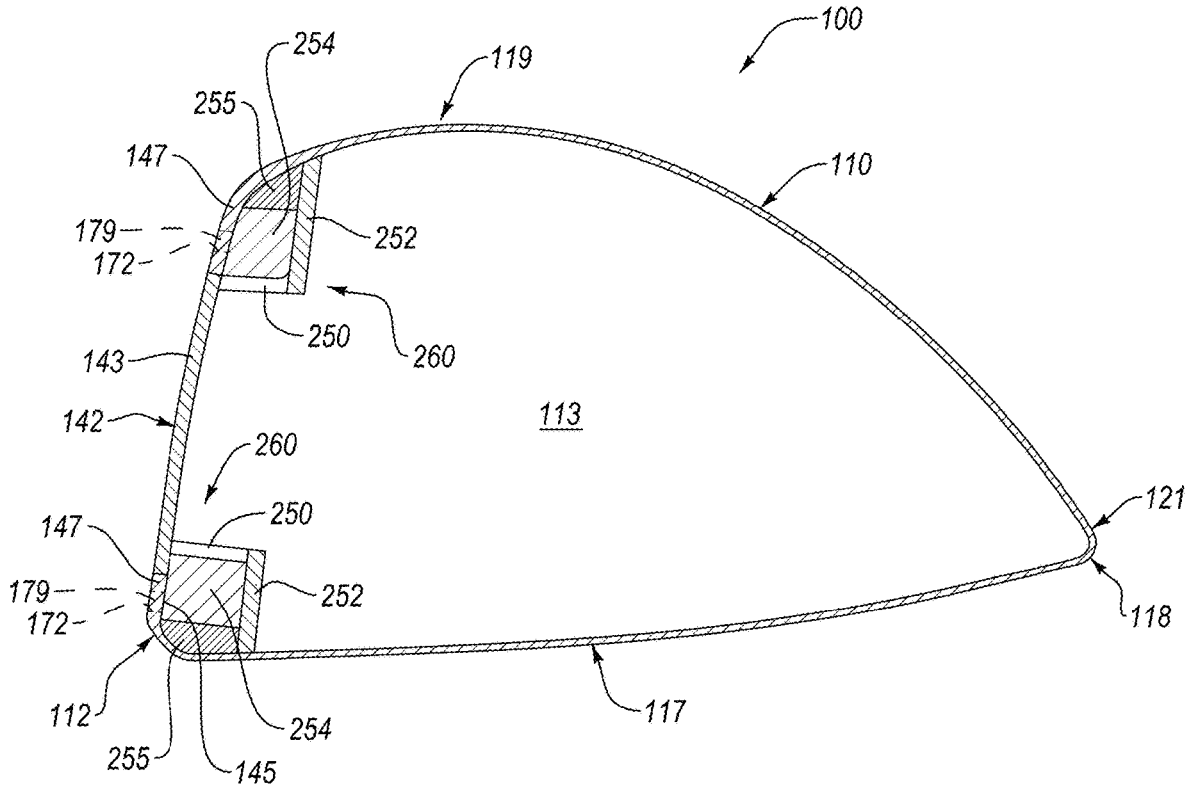
FIG. 32B is a cross-sectional side elevation view of a golf club head, taken along a line similar to line 1-1 of FIG. 2, according to one or more examples of the present disclosure.

According to another example shown in FIGS. 31B and 32B, the stiffener 254 of the stiffener assembly 260 of the golf club head 100 is not directly coupled to the interior surface of the body 110, which is in contrast to the golf club head 100 of FIGS. 31A and 32A where the stiffener 254 of the stiffener assembly 260 is directly coupled to the interior surface of the body 110. Rather, in the example of FIGS. 31B and 32B, the stiffener assembly 260 further includes a base 255 on which the stiffener 254 is supported relative to the body 110. In other words, the base 255 is interposed between the stiffener 254 and the interior surface of the body 110. The base 255 is coupled directly to the interior surface of the base 255, such as with an adhesive. The base 255 acts as a platform to help position the stiffener 254 higher up on the face portion 142, if located at the bottom region of the golf club head 100, or lower down on the face portion 142, if located at the top region of the golf club head 100. In some examples, the base 255 has a length equal to the length L2 of the stiffener 254. The base 255 is made of a fourth material, which has a fourth modulus of elasticity that is less than the second modulus of elasticity of the second material of the stiffener 254. According to an example, the fourth material is the same as the third material and the fourth modulus of elasticity is the same as the third modulus of elasticity. In fact, in some examples, the base 255 forms a one-piece monolithic, seamless, construction with the second wall 250 and the third wall 251.

In some examples of the golf club head 100 of FIGS. 31A and 32A and the golf club head 100 of FIGS. 31B and 32B, the stiffener assembly 260 does not include both the second wall 250 and the third wall 251. As one example, the stiffener assembly 260 of the golf club head 100 includes only one of the second wall 250 or the third wall 251. In such an example, the golf club head 100 can be oriented during the formation of the stiffener 254 such that the second wall 250 or the third wall 251 acts as a vertically lower stop against which the stiffener 254 collects and hardens, which helps to obviate the need for the other of the second wall 250 or the third wall 251. Alternatively, in another example, the stiffener assembly 260 does not include the second wall 250 and the third wall 251. In such an example, the stiffener 254 is not formed in place in the golf club head 100 (e.g., by flowing a hardenable material into the golf club head 100), but rather the stiffener 254 can be pre-formed and fixedly inserted into place between the first wall 252 and the interior surface 145 of the face portion 142.

As shown in FIGS. 31A, 32A, 31B, and 32B, the golf club head 100 includes multiple stiffener assemblies 260 in some examples. The stiffener assemblies 260 may be located at any of various locations on the sole portion 117 and/or the crown portion 119. Multiple assemblies 260 on the sole portion 117 are laterally spaced apart from each other, in the heel-to-toe direction, and multiple assemblies 260 on the crown portion 119 are laterally spaced apart from each other, also in the heel-to-toe direction. According to some examples, each of the multiple stiffener assemblies 260 is located toewardly or heelwardly of the center of the face portion 142 such that the stiffener 254 is positioned in any of the various positions described above in connection with stiffener 250. Additionally, in certain examples, one stiffener assembly 260 of the golf club head 100 may be different than another stiffener assembly 260 of the golf club head 100. For example, one stiffener assembly 260 may have a base 255 and another stiffener assembly 260 may not have a base 255. As another example, the modulus of elasticity of the first wall 252, the second wall 250, the third wall 251, or the base 255 of one stiffener assembly 260 of the golf club head 100 can be different than the modulus of elasticity of the first wall 252, the second wall 250, the third wall 251, or the base 255, respectively, of another stiffener assembly 260 of the same golf club head 100. Such flexibility in the configuration of one stiffener assembly 260 relative to another stiffener assembly 260 of the same golf club head 100 allows the impact the stiffener assemblies 260 have on CT at one location of the golf club head 100 to be different than at another location of the golf club head 100.

Figure 33:
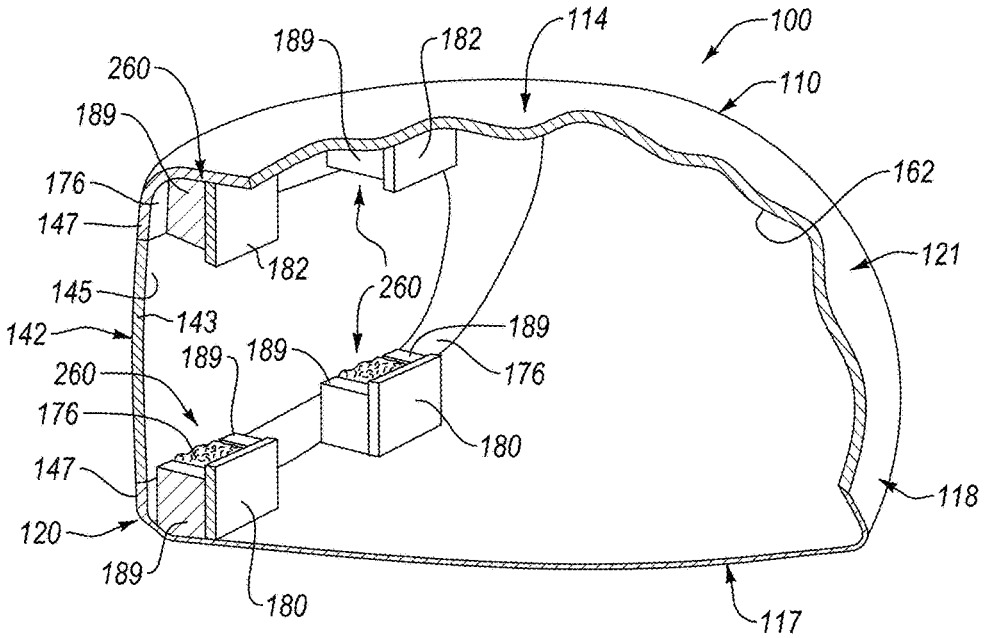
FIG. 33 is a cross-sectional perspective view of a golf club head, taken along a line similar to line 1-1 of FIG. 2, from a side of the golf club head, and shown with a portion of the top portion of the golf club head removed, according to one or more examples of the present disclosure.
Figure 34:
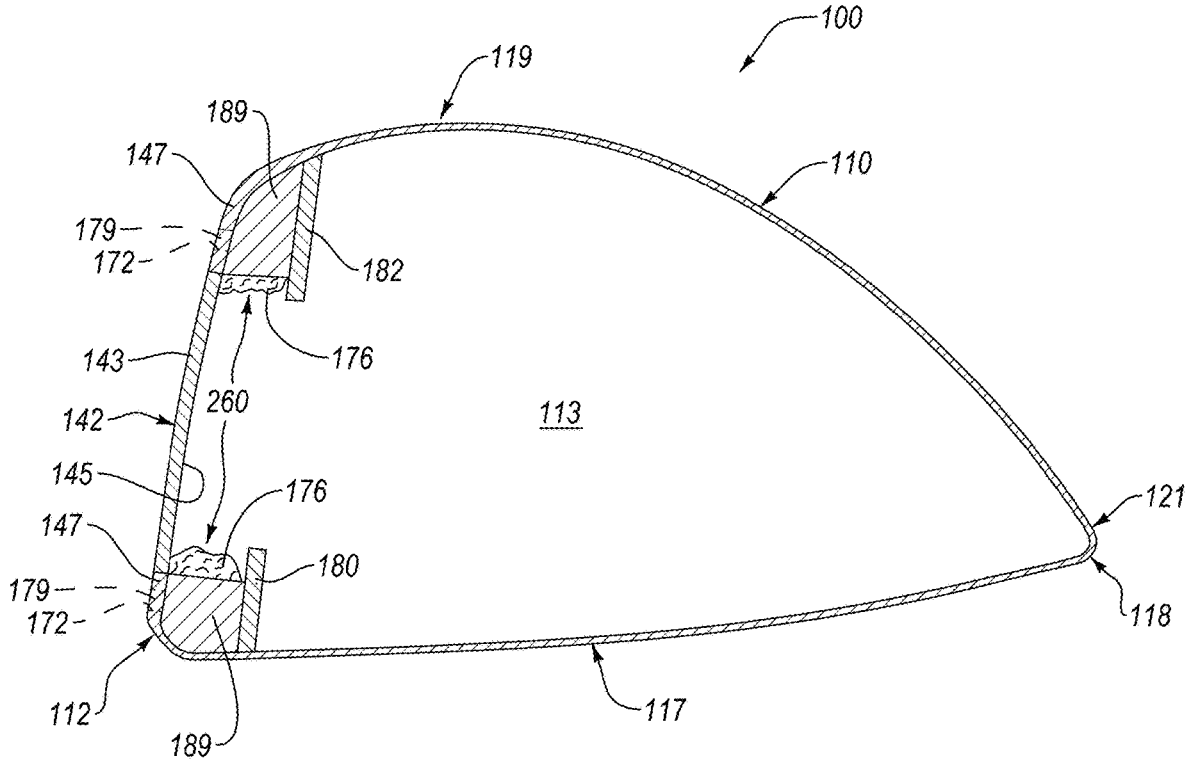
FIG. 34 is a cross-sectional side elevation view of a golf club head, taken along a line similar to line 1-1 of FIG. 2, according to one or more examples of the present disclosure.
Figure 46:
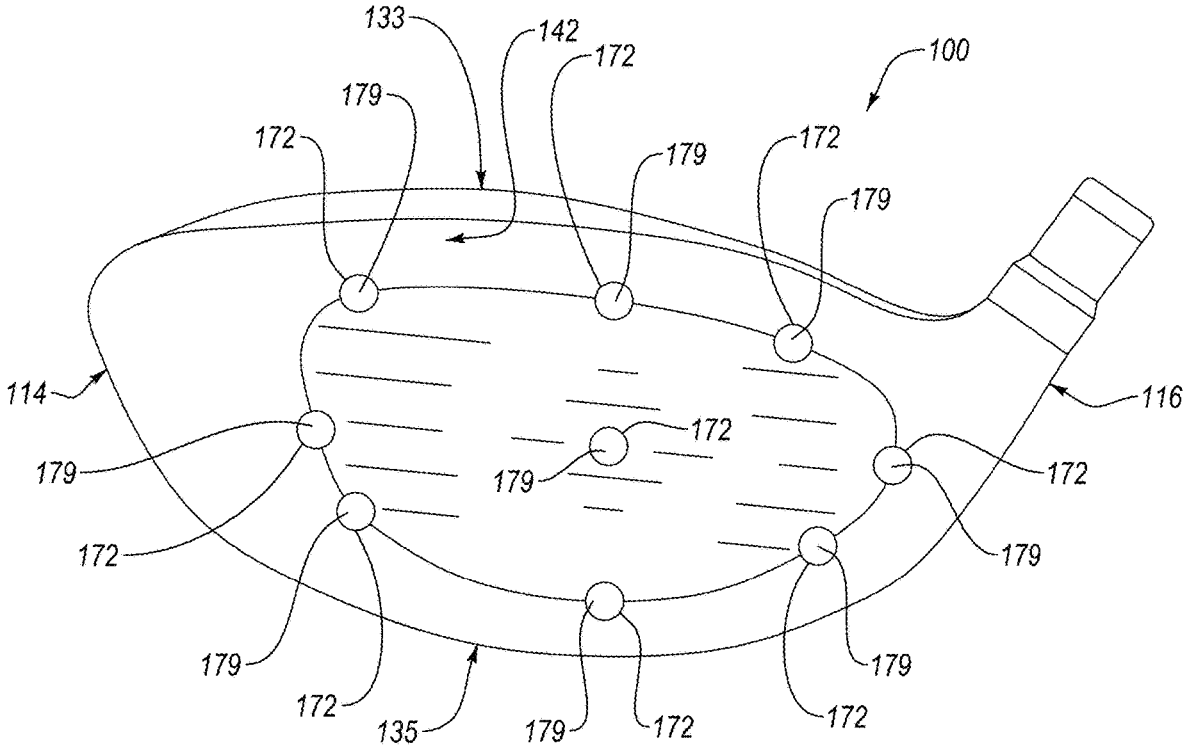
FIG. 46 is a front elevation view of a golf club head, according to one or more examples of the present disclosure.

Referring to FIGS. 33 and 34, one implementation of the golf club head 100 of FIGS. 31A and 32A is shown. In the golf club head 100 of FIGS. 33 and 34, the stiffener assemblies 260, in one implementation, are configured in a manner similar to those of the golf club head 100 of FIGS. 31A and 32A. For example, in the golf club head 100 of FIGS. 33 and 34, the first wall 252 is the retaining wall 180, co-formed with the body 110 of the golf club head, the second wall 250 is one of the walls 189, made of foam, the third wall 251 is the other of the walls 189, made of foam, and the stiffener 254 is the discrete mass 176 of polymeric material. Although not shown, the stiffener assemblies 260 of the golf club head 100 of FIGS. 33 and 34, in another implementation, are configured in a manner similar to those of the golf club head 100 of FIGS. 31B and 32B to have a base 187, made of foam, between the discrete masses 176 of polymeric material and the interior surface of the body 110. The golf club head 100 of FIGS. 33 and 34 also includes apertures 172, formed in the face portion 142, through which the polymeric material of the discrete mass 176 is respectively added to form the stiffener assemblies 260. Each aperture 172 is plugged with a plug 179 after adding the polymeric material. In some examples, the golf club head 100 may include an aperture 172 and a corresponding plug 179 at any one or more of the locations shown in FIG. 46. According to certain examples, the golf club head 100 may include an aperture 172 and a corresponding plug 179 at any two or more of the locations shown in FIG. 46. In yet some examples, the golf club head 100 may include an aperture 172 and a corresponding plug 179 at all of the locations shown in FIG. 46.

Figure 50:
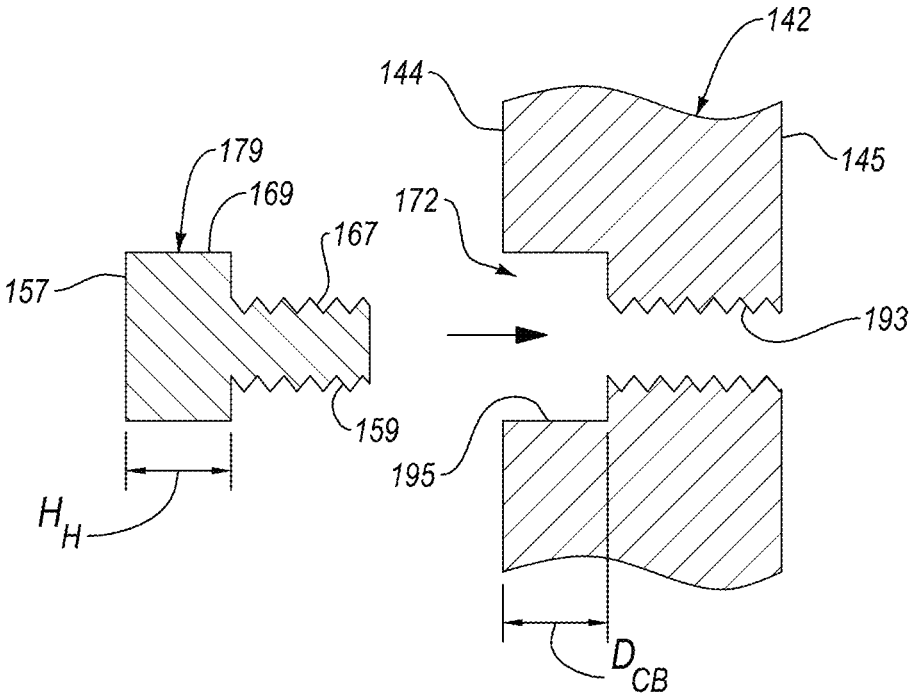
FIG. 50 is an exploded cross-sectional side view of a face portion of a golf club head, according to one or more examples of the present disclosure.
Figure 51:
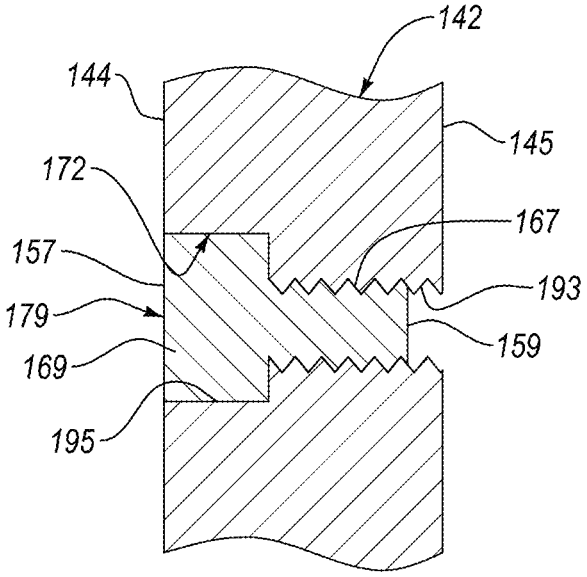
FIG. 51 is a cross-sectional side view of the face portion of the golf club head of FIG. 50, according to one or more examples of the present disclosure.

Referring to FIG. 50, according to some examples of the golf club head 100, the aperture 172 extends through the face portion 142 from the strike face 144 to the interior surface 145. The aperture 172 includes internal threads 193 and a counterbore 195 in certain examples. The counterbore 195 is interposed between the internal threads 193 and the strike face 144. The counterbore 195 has a radial dimension greater than a maximum radial dimension of the internal threads 193. Additionally, the counterbore 195 has a depth $D_{CB}$ relative to the strike face 144. The plug 179 includes a shank 159 and a head 169. The shank 159 includes external threads 167 that are configured to threadably engage the internal threads 193 of the aperture 172. The head 169 has a radial dimension that is greater than a maximum radial dimension of the external threads 167. Moreover, the radial dimension of the head 169 is equal to or just smaller than the radial dimension of the counterbore 195 such that the head 169 can be nestably seated within the counterbore 195 when the external threads 167 are threadably engaged with the internal threads 193, as shown in FIG. 51. Additionally, the head 169 has a height $H_H$.

Referring to FIG. 51, the plug 179 is non-movably fixedly retained within the aperture 172. Generally, the plug 179 of FIGS. 50 and 51 is non-movably fixedly retained within the aperture 172 when the external threads 167 are threadably engaged with the internal threads 193 and the head 169 is fully seated against the counterbore 195. In some examples, an adhesive is applied between the external threads 167 and the internal threads 193 to promote a secure fit between the plug 179 and the aperture 172.

Figure 52:
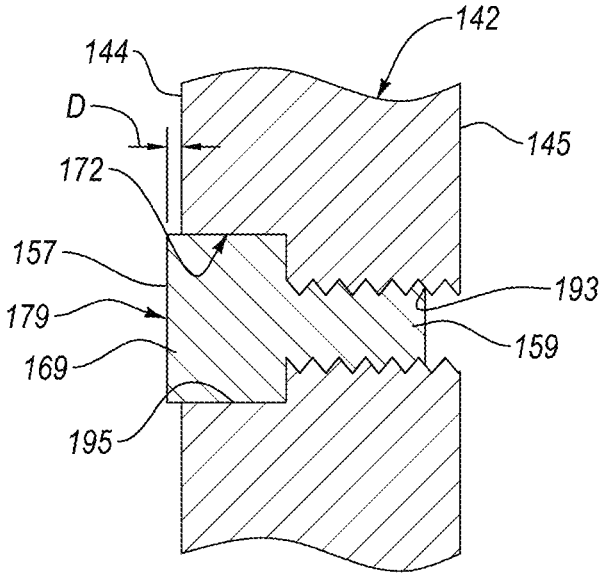
FIG. 52 is a cross-sectional side view of a face portion of a golf club head, according to one or more examples of the present disclosure.
Figure 53:
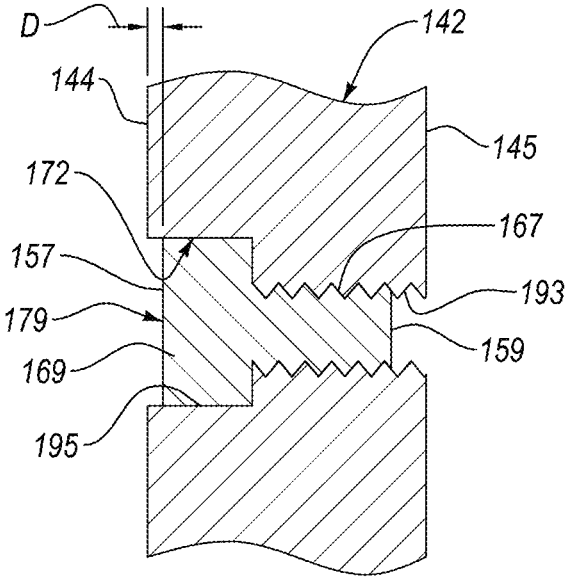
FIG. 53 is a cross-sectional side view of a face portion of a golf club head, according to one or more examples of the present disclosure.

When non-movably fixedly retained within the aperture 172, an outermost surface 157 of the plug 179, which is the outermost surface of the head 169 in the examples corresponding with FIGS. 50 and 51, establishes a flushness with the strike face 144. The flushness can be quantified as the distance D the outermost surface 157 protrudes from the strike face 144 (see, e.g., FIG. 52) or the distance D the outermost surface 157 is recessed or sunken below the strike face 144 (see, e.g., FIG. 53). In FIG. 51, the distance D is zero such that the outermost surface 157 is perfectly flush with the strike face 144. However, in some examples, the distance D is greater than zero such that the outermost surface 157 is not perfectly flush with the strike face 144. For example, in one implementation, the outermost surface 157 of the plug 179 protrudes a distance D no more than 0.15 millimeters from the strike face 144 or is sunken below the surface of the strike face a distance D no more than 0.1 millimeters. Enabling a flushness within this range promotes improved performance of the golf club head by reducing potentially negative interactions with a golf ball on impact.

According to one method, the desired flushness is achieved by determining the depth $D_{CB}$ of the counterbore 195 after the face portion 142 is formed. In response to the determined depth $D_{CB}$, a plug 179 with a desired head height $H_H$, corresponding with the determined depth $D_{CB}$, is selected from a plurality of plugs 179 each with a different head height $H_H$. After the plug 179 with the desired head height $H_H$ is selected, it is non-movably fixedly retained within the aperture 172.

Figure 54:
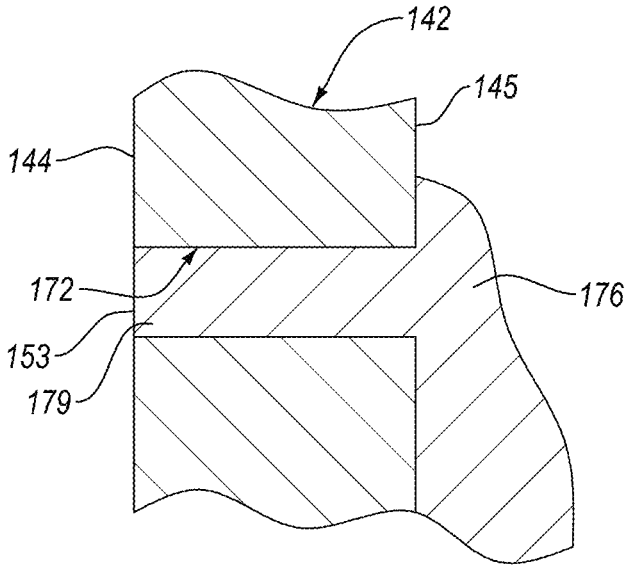
FIG. 54 is a cross-sectional side view of a face portion of a golf club head, according to one or more examples of the present disclosure.

Referring to FIG. 54, in some examples, the plug 179 includes a portion of the stiffener. In one example, the stiffener is a discrete mass 176 of polymeric material and the plug 179 is made of a portion of the polymeric material. The polymeric material is injected through the aperture 172 to form the discrete mass 176 within the golf club head 100 and allowed to fill the aperture 172 after forming the discrete mass 176. To obtain a desired flushness with the strike face 144, in one example, the polymeric material of the plug 179 can originally protrude from the strike face 144 and be surface finished (e.g., sanded, grinded, polished, chemically etched, etc.) until the plug 179 reaches the desired flushness.

Figure 35:
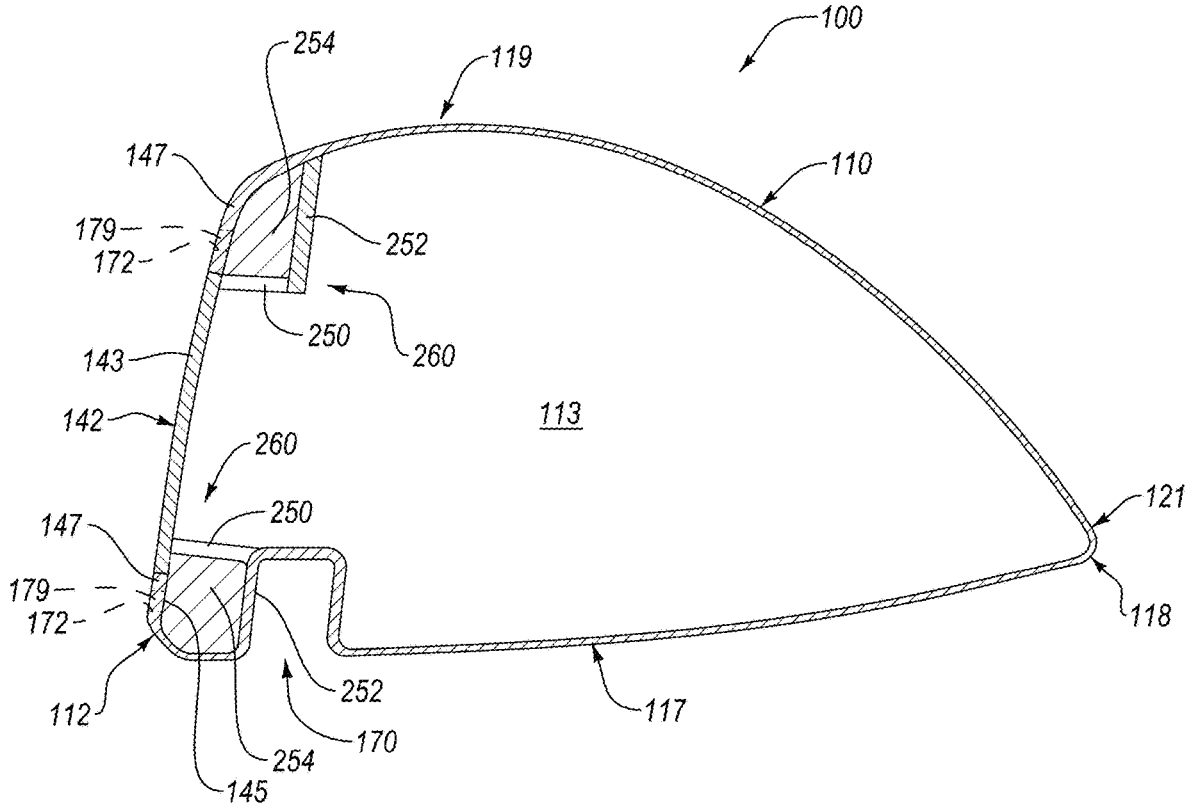
FIG. 35 is a cross-sectional side elevation view of a golf club head, taken along a line similar to line 1-1 of FIG. 2, according to one or more examples of the present disclosure.

The stiffener assemblies 260 of the golf club head 100 of FIG. 35 are similar to those of the golf club head 100 of FIGS. 31A and 32A except the first wall 252, instead of being a stand-alone, dedicated wall, forms a forwardmost sidewall of the slot 170 formed in the sole portion 117 of the body 110. The slot 170 extends lengthwise parallel to the heel-to-toe direction. Although the slot 170 is shown to be closed to the interior cavity 113 of the body, in some examples, the slot 170 can be open to the interior cavity 113 (see, e.g., FIG. 40).

Figure 36:
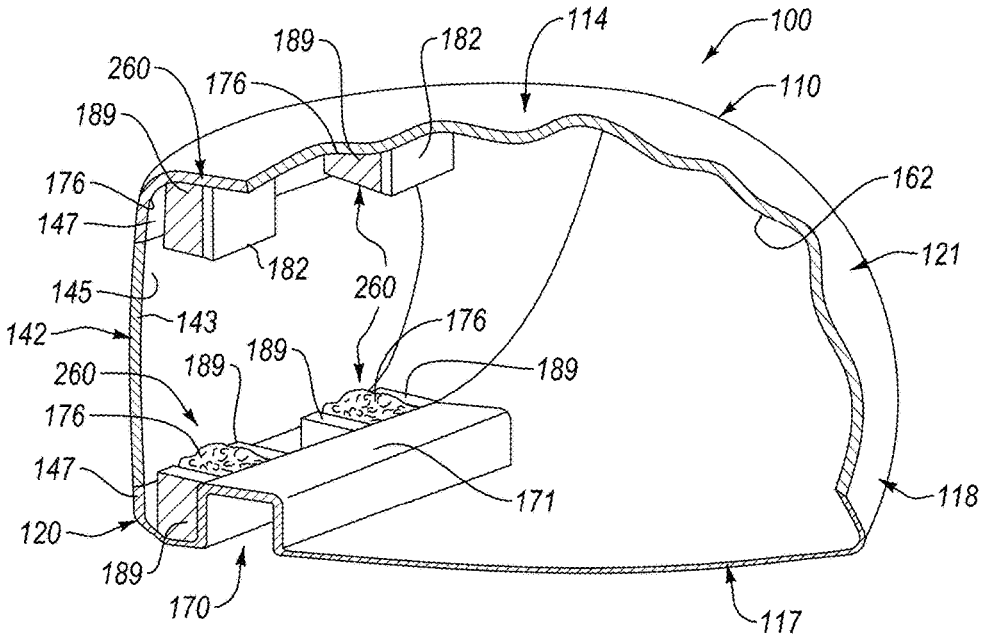
FIG. 36 is a cross-sectional perspective view of a golf club head, taken along a line similar to line 1-1 of FIG. 2, from a side of the golf club head, and shown with a portion of the top portion of the golf club head removed, according to one or more examples of the present disclosure.

In one example, the slot 170 extends the entire length of the entire section of the face portion 142 that is contiguous with the sole portion 117 of the body 110 (see, e.g., FIG. 36). Accordingly, the first wall 252 also extends the entire length of the entire section of the face portion 142 that is contiguous with the sole portion 117 of the body 110. However, the stiffener 254 extends lengthwise less than the entire length of the entire section of the face portion 142 that is contiguous with the sole portion 117 of the body 110. In other words, the length L5 of the first wall 252 is much larger than the length L2 of the stiffener 254.

Although not shown, one or more of the stiffener assemblies 260 of the golf club head 100 of FIG. 35 further includes a base 255, interposed between the stiffener 254 and the interior surface of the body 110, in a manner similar to the stiffener assemblies 260 of the golf club head 100 of FIGS. 31B and 32B. It is also recognized that in some examples, one or more of the stiffener assemblies 260 of the golf club head 100 of FIG. 35 includes only one or none of the second wall 250 and the third wall 251.

Figure 37:
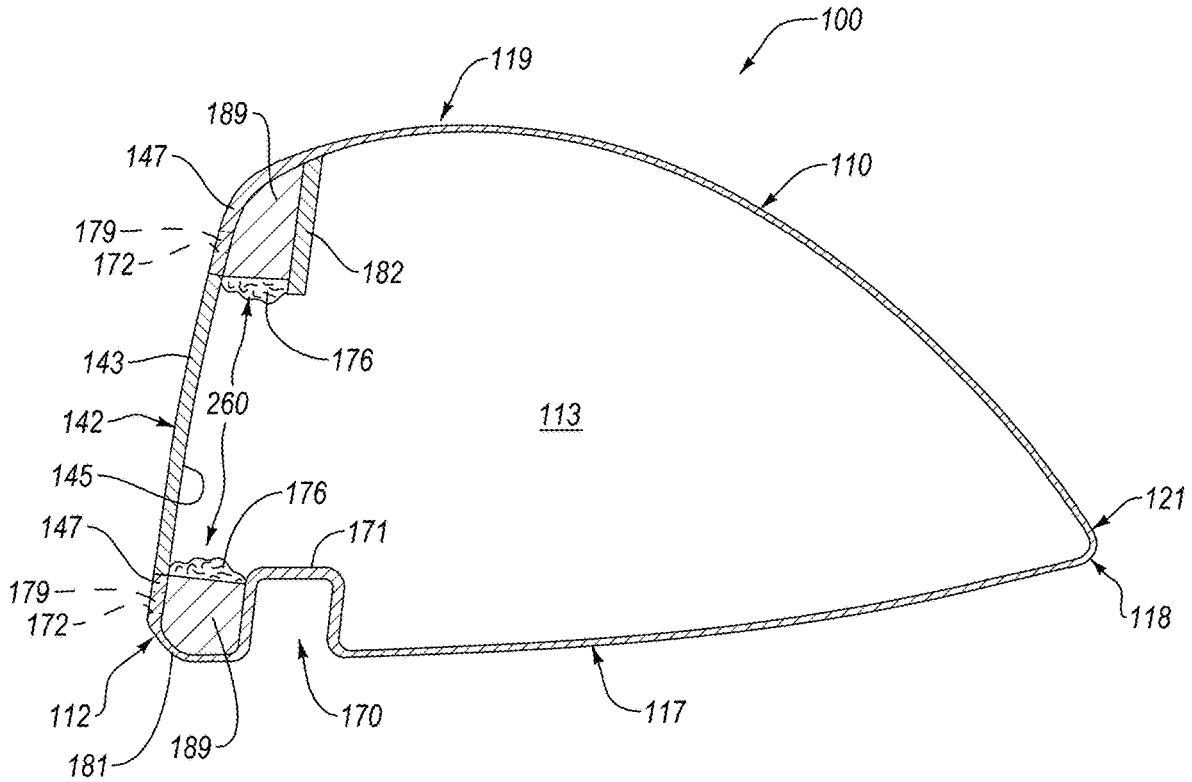
FIG. 37 is a cross-sectional side elevation view of a golf club head, taken along a line similar to line 1-1 of FIG. 2, according to one or more examples of the present disclosure.
Figure 38:
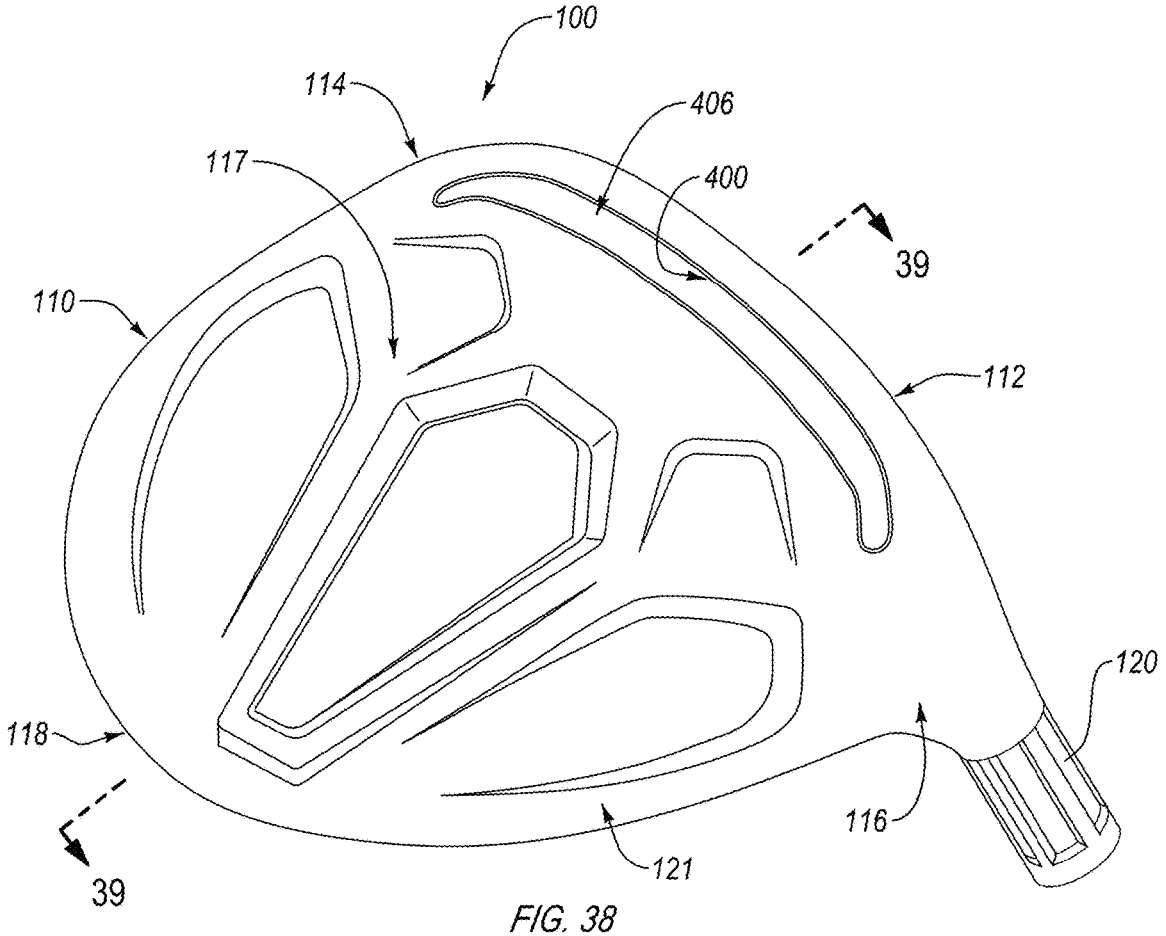
FIG. 38 is a perspective view of a golf club head, from a bottom of the golf club head, according to one or more examples of the present disclosure.
Figure 39:
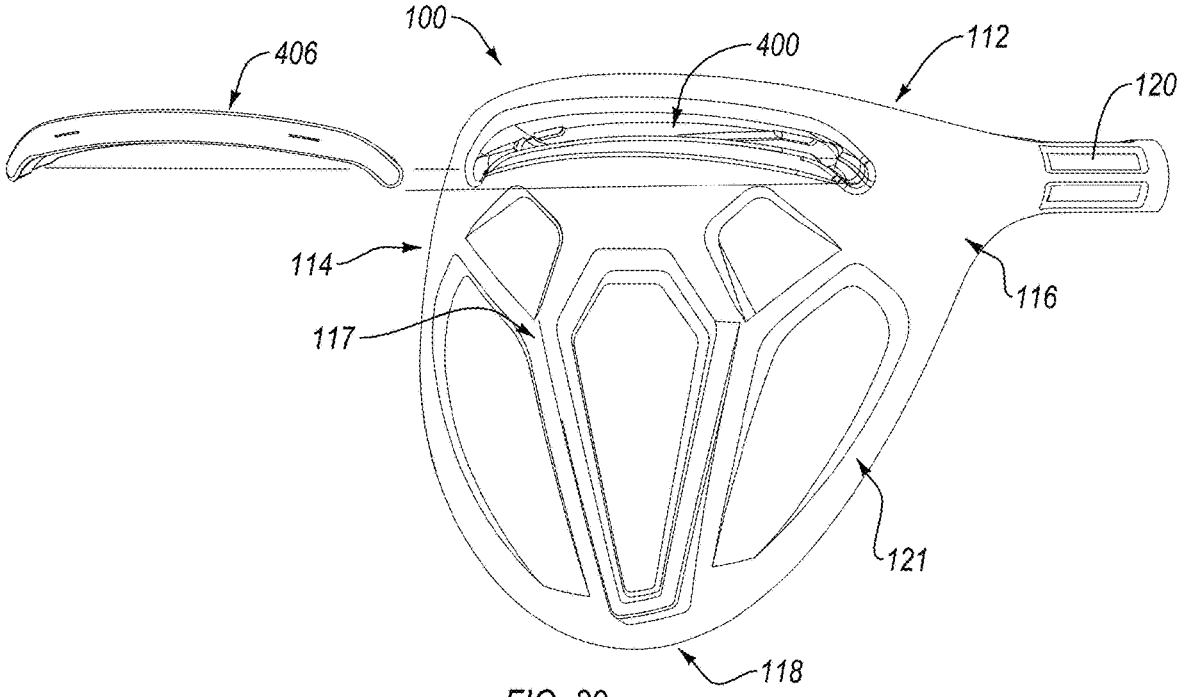
FIG. 39 is an exploded perspective view of a golf club head, from a bottom of the golf club head, according to one or more examples of the present disclosure.

Referring to FIGS. 36 and 37, one implementation of the golf club head 100 of FIG. 35 is shown. In the golf club head 100 of FIGS. 36 and 37, the second wall 250 is one of the walls 189, made of foam, the third wall 251 is the other of the walls 189, made of foam, and the stiffener 254 is the discrete mass 176 of polymeric material. The golf club head 100 of FIGS. 36 and 37 also includes apertures 172, formed in the face portion 142, through which the polymeric material of the discrete mass 176 is respectively added to form the stiffener assemblies 260. Each aperture 172 is plugged with a plug 179 after adding the polymeric material.

Although not shown, the stiffener assemblies 260 of the golf club head 100 of FIGS. 36 and 37, in another implementation, are configured in a manner similar to those of the golf club head 100 of FIGS. 31B and 32B to have a base 187, made of foam, between the discrete masses 176 of polymeric material and the interior surface of the body 110.

Figure 31C:
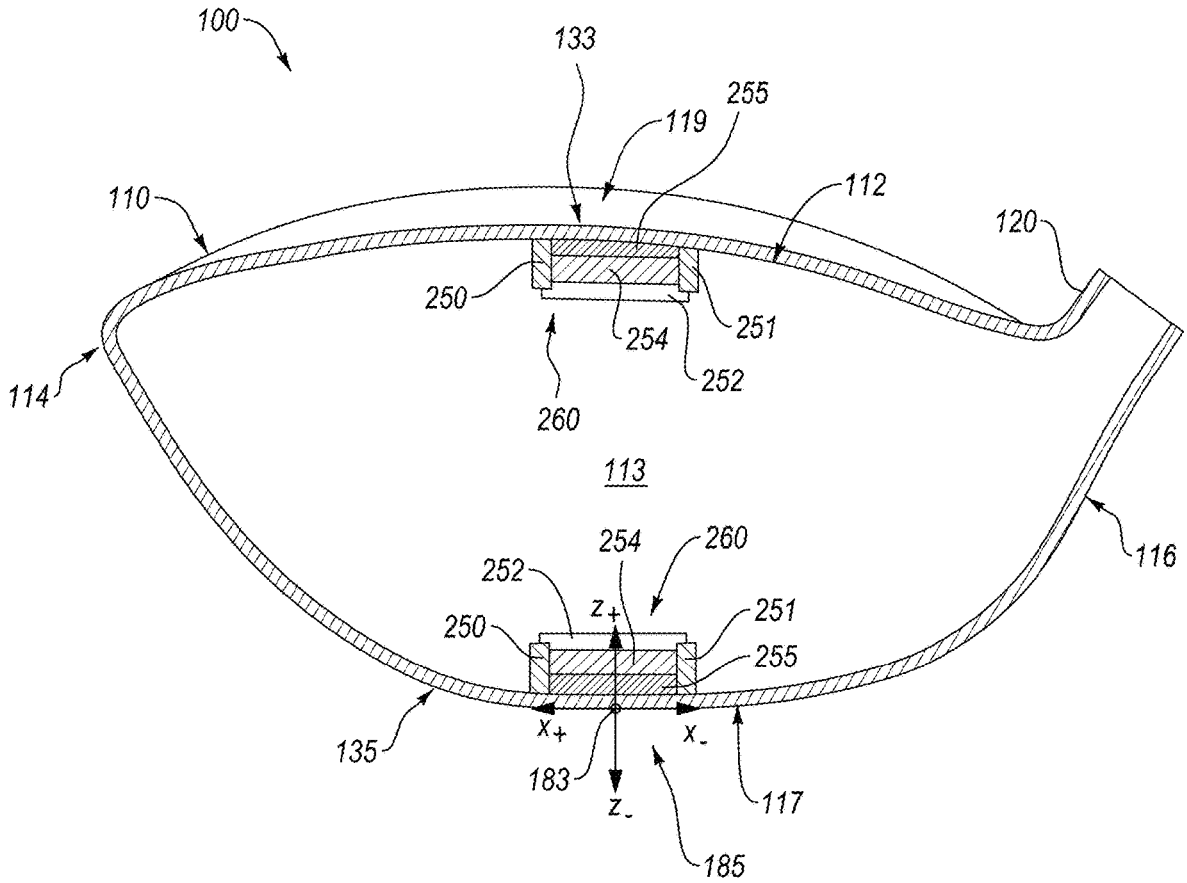
FIG. 31C is a cross-sectional front view of a golf club head, taken along a line similar to line 31-31 of FIG. 2, according to one or more examples of the present disclosure.

The stiffener assemblies 260 of the golf club head 100 of FIGS. 31A, 31B, 32A, and 32B are shown offset from the center of the face portion 142 (e.g., center face). Accordingly, the stiffeners 254 of the golf club head 100 of FIGS. 31A, 31B, 32A, and 32B are offset from the center of the face portion 142. In contrast, or in addition, to offset stiffener assemblies 260, in some examples, such as shown in FIG. 31C, at least one stiffener assembly 260 of the golf club head 100 is aligned with the center of the face portion 142 (i.e., positioned along a y-z plane of the club head origin coordinate system 185). In such examples, the stiffener 254 of the corresponding stiffener assembly 260 is also align with the center of the face portion 142. A stiffening assembly 260 and a stiffener 254 are considered aligned with the center of the face portion 142 when at least a portion of the stiffener 254 has x-axis coordinate of the golf club head origin coordinate system 185 of zero. Although not in all examples, in the illustrated example of FIG. 31C, the golf club head 100 includes a stiffener assembly 260, at the bottom of the golf club head 100, that is aligned with the center of the face portion 142 and a stiffener assembly 260, at the top of the golf club head 100, that is aligned with the center of the face portion 142.

Figure 40:
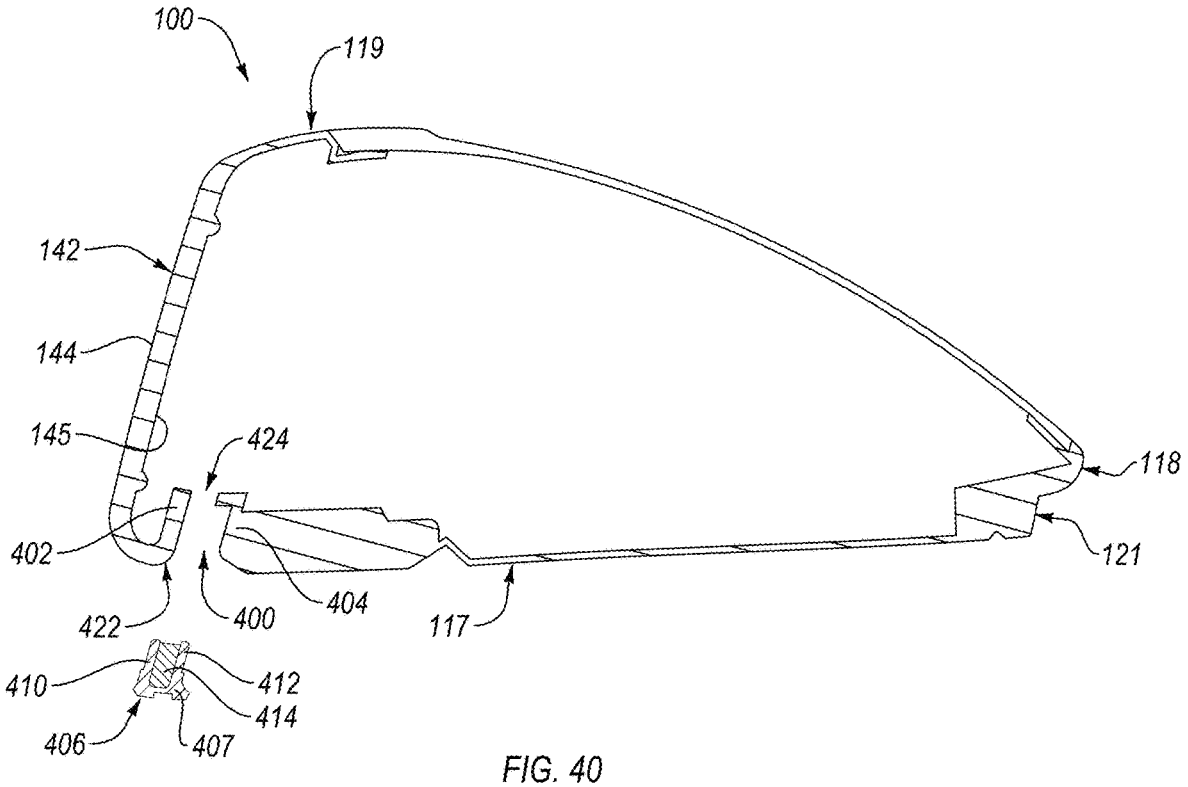
FIG. 40 is a cross-sectional side elevation view of a golf club head, taken along a line similar to line 1-1 of FIG. 2, according to one or more examples of the present disclosure.
Figure 41A:
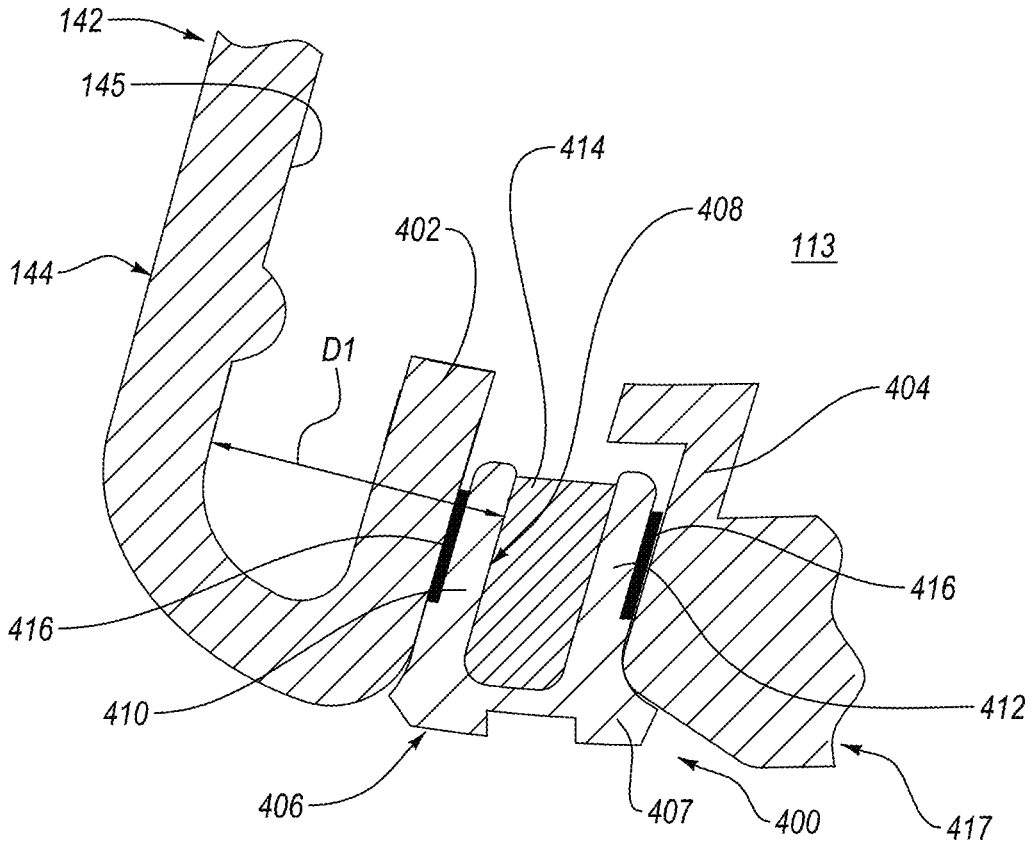
FIG. 41A is a cross-sectional side elevation view of a face-to-sole transition area of a golf club head, taken along a line similar to line 1-1 of FIG. 2, according to one or more examples of the present disclosure.

Referring to FIGS. 38-43, the golf club head 100, according to another embodiment, includes a slot 400 and an insert 406 fixedly retained within the slot 400. The slot 400 is similar to the slot 170 described above. For example, the slot 400 is formed in the sole portion 117 of the body 110 and extends lengthwise (e.g., longitudinally) in a generally heel-to-toe direction. More specifically, the slot 400 is parallel with and offset from the face portion 142. Along the length of the slot 400, the slot 400 is defined between a front wall 402 and a back wall 404. The front wall 402 and the back wall 404 extends substantially uprightly into the interior cavity 113 of the golf club head 100 away from the sole portion 117. The slot 400 is co-formed with the body 110 and is made of the same material as the body 110. Referring to FIGS. 40 and 41, the slot 400 is open to the interior cavity 113 of the body 110 in some examples. More specifically, the slot 400 includes a first open end 422 and a second open end 424. The first open end 422 can be considered a bottom open end and the second open end 424 can be considered a top open end.

Figure 41B:
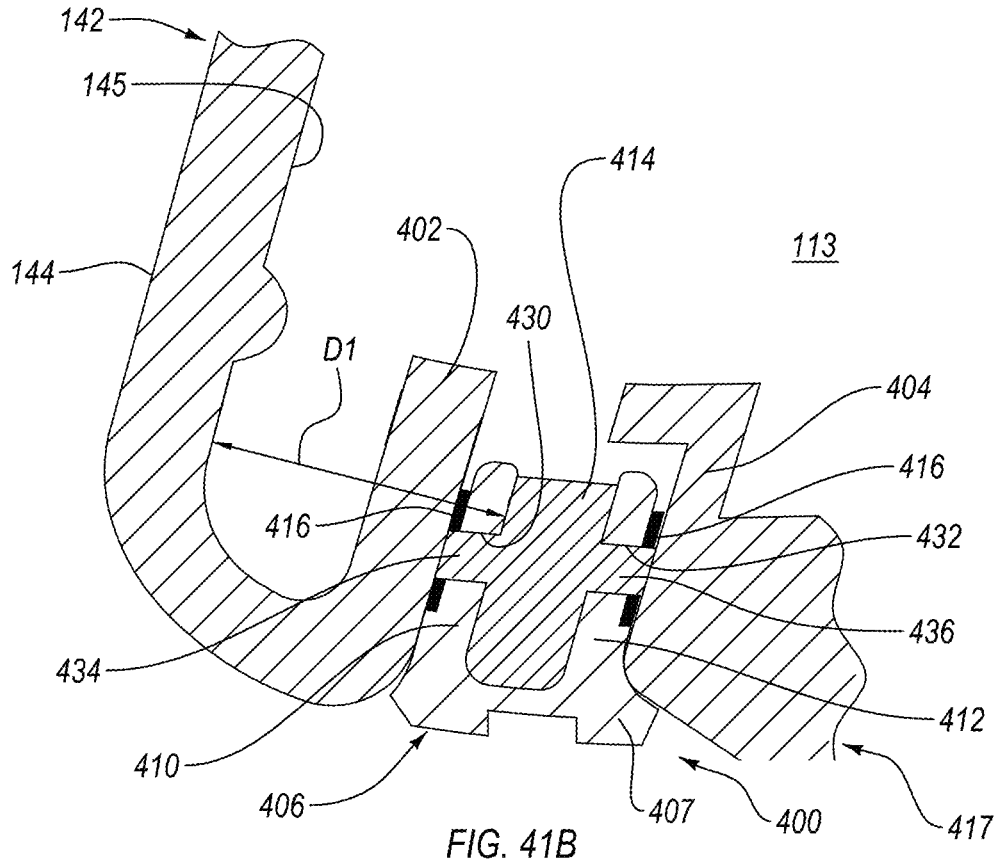
FIG. 41B is a cross-sectional side elevation view of a face-to-sole transition area of a golf club head, taken along a line similar to line 1-1 of FIG. 2, according to one or more examples of the present disclosure.

The insert 406 is formed separately from the formation of the body 110. The insert 406 is shaped to complement the shape of the slot 400. More specifically, the insert 406 is configured to be press-fit into the slot 400 in some examples. As shown in FIGS. 40 and 41, the insert 406 includes a base 406 spanning a width of the slot 400. When inserted into the slot 400, the base 406 covers or plugs the slot 400 to prevent access to the interior cavity 113 via the slot 400. Extending from the base 406 are sidewalls, such as a front side wall 410 and a back side wall 412. The insert 406 further includes a channel 408 defined between the front side wall 410 and the back side wall 412. The channel 408 extends an entire length L1 of the insert 406, which is substantially the same length as the slot 400. The sidewalls of the slot 400 penetrate the slot 400 and engage the sides of the slot to help retain the insert 406 in the slot 400. Additionally, as shown in FIG. 41B, in some examples, adhesive or bonding materials 416 are positioned between the sidewalls of the insert 406 and the sides of the slot 400 to promote the fixed retention of the insert 406 in the slot 400. In some examples, the insert 406 is selectively removable from the slot 400 without damaging the insert 406 or the slot 400. Accordingly, in such examples, after removal, the insert 406 can be reinserted back into the slot 400.

The golf club head 100 of FIGS. 38-43 further includes at least one stiffener 414 fixedly retained within the channel 408 of the insert 406. The stiffener 414 is directly coupled to the front side wall 410 and the back sidewall 412 of the insert 406. The stiffener 414 can be configured similarly to the stiffener 254 of FIGS. 31A and 32A. For example, the stiffener 414 can be made of a polymeric material having a hardness similar to that of the discrete mass 189 of polymeric material described above. In some examples, the stiffener 414 is selectively removable from the channel 408, such that the stiffener 414 can be inserted into and removed from the channel 408 without damaging the insert 406 or the stiffener 414. Accordingly, in one example, the stiffener 414 is press-fit into the channel 408. However, in other examples, the stiffener 414 is non-removably fixed within the channel 408 of the insert 406, such as with an adhesive.

In some examples, the slot 400 is made of a first material having a first modulus of elasticity, the stiffener 414 is made of a second material having a second modulus of elasticity, and the insert 406 is made of a third material having a third modulus of elasticity. In these examples, the second modulus of elasticity is higher than the third modulus of elasticity and lower than the first modulus of elasticity. The ranges of values of the first modulus of elasticity, the second modulus of elasticity, and the third modulus of elasticity can be the same as those listed above. According to one example, the slot 400 is made of metal, such as steel or titanium, the insert 406 is made of plastic, and the stiffener 414 is made of acrylic.

When the insert 406, with the stiffener 414, is inserted into the slot 400, the stiffener 414 affects the CT of the golf club head 100. Although the stiffener 414 does not directly contact the interior surface 145 of the face portion 142, the close proximity of the stiffener 414 relative to the face portion 142, and the indirect coupling of the stiffener 414 with the face portion 142 via the front wall 402 of the slot 400 and the front side wall 410 of the insert 406, helps to stiffen the face portion 142 and thus affect (e.g., reduce) the CT of the golf club head 100.

To help improve the effect of the stiffener 414 on the CT of the golf club head 100, in some examples, as shown in FIG. 41B, the stiffener 414 is configured to be directly coupled to the front wall 402 and the back wall 404 that define the slot 400. Direct coupling of the stiffener 414 to the front wall 402 and the back wall 404 magnifies the stiffening effect of the stiffener 414 on the face portion 142 by decreasing the distance D1 between the interior surface 145 and the stiffener 414 and effectually making the stiffener 414 more directly coupled to the face portion 142. The stiffener 414 is directly coupled to the front wall 410 and the back wall 404 by passing a front extension tab 434 of the stiffener 414 through a front aperture 430 formed in the front side wall 410 of the insert 406 and passing a back extension tab 436 of the stiffener 414 through a back aperture 432 formed in the back side wall 412 of the insert 406. The front extension tab 434 directly contacts the front wall 402 and the back extension tab 436 directly contacts the back wall 404. In this manner, the stiffener 414 is directly coupled to the front wall 402 and the back wall 404.

Figure 42:
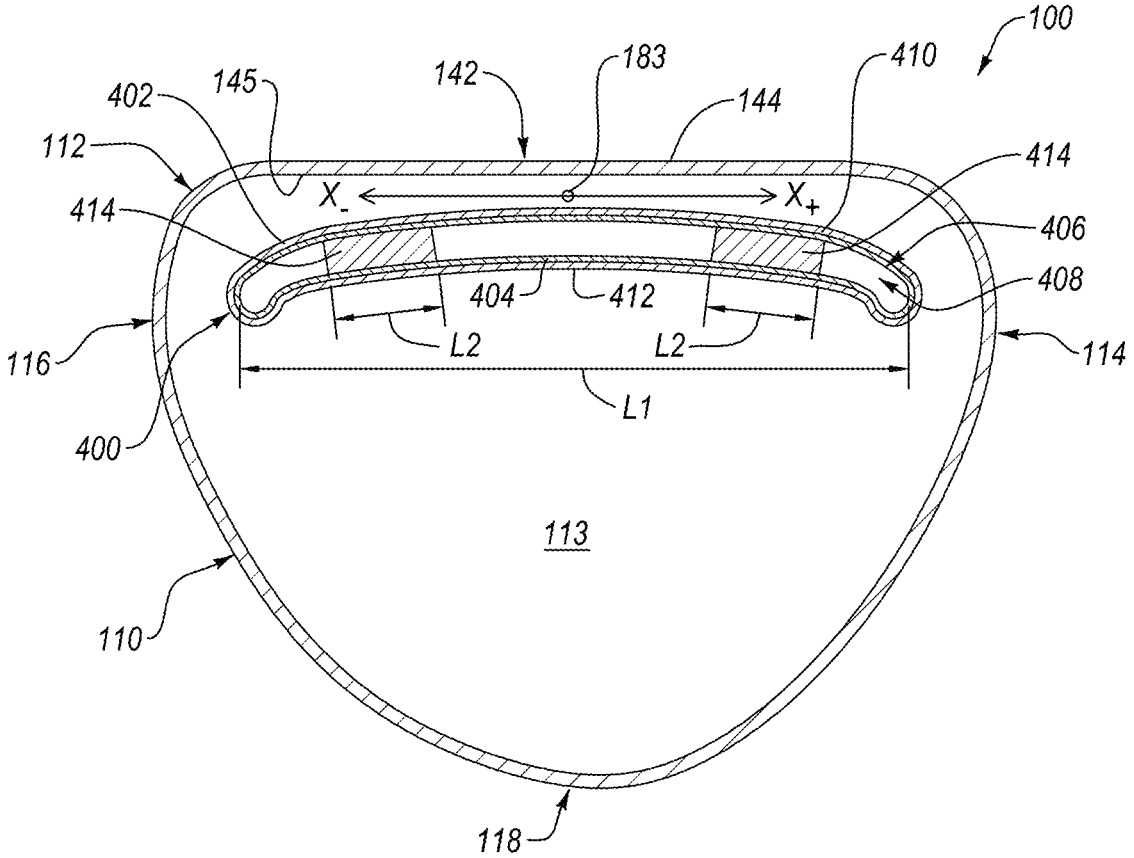
FIG. 42 is a cross-sectional top view of a golf club head, taken along a line similar to line 3-3 of FIG. 5, according to one or more examples of the present disclosure.

Referring to FIG. 42, the length L2 of the stiffener 414 is less than the length L1 of the insert 406 and less than the entire length of the channel 408. The stiffener 414 can be located along the channel 408 such that when the insert 406 is inserted into the slot 400, the stiffener 414 is toeward of, heelward of, or aligned with the center of the face portion 142. For example, the stiffener 414 can be positioned in any of the various positions of the stiffener 150 described above. The golf club head 100 may have more than one stiffener 414 fixedly retained in the channel 408 of the insert 406 as shown in FIG. 42. The stiffeners 414 are spaced apart along the length of the channel 408. The multiple stiffeners 414 may be configured the same as each other.

Alternatively, the multiple stiffeners 414 may be configured differently from one another, such as, for example, made of materials of different moduli of elasticity, different hardness, differently sized, differently shaped, and the like. The different configurations may be dependent on the corresponding locations of the stiffeners 414. For example, the stiffener 414 offset toewardly from the center of the face portion 142 may have a higher modulus of elasticity than the stiffener 414 heelward from the center of the face portion 142.

Figure 43:
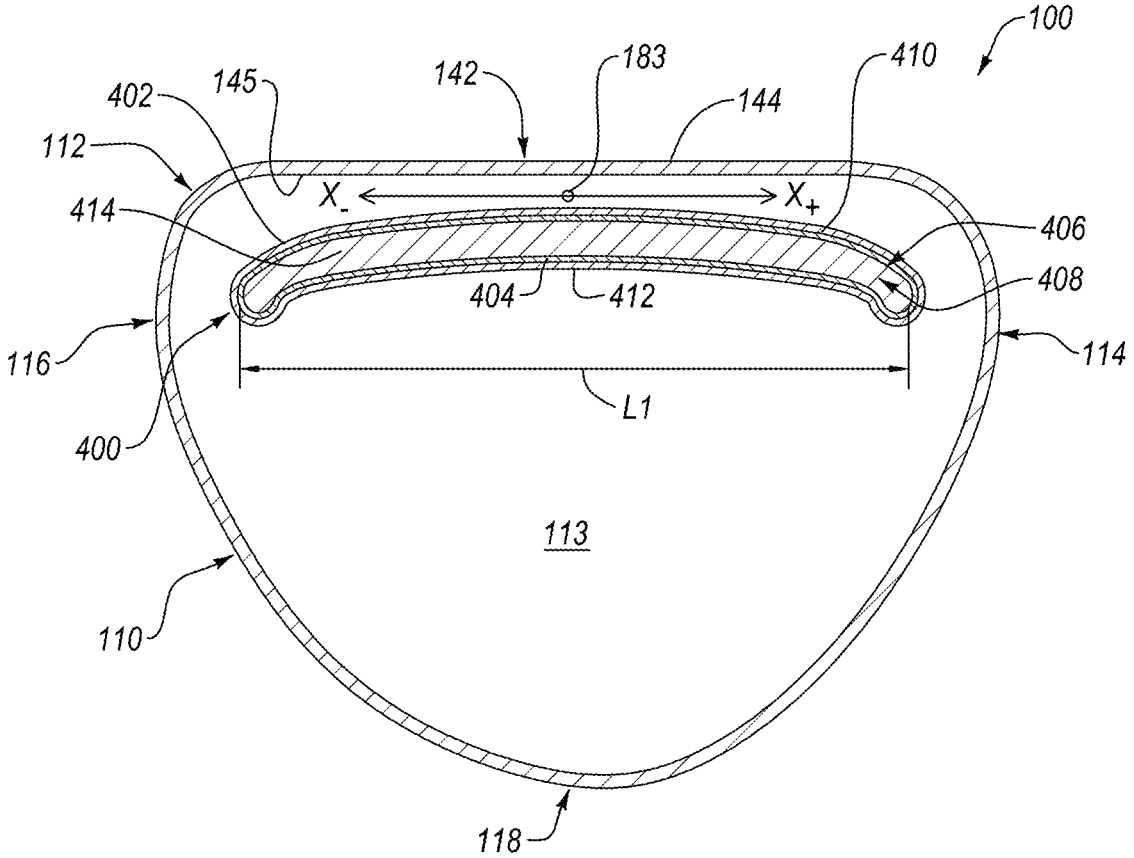
FIG. 43 is a cross-sectional top view of a golf club head, taken along a line similar to line 3-3 of FIG. 5, according to one or more examples of the present disclosure.

Alternatively, referring to FIG. 43, the insert 406 includes a single stiffener 414 with a length L2 substantially equal to the length L1 of the insert 406 and the channel 408. In other words, the stiffener 414 may extend along an entirety of the length of the channel 408.

One example of a method of tuning CT of the golf club head 100 of FIGS. 38-43 includes measuring a first measured CT value on the face portion 142 of the golf club head 100 with the insert 406 and stiffener 414 retained within the slot 400. If the first measured CT value does not meet an intended target CT, the insert 406 with the stiffener 414 is removed from the slot 400.

In one example, after the insert 406 is removed, the existing stiffener 414 is removed and replaced by a new stiffener 414, such as one that is made of a material with a higher modulus of elasticity or one that is made of a material with the same modulus of elasticity but having a larger size. The same insert 406 with the new stiffener 414 is reinserted back into the slot 400. Such an adjustment results in an adjustment (e.g., decrease) to the CT of the golf club head at the same location on the face portion that the first measured CT value was measured. The adjusted CT can be confirmed by taking another measurement after the insert 406 is reinserted.

In another example, after the insert 406 is removed, a new insert 406 with a stiffener 414, configured differently than the stiffener 414 of the removed insert 406, is inserted into the slot 400 in place of the removed insert 406. Such an adjustment results in an adjustment (e.g., decrease) to the CT of the golf club head at the same location on the face portion that the first measured CT value was measured. The adjusted CT can be confirmed by taking another measurement after the new insert 406 is inserted.

Figure 44:
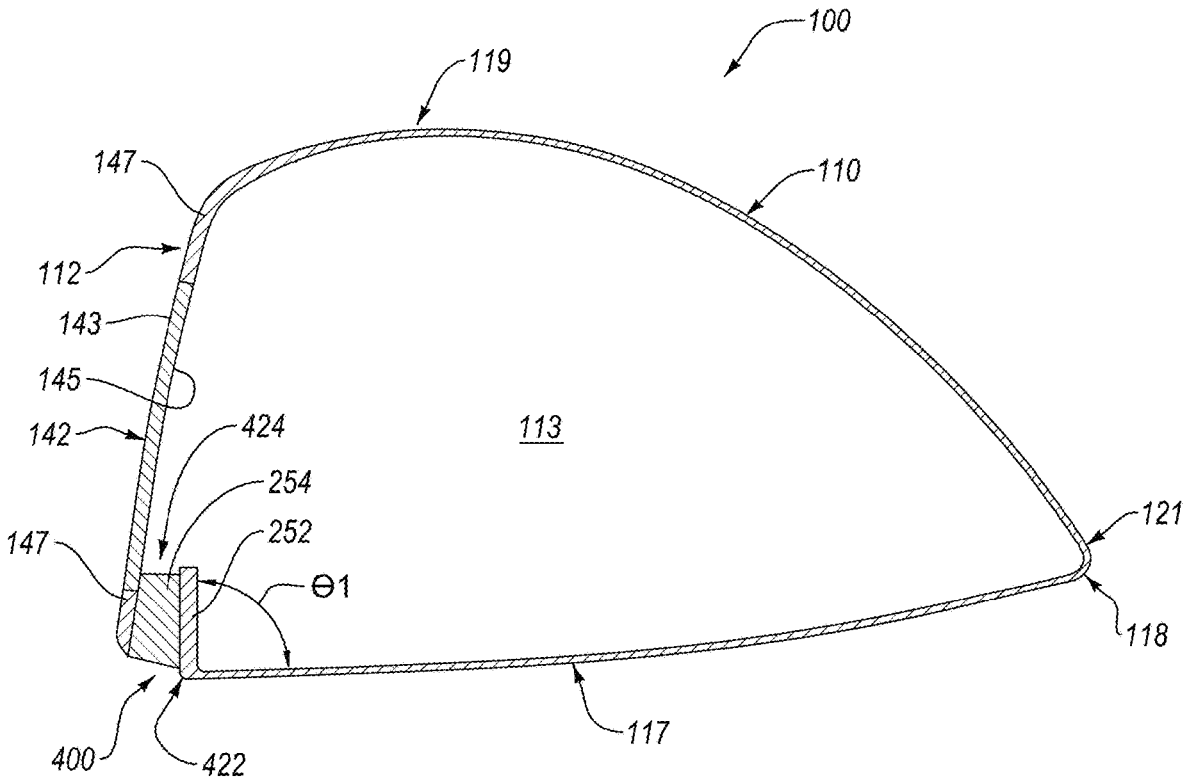
FIG. 44 is a cross-sectional side elevation view of a golf club head, taken along a line similar to line 1-1 of FIG. 2, according to one or more examples of the present disclosure.
Figure 45:
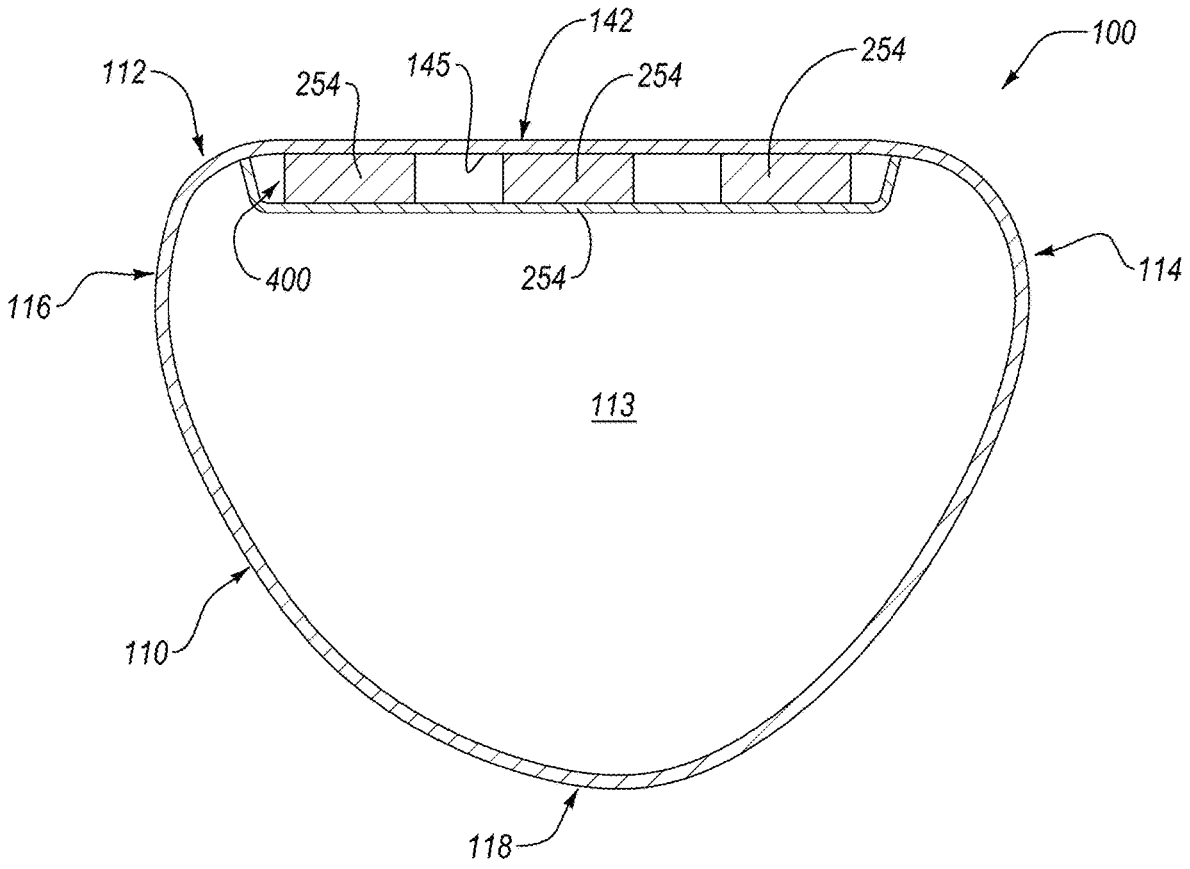
FIG. 45 is a cross-sectional top view of a golf club head, taken along a line similar to line 3-3 of FIG. 5, according to one or more examples of the present disclosure.

Referring now to FIGS. 44 and 45, according to another example, the golf club head 100 includes a first wall 252 and a stiffener 254 interposed between the first wall 252 and the interior surface 145 of the face portion 142. The golf club head 100 also includes a slot 400 formed in the sole portion 117 of the body 110. The slot 400 extends lengthwise (e.g., longitudinally) in a generally heel-to-toe direction. More specifically, the slot 400 is parallel with the face portion 142. Along the length of the slot 400, the slot 400 is defined directly between the interior surface 145 of the front portion 142 and the retaining wall 252. Accordingly, the slot 400 of the golf club head 100 of FIGS. 44 and 45 is not rearwardly offset from the interior surface 145, as with the slot 400 of the golf club head 100 of FIG. 40. Rather, the slot 400 of the golf club head 100 of FIGS. 44 and 45 is contiguous with the interior surface 145, which allows the stiffener 254 to be in direct contact with the interior surface 154. The stiffener 254 being in direct contact with the interior surface 154 magnifies the impact of the stiffener 254 on the CT of the golf club head 100.

The first wall 252 of FIGS. 44 and 45, like the retaining wall 180 of FIGS. 33 and 34, acts as a retaining wall that extends substantially uprightly into the interior cavity 113 of the golf club head 100 away from the sole portion 117. However, the first wall 252 in the golf club head 100 of FIGS. 44 and 45 is angled toward the face portion 142 at an obtuse angle θ1 defined between the first wall 252 and the interior surface of the sole portion 117 of the body 110. The first wall 252 is co-formed with the body 110 and is made of the same material as the body 110 in some implementations. The slot 400 is open to the interior cavity 113 of the body 110 in some examples. More specifically, the slot 400 includes a first open end 422 and a second open end 424. The first open end 422 can be considered a bottom open end and the second open end 424 can be considered a top open end.

Because the slot 400 of the golf club head 100 of FIG. 44 is defined directly by the interior surface 145, the stiffener 254 is wedged directly between the first wall 252 and the interior surface 145 of the face portion 142. In one example, the stiffener 254 is inserted into the slot 400 through the first open end 422. As the stiffener 254 is inserted, the narrowing width of the slot 400, in the upward direction and defined by the angled first wall 252, causes a gradually increased compression of the stiffener 254 between the interior surface 145 and the first wall 252. The compression of the stiffener 254 creates an interference fit of the stiffener 254 within the slot 400, which retains the stiffener 254 in the slot 400 during use of the golf club head 100. In some implementations, retention-promoting features may be added, such as adhesives, to promote the retention of the stiffener 254 in the slot 400. Additionally, or alternatively, in certain implementations, the stiffener 254 may be inserted into the slot 400 in an expandable state (e.g., a pre-cured state), such that after being inserted into the slot 400 the stiffener 245 expands in the slot 400 to promote the retention of the stiffener 254 in the slot 400.

The stiffener 254 of the golf club head of FIGS. 44 and 45 is made of a second material having a second modulus of elasticity. The second modulus of elasticity is less than the first modulus of elasticity of the material of the first wall 252 and the face portion 142. In some examples, the second modulus of elasticity is between 0.5 GPa and 30.0 GPa. According to other examples, the second modulus of elasticity is between 1.0 GPa and 5.0 GPa. Referring to FIG. 45, the length of the stiffener 254 is less than the entire length of the slot 400. The stiffener 254 can be located along the 400 such that when the stiffener 254 is inserted into the slot 400, the stiffener 254 is toeward of, heelward of, or aligned with the center of the face portion 142. For example, the stiffener 254 can be positioned in any of the various positions of the stiffener 150 described above. Again referring to FIG. 45, the golf club head 100 may have more than one stiffener 254 fixedly retained in the slot 400. The stiffeners 254 are spaced apart along the length of the channel 400. The multiple stiffeners 254 may be configured the same as each other. Alternatively, the multiple stiffeners 254 may be configured differently from one another, such as, for example, made of materials of different moduli of elasticity, different hardness, differently sized, differently shaped, and the like. The different configurations may be dependent on the corresponding locations of the stiffeners 254. For example, the stiffeners 254 offset toewardly from the center of the face portion 142 may have a higher modulus of elasticity than the stiffener 254 aligned with the center of the face portion 142.

According to one example, a method of tuning CT of the golf club head 100 of FIGS. 44 and 45 includes measuring a first measured CT value on the face portion 142 of the golf club head 100 with the stiffener 254 retained within the slot 400. If the first measured CT value does not meet an intended target CT, the stiffener 254 is removed from the slot 400.

In one example, the removed stiffener 254 is replaced by a new stiffener 254, such as one that is made of a material with a higher modulus of elasticity, higher hardness, or one that is made of a material with the same modulus of elasticity but having a larger size. In other words, the new stiffener 414 is inserted into the slot 400 in place of the removed stiffener 254. Such an adjustment results in an adjustment (e.g., decrease) to the CT of the golf club head at the same location on the face portion that the first measured CT value was measured. The adjusted CT can be confirmed by taking another measurement after the new stiffener 254 is inserted. According to another example, the original stiffener 254 is moved into a new location along the slot 400 to adjust the CT to meet the intended target CT.

Although not specifically shown, the golf club head 100 of the present disclosure may include other features to promote the performance characteristics of the golf club head 100. For example, the golf club head 100, in some implementations, includes movable weight features similar to those described in more detail in U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; 7,410,425; and 7,410,426, the entire contents of each of which are incorporated herein by reference in their entirety.

In certain implementations, for example, the golf club head 100 includes slidable weight features similar to those described in more detail in U.S. Pat. Nos. 7,775,905 and 8,444,505; U.S. patent application Ser. No. 13/898,313, filed on May 20, 2013; U.S. patent application Ser. No. 14/047,880, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015, the entire contents of each of which are hereby incorporated herein by reference in their entirety.

According to some implementations, the golf club head 100 includes aerodynamic shape features similar to those described in more detail in U.S. Patent Application Publication No. 2013/0123040A1, the entire contents of which are incorporated herein by reference in their entirety.

In certain implementations, the golf club head 100 includes removable shaft features similar to those described in more detail in U.S. Pat. No. 8,303,431, the contents of which are incorporated by reference herein in in their entirety.

According to yet some implementations, the golf club head 100 includes adjustable loft/lie features similar to those described in more detail in U.S. Pat. Nos. 8,025,587; 8,235,831; 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677, the entire contents of which are incorporated by reference herein in their entirety.

Additionally, in some implementations, the golf club head 100 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677, the entire contents of each of which are incorporated by reference herein in their entirety.

In some implementations, the golf club head 100 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

In some examples, the golf club head includes a plurality of stiffeners located within the interior cavity of the body and offset from the interior surface of the face portion by at least 1 mm and by no more than 20 mm as measured along a head origin y-axis. The plurality of stiffeners are elongated stiffening members extending between an interior surface of the crown portion and an interior surface of the sole portion. For example, the plurality of stiffeners are the same, as or similar to, the stiffening members shown and described in U.S. patent application Ser. No. 14/855,190, filed Sep. 15, 2015, the brace bars shown and described in U.S. patent application Ser. No. 15/859,297, filed Dec. 29, 2017, and the stiffening tubes shown and described in U.S. Pat. No. 9,795,840, issued Oct. 24, 2017, which are all incorporated herein by reference in their entirety.

Figure 47:
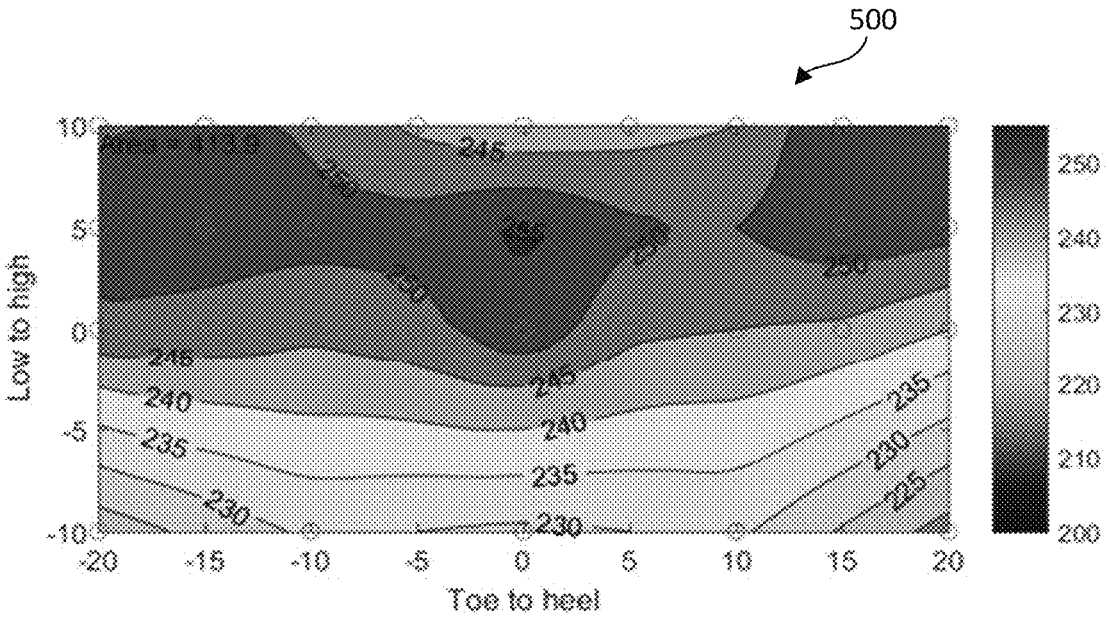
FIG. 47 is a chart showing characteristic time (CT) values within a central region of the strike face of a golf club head, according to one or more examples of the present disclosure.
Figure 48:
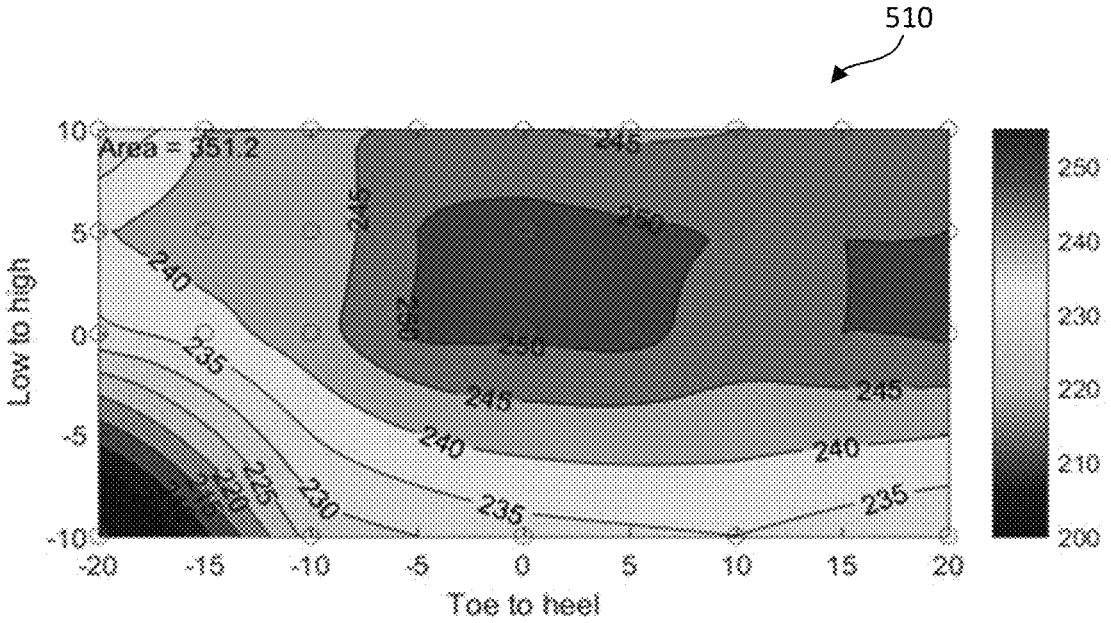
FIG. 48 is a chart showing characteristic time (CT) values within a central region of the strike face of a golf club head, according to one or more examples of the present disclosure.

The features of the golf club head described herein, including the ability to tune the CT after complete manufacturing of the golf club head, promote higher CT values across larger surface areas of the strike face, particularly within a central region, than convention golf club heads. For example, the chart 500 and 510 of FIGS. 47 and 48 show relatively higher CT values, within a central region of the strike face of two different implementations of the golf club head described herein, compared to conventional golf club heads. The central region of the strike face is defined by a forty millimeter by twenty millimeter rectangular area centered on a center of the strike face and elongated in a heel-to-toe direction. As indicated in the chart 500 and the chart 510, within the central region, the strike face of the golf club head described herein has a characteristic time (CT) of no more than 257 microseconds. Additionally, within the central region of at least one example of the golf club head described herein, such as those exemplified by the chart 500 and the chart 510, no less than 60% of the strike face has a CT of at least 235 microseconds. Furthermore, within the central region of at least one example of the golf club head described herein, such as those exemplified by the chart 500 and the chart 510, no less than 35%, 60%, or 70% of the strike face has a CT of at least 240 microseconds. Additionally, within the central region of at least one example of the golf club head described herein, such as those exemplified by the chart 500 and the chart 510, no less than 40% or 50% of the strike face has a CT of at least 245 microseconds. Also, within the central region of at least one example of the golf club head described herein, such as those exemplified by the chart 500 and the chart 510, no less than 10% or 15% of the strike face has a CT of at least 250 microseconds.

Figure 49:
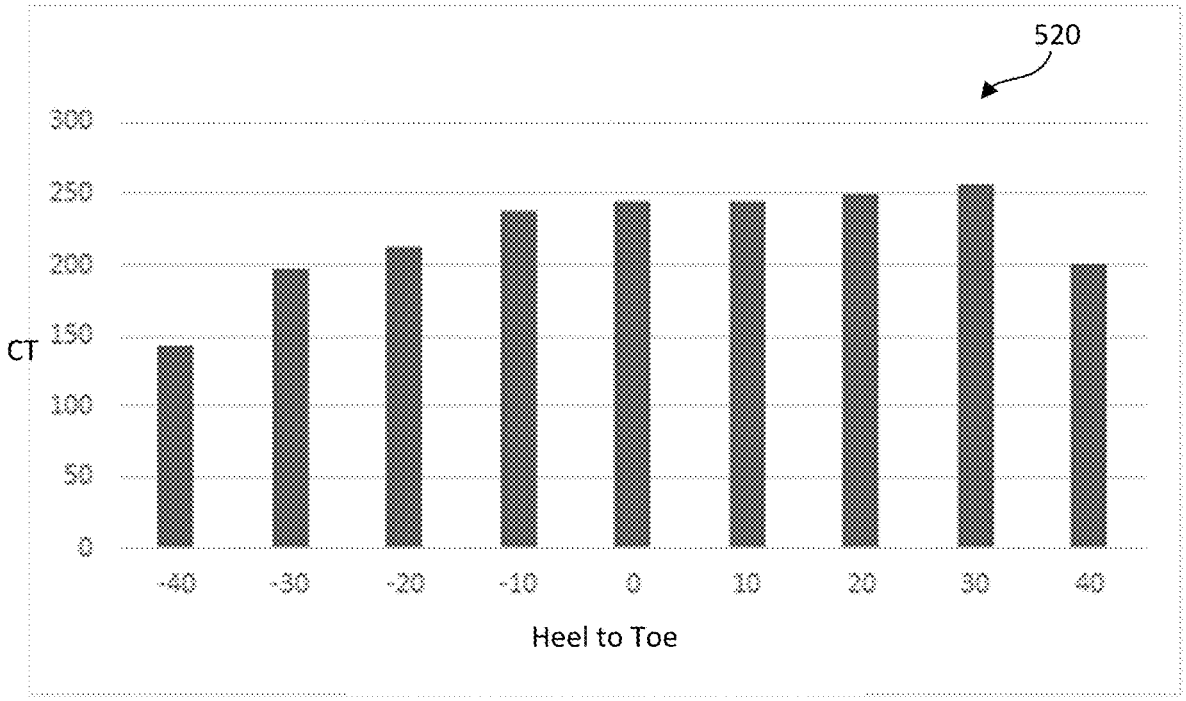
FIG. 49 is a chart showing characteristic time (CT) values along a horizontal path on the strike face passing through a center of the strike face, according to one or more examples of the present disclosure.

Additionally, in at least one example of the golf club head described herein, such as those exemplified by the chart 500 and the chart 510, more than 20% of the strike face has a CT of at least 245 microseconds. Furthermore, according to at least one example of the golf club head described herein, such as those exemplified by the chart 500 and the chart 510, the CT at any location on the strike face within at least five millimeters of the center of the strike face is greater than 240 microseconds. Referring to the chart 520 of FIG. 49, according to at least one example of the golf club head described herein, the CT of the strike face, along a horizontal path on the strike face passing through a center of the strike face, peaks at a distance of at least 30 millimeters toeward of the center of the strike face.

According to at least one example of the golf club head described herein, within the central region, no less than 25% of the strike face has a coefficient of restitution (COR) of at least 0.8. In at least one example, no less than 50% of the strike face, within the central region, has a coefficient of restitution (COR) of at least 0.8. According to yet another example, no less than 55% of the strike face, within the central region, has a coefficient of restitution (COR) of at least 0.8.

According to one embodiment, a method of making a golf club head, such as golf club head 100, includes one or more of the following steps: (1) forming a frame having a sole opening, forming a composite laminate sole insert, injection molding a thermoplastic composite head component over the sole insert to create a sole insert unit, and joining the sole insert unit to the frame; (2) providing a composite head component, which is a weight track capable of supporting one or more slidable weights; (3) forming a sole insert from a thermoplastic composite material having a matrix compatible for bonding with a weight track; (4) forming a sole insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; (5) forming both a sole insert and a weight track from thermoplastic composite materials having a compatible matrix; (6) forming a sole insert from a thermosetting material, coating a sole insert with a heat activated adhesive, and forming a weight track from a thermoplastic material capable of being injection molded over the sole insert after the coating step; (7) forming a frame from a material selected from the group consisting of titanium, one or more titanium alloys, aluminum, one or more aluminum alloys, steel, one or more steel alloys, and any combination thereof; (8) forming a frame with a crown opening, forming a crown insert from a composite laminate material, and joining the crown insert to the frame such that the crown insert overlies the crown opening; (9) selecting a composite head component from the group consisting of one or more ribs to reinforce the golf club head, one or more ribs to tune acoustic properties of the golf club head, one or more weight ports to receive a fixed weight in a sole portion of the golf club head, one or more weight tracks to receive a slidable weight, and combinations thereof; (10) forming a sole insert and a crown insert from a continuous carbon fiber composite material; (11) forming a sole insert and a crown insert by thermosetting using materials suitable for thermosetting, and coating the sole insert with a heat activated adhesive; (12) forming a frame from titanium, titanium alloy or a combination thereof to have a crown opening, a sole insert, and a weight track from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; and (13) forming a frame with a crown opening, forming a crown insert from a thermoplastic composite material, and joining the crown insert to the frame such that the crown insert overlies the crown opening.

Exemplary polymers for the embodiments described herein may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyethelipides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-SO2-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially important polysulfones are a) polysulfone (PSU); b) Polyethersulfone (PES also referred to as PESU); and c) Polyphenylene sulfoner (PPSU).

Particularly important and preferred aromatic polysulfones are those comprised of repeating units of the structure —C6H4SO2-C6H4-O— where C6H4 represents a m- or p-phenylene structure. The polymer chain can also comprise repeating units such as —C6H4-, C6H4-O—, —C6H4-(lower-alkylene)-C6H4-O—, —C6H4-O—C6H4-O—, —C6H4-S—C6H4-O—, and other thermally stable substantially-aromatic difunctional groups known in the art of engineering thermoplastics. Also included are the so called modified polysulfones where the individual aromatic rings are further substituted in one or substituents including

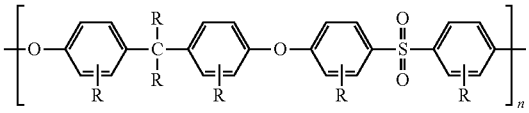

or

-continued

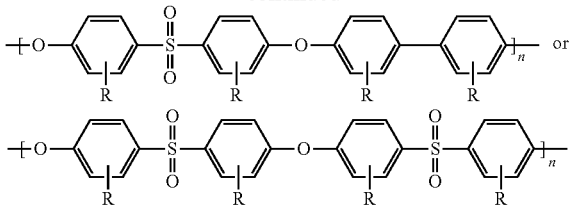

wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a C1-C20 alkyl group, a C2-C20 alkenyl group, a C3-C20 cycloalkyl group, a C3-C20 cycloalkenyl group, and a C6-C20 aromatic hydrocarbon group. These hydrocarbon groups may be partly substituted by a halogen atom or atoms, or may be partly substituted by a polar group or groups other than the halogen atom or atoms. As specific examples of the C1-C20 alkyl group, there can be mentioned methyl, ethyl, propyl, isopropyl, amyl, hexyl, octyl, decyl and dodecyl groups. As specific examples of the C2-C20 alkenyl group, there can be mentioned propenyl, isopropepyl, butenyl, isobutenyl, pentenyland hexenyl groups. As specific examples of the C3-C20 cycloalkyl group, there can be mentionedcyclopentyl and cyclohexyl groups. As specific examples of the C3-C20 cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers include (a) the polysulfone made by condensation polymerization of bisphenol A and 4,4'-dichlorodiphenyl sulfone in the presence of base, and having the main repeating structure

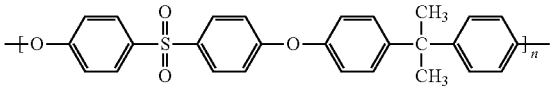

and the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

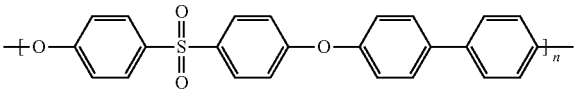

and the abbreviation PPSF and sold under the tradenames RADEL® resin; and (c) a condensation polymer made from 4,4'-dichlorodiphenyl sulfone in the presence of base and having the principle repeating structure

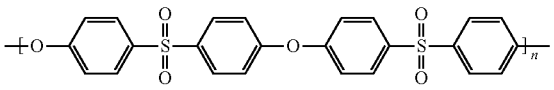

and the abbreviation PPSF and sometimes called a "polyether sulfone" and sold under the tradenames Ultrason® E, LNP™, Veradel®PESU, Sumikaexce, and VICTREX® resin," and any and all combinations thereof.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present). Examples of some of these composite materials for use in the metalwood golf clubs and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12/004,387, 11/960,609, 11/960,610, and 12/156,947, which are incorporated herein by reference in their entirety. The composite material may be manufactured according to the methods described at least in U.S. patent application Ser. No. 11/825,138, the entire contents of which are herein incorporated by reference.

Alternatively, short or long fiber-reinforced formulations of the previously referenced polymers can be used. Exemplary formulations include a Nylon 6/6 polyamide formulation, which is 30% Carbon Fiber Filled and available commercially from RTP Company under the trade name RTP 285. This material has a Tensile Strength of 35000 psi (241 MPa) as measured by ASTM D 638; a Tensile Elongation of 2.0-3.0% as measured by ASTM D 638; a Tensile Modulus of 3.30×106 psi (22754 MPa) as measured by ASTM D 638; a Flexural Strength of 50000 psi (345 MPa) as measured by ASTM D 790; and a Flexural Modulus of 2.60×106 psi (17927 MPa) as measured by ASTM D 790.

Other materials also include is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Yet other materials include is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Especially preferred materials include a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Also, preferred materials may include a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Further preferred materials include a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A golf club head, comprising:

a body, defining an interior cavity and comprising:

a sole portion, positioned at a bottom region of the golf club head, the sole portion having a sole surface area;

a crown portion, positioned at a top region of the golf club head, the crown portion having a crown surface area;

a skirt portion, positioned around a periphery of the golf club head between the sole portion and the crown portion;

a forward region;

a rearward region, opposite the forward region;

a heel region; and a toe region, opposite the heel region;

a face portion, coupled to the body, at the forward region of the body, and comprising a strike face and an interior surface, opposite the strike face; and a stiffener located within the interior cavity of the body and in direct contact with the interior surface of the face portion at only a bottom region of the golf club head below a geometric center of the strike face, wherein the stiffener is made of a polymeric material having a hardness of at least Shore 5.95D;

wherein:

an areal weight of the crown portion of the golf club head is less than about 0.35 g/cm$^2$ over more than about 50% of an entire surface area of the crown portion and at least a portion of the crown portion is formed of a non-metal material with a density between about 1 g/cm$^3$ to about 2 g/cm$^3$;

an areal weight of the sole portion of the golf club head is less than about 0.35 g/cm$^2$ over more than about 50% of an entire surface area of the sole portion and at least a portion of the sole portion is formed of a non-metal material with a density between about 1 g/cm$^3$ to about 2 g/cm$^3$;

the golf club head has a center of gravity (CG) with a head center face origin x-axis coordinate between about −5 mm and about 5 mm and a head center face origin y-axis coordinate between about 25 mm and about 50 mm, and a center face head origin z-axis coordinate less than 2 mm;

the strike face has a central region, defined by a forty millimeter by twenty millimeter rectangular area centered on a center of the strike face and elongated in a heel-to-toe direction;

the face portion has a thickness that varies;

within the central region, the face portion has a maximum face thickness no more than 5 mm and a minimum face thickness no less than 2.0 mm;

within the central region, the strike face has a characteristic time (CT) of no more than 257 microseconds;

a surface area of the interior surface of the face portion in contact with the stiffener is such that, within the central region, no less than 25% of the strike face has a coefficient of restitution (COR) of at least 0.8;

the surface area of the interior surface of the face portion in contact with the stiffener is such that, within the central region, no less than 60% of the strike face has a CT of at least 235 microseconds;

the surface area of the interior surface of the face portion in contact with the stiffener is such that, within the central region, no less than 35% of the strike face has a CT of at least 240 microseconds;

the golf club head has a volume between about 350 cm$^3$ and about 500 cm$^3$, a moment of inertia about a head center of gravity z-axis (Izz), and a moment of inertia about a head center of gravity x-axis (Ixx);

a summation of Izz and Ixx is between about 740 kg·mm$^2$ and about 1100 kg·mm$^2$; and a transition region defined between the face portion and the sole portion, wherein no portion of the stiffener directly contacts an interior surface of the transition region.

2. The golf club head according to claim 1, the crown portion further comprises a crown opening having a peripheral edge configured to receive a crown insert.

3. The golf club head according to claim 2, wherein the sole portion further comprises a sole opening having a peripheral edge configured to receive a sole insert.

4. The golf club head according to claim 3, wherein at least one of the sole insert and the crown insert are formed of a non-metal material having a density between about between about 1 g/cm$^3$ to about 2 g/cm$^3$.

5. The golf club head according to claim 4, wherein the non-metal material is a polymer-reinforced composite material.

6. The golf club head according to claim 5, wherein the face portion is formed of a titanium alloy and is unitarily cast with at least a portion of the body and the face portion has an alpha case thickness about 0.30 mm or less.

7. The golf club head according to claim 6, wherein the face portion being cast substantially entirely of 9-1-1 titanium, wherein the 9-1-1 titanium comprises molybdenum, vanadium, and aluminum, and wherein the 9-1-1 titanium has a tensile strength of at least 958 MPa.

8. The golf club head according to claim 5, wherein the face portion is formed of an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti.

9. The golf club head according to claim 5, wherein the face portion is formed of a titanium alloy and is unitarily cast with at least a portion of the body and the face portion has an alpha case thickness about 0.30 mm or less.

10. The golf club head according to claim 5, wherein the face portion further comprises a face opening and a strike plate encloses the face opening.

11. The golf club head according to claim 10, wherein the strike plate is welded to the face opening.

12. The golf club head according to claim 10, wherein the strike plate is bonded or glued to the face opening.

13. The golf club head according to claim 10, wherein the face portion further comprises a composite face.

14. The golf club head according to claim 2, wherein more than 20% of the strike face has a CT of at least 245 microseconds.

15. The golf club head according to claim 2, wherein at least 60% of the strike face within the central region has a CT of at least 240 microseconds.

16. The golf club head according to claim 2, wherein the CT at any location on the strike face within at least five millimeters of the center of the strike face is greater than 240 microseconds.

17. The golf club head according to claim 1 wherein:

within the central region, a maximum thickness of the face portion is no more than 4 mm and a minimum thickness of the face portion is no less than 2.0 mm; and the CT at any location on the strike face within at least five millimeters of the center of the strike face is greater than 240 microseconds.

18. The golf club head according to claim 1, further comprising:

at least one aperture configured for selectively adding the stiffener into the interior cavity; and a plug removably inserted into the at least one aperture, wherein the plug is made of a material that is different than the polymeric material.

19. The golf club head according to claim 1, wherein the stiffener is in direct contact with the interior surface of the face portion at a location on the face portion that is at least 5 mm away from an outer peripheral edge of the face portion and that is toewardly offset from the geometric center of the strike face.

20. A golf club head, comprising:

a body, defining an interior cavity and comprising:

a sole portion, positioned at a bottom region of the golf club head, the sole portion having a sole surface area;

a crown portion, positioned at a top region of the golf club head, the crown portion having a crown surface area;

a skirt portion, positioned around a periphery of the golf club head between the sole portion and the crown portion;

a forward region;

a rearward region, opposite the forward region;

a heel region; and a toe region, opposite the heel region;

a face portion, coupled to the body, at the forward region of the body, and comprising a strike face and an interior surface, opposite the strike face; and a stiffener located within the interior cavity of the body and in direct contact with the interior surface of the face portion at only a bottom region of the golf club head below a geometric center of the strike face, wherein the stiffener is made of a polymeric material having a hardness of at least Shore 5.95D;

wherein:

an areal weight of the crown portion of the golf club head is less than about 0.35 g/cm$^2$ over more than about 50% of an entire surface area of the crown portion and at least a portion of the crown portion is formed of a non-metal material with a density between about 1 g/cm$^3$ to about 2 g/cm$^3$;

an areal weight of the sole portion of the golf club head is less than about 0.35 g/cm$^2$ over more than about 50% of an entire surface area of the sole portion and at least a portion of the sole portion is formed of a non-metal material with a density between about 1 g/cm$^3$ to about 2 g/cm$^3$;

the golf club head has a center of gravity (CG) with a head center face origin x-axis coordinate between about −5 mm and about 5 mm and a head center face origin y-axis coordinate between about 25 mm and about 50 mm, and a center face head origin z-axis coordinate less than 2 mm;

the strike face has a central region, defined by a forty millimeter by twenty millimeter rectangular area centered on a center of the strike face and elongated in a heel-to-toe direction;

the face portion has a thickness that varies;

within the central region, the face portion has a maximum face thickness no more than 5 mm and a minimum face thickness no less than 2.0 mm;

within the central region, the strike face has a characteristic time (CT) of no more than 257 microseconds;

a surface area of the interior surface of the face portion in contact with the stiffener is such that, within the central region, no less than 25% of the strike face has a coefficient of restitution (COR) of at least 0.8;

the surface area of the interior surface of the face portion in contact with the stiffener is such that, within the central region, no less than 60% of the strike face has a CT of at least 235 microseconds;

the surface area of the interior surface of the face portion in contact with the stiffener is such that, within the central region, no less than 35% of the strike face has a CT of at least 240 microseconds;

the golf club head has a volume between about 350 cm$^3$ and about 500 cm$^3$, a moment of inertia about a head center of gravity z-axis (Izz), and a moment of inertia about a head center of gravity x-axis (Ixx);

a summation of Izz and Ixx is between about 740 kg·mm$^2$ and about 1100 kg·mm$^2$; and the stiffener is in direct contact with the interior surface of the face portion at a location on the face portion that is at least 5 mm away from an outer peripheral edge of the face portion and that is toewardly offset from the geometric center of the strike face.

* * * * *